US012365369B2

(12) United States Patent
Moloodi et al.

(10) Patent No.: US 12,365,369 B2
(45) Date of Patent: Jul. 22, 2025

(54) RAIL ROAD CAR TRUCK BOLSTER

(71) Applicant: NATIONAL STEEL CAR LIMITED, Hamilton (CA)

(72) Inventors: Sina Moloodi, Mississauga (CA); Usman Khan, Hamilton (CA)

(73) Assignee: National Steel Car Limited, Hamilton (CA)

( * ) Notice: Subject to any disclaimer, the term of this patent is extended or adjusted under 35 U.S.C. 154(b) by 614 days.

(21) Appl. No.: 17/665,221

(22) Filed: Feb. 4, 2022

(65) Prior Publication Data

US 2022/0153322 A1 May 19, 2022

Related U.S. Application Data

(62) Division of application No. 16/193,482, filed on Nov. 16, 2018, now Pat. No. 11,273,852.

(60) Provisional application No. 62/587,736, filed on Nov. 17, 2017.

(51) Int. Cl.
*B61F 5/52* (2006.01)

(52) U.S. Cl.
CPC ..... *B61F 5/52* (2013.01)

(58) Field of Classification Search
CPC ..... B61F 5/52
See application file for complete search history.

(56) References Cited

U.S. PATENT DOCUMENTS 1,436,188 A 11/1922 Miller
1,555,942 A 10/1925 Cartzdafner
1,628,839 A 5/1927 Haskell
1,902,807 A 3/1933 Dreibuss et al.
1,985,469 A 12/1934 Sumington
1,987,134 A 1/1935 Stertzbach
2,552,019 A * 5/1951 Stertzbach ..... B61F 5/04 105/230
3,266,601 A * 8/1966 Taylor ..... B61H 13/00 188/203
4,196,672 A 4/1980 Bullock
4,342,266 A 8/1982 Cooley
(Continued)

OTHER PUBLICATIONS

International Search Report and Written Opinion for PCT/CA2018/051457 dated Feb. 15, 2019.

*Primary Examiner* — Jason C Smith
(74) *Attorney, Agent, or Firm* — Hahn Loeser & Parks LLP

(57) ABSTRACT

A rail road car truck has a bolster having the form of a hollow beam that has a deep central portion and shallow ends. The bolster has a top flange, a bottom flange and internal and external webs extending between, intersecting and merging with the top and bottom flanges. A center plate bowl is located in the middle of the top flange, and brake rod passages are defined transversely through the bolster. In some embodiments, transverse ribs run underneath the center plate bowl. The ribs may be curved. The ribs may be flush with the brake rod openings in the various webs. There may be upwardly standing ribs running transversely across the bottom flange. Those lower ribs may terminate upwardly flush with the brake rod openings. Alternatively, the bottom portion of the bolster may by cast with a greater thickness, up to the bottom of the break rod openings. In other embodiments, the bolster may have partial or fully tubular brake rod opening liners or tubes that extend across the bolster beneath the center plate.

10 Claims, 32 Drawing Sheets

(56) References Cited

U.S. PATENT DOCUMENTS

| | | | | |
|---|---|---|---|---|
| 4,753,174 | A | 6/1988 | Berg et al. | |
| 5,111,753 | A * | 5/1992 | Zigler | B61F 5/04 105/230 |
| 5,241,913 | A | 9/1993 | Weber | |
| 5,718,177 | A | 2/1998 | Wronkiewicz et al. | |
| 5,752,564 | A | 5/1998 | Callahan et al. | |
| 6,196,134 | B1 * | 3/2001 | Stecker | B61F 5/04 105/228 |
| 6,662,853 | B2 | 12/2003 | Bauer et al. | |
| 7,497,169 | B2 | 3/2009 | Forbes et al. | |
| 7,681,506 | B2 * | 3/2010 | Forbes | B61F 5/52 105/226 |
| 9,346,098 | B2 | 5/2016 | Gotlund et al. | |
| 10,507,849 | B2 * | 12/2019 | Gotlund | B61F 5/52 |
| 10,913,469 | B2 * | 2/2021 | Woods | B61F 5/38 |
| 2006/0283351 | A1 * | 12/2006 | Forbes | B61F 5/52 105/157.1 |
| 2012/0291661 | A1 | 11/2012 | Gotlund et al. | |
| 2019/0152498 | A1 * | 5/2019 | Moloodi | B61F 3/02 |
| 2019/0152598 | A1 | 5/2019 | Moloodi | |
| 2019/0185032 | A1 * | 6/2019 | Woods | B61F 5/06 |

* cited by examiner

RAIL ROAD CAR TRUCK BOLSTER

This application claims priority as a divisional of U.S. patent application Ser. No. 16/193,482 filed Nov. 16, 2018, itself claiming priority from of U.S. Prov. Pat. Appn 62/587,736 filed Nov. 17, 2017, the specification and drawings of both of them being incorporated herein by reference.

FIELD OF THE INVENTION

This invention relates to the field of rail road car truck bolsters.

BACKGROUND

Railroad truck bolsters carry the loads of the railroad car body to the truck sideframes. They generally have the form of hollow beams with a deep center and shallow ends. The shallow ends are carried on the main spring groups that seat in the truck sideframes. The bolster has a center plate bowl that receives the center plate of the main bolster of the railcar body in a pivoting connection, allowing the truck to turn in yaw relative to the car body. The bolster generally has a top flange, a bottom flange, and webs that carry shear force between the top and bottom flanges. The center of the truck bolster has openings formed therethrough to accommodate brake rods.

SUMMARY OF THE INVENTION

In an aspect of the invention, there is a railroad car truck bolster. It has first and second brake rod opening envelopes extending therethrough. The bolster has at least a first vault or archway defined therewithin. The first vault arches over, and conforms to, the brake rod envelopes.

In a feature of that aspect of the invention, the first vault has an arcuate cross-section. The arcuate cross-section extends transversely across the bolster. In another feature, the bolster has a respective first and second transversely extending structural sections extending peripherally about the brake rod envelopes. The vaults are defined by upper portions of the continuous structural sections. In another feature, the bolster has a center plate bowl and the bolster has respective transversely running ribs extending downwardly of the center plate bowl to meet the vaults. In another feature, the bolster is a casting. In another the bolster is a steel casting.

In another aspect of the invention there is a railroad car truck bolster. It has first and second brake rod openings formed therein. The brake rod openings conform to respective first and second brake rod envelopes. The bolster has first and second cross-wise extending center plate reinforcement ribs formed therewithin. The center plate reinforcement ribs are located above, and clear of, the first and second brake rod envelopes respectively.

In a feature of that aspect of the invention the bolster has first and second internal, lengthwise-extending upright webs. The first rib extends between the first and second internal upright webs. In a further feature, the first rib has a central portion and first and second end portions. The central portion is located between the first and second upright webs. The end portions being located transversely outboard of the first and second upright webs respectively. In another feature, the bolster has first and second outside webs. The first and second end portions of the first rib merge into the first and second outside webs respectively. In still another feature, the central portion of the first rib has greater cross-sectional area than the end portions of the first rib. In a still further feature the first rib tapers in thickness from a widest dimension in the center portion to a narrower dimension in the end portions. In yet another feature, the bolster has a center plate bowl having an upstanding center plate bowl peripheral wall. The first rib is at least partially curved, and runs at least partially beneath the peripheral wall of the center plate bowl. In yet another further feature, the first rib has a lowermost margin that conforms to and that is flush with the first brake rod opening. In another feature, the first brake rod opening has an uppermost portion having a location of horizontal tangency. The first rib fills entirely such space as there is between the first and second webs lengthwise inboard from the location of tangency to a center plate center pin aperture of the bolster. In still another feature, the bolster has at least a first tunnel roof portion extending along and above at least a portion of the first brake rod envelope. In still another feature, the first rib merges into the tunnel roof portion. In yet another feature the tunnel roof portion is flush with at least one of the brake rod openings.

In another feature, the bolster includes at least a semi-tunnel roof extending through the bolster above each brake rod envelope. In yet another feature, the bolster includes a brake rod opening tube extending through the bolster. In a further feature, the tube has side openings. In another feature, each of the first and second ribs merges into a respective one of the tubes. In still another feature, the bolster has a bottom flange and the bottom flange has upstanding first and second ribs running transversely there across beneath the first and second brake rod opening envelopes. In an additional feature the first and second ribs merge flush with webs of the bolster through which the brake rod openings are formed. In another feature, the railroad car truck bolster has a tension member. The tension member has a central section and adjacent sloped sections to either side lengthwise thereof. The central section and the sloped sections have respective through-thicknesses. The through-thickness of the central portion is greater than the through-thickness of the sloped sections. The brake rod openings have respective peripheries having rounded lowermost portions. The central section of the tension member has an upper surface flush with the lowermost portions of the peripheries. In any of the foregoing aspects and features, the bolster may be a casting, such as a steel casting.

In still another aspect of the invention there is a railroad car truck bolster. It includes a hollow beam having a lengthwise extending tension member, a lengthwise extending compression member, and lengthwise running upstanding webbing extending between the compression member and the tension member. The compression member includes a center plate bowl. The bolster has first and second brake rod opening envelopes defined transversely therethrough. The webbing includes a first internal web and a first internal rib extending side-ways relative to the web. The first internal web has first and second brake rod openings providing clearance for the first and second brake rod clearance envelopes. The first brake rod opening has a periphery. The first rib stands upward of the tension member and has an uppermost margin flush with the periphery of the first brake rod opening.

In a feature of that aspect of the invention the first internal web has a second brake rod opening having a periphery, and a second rib standing upwardly of the tension member. The second rib has an uppermost margin flush with the periphery of the second brake rod opening. In another feature, the webbing includes a second internal web spaced from the first internal web. The first rib runs across the tension member between the first web and the second web. In another feature, the webbing of the bolster includes first and second external webs. The first rib extends across the tension member from the first external web to the second external web. In another feature, the first rib is a lower first rib. The truck has an upper first rib. The upper first rib extends underneath the center plate bowl sideways relative to the first web. The first upper rib terminates clear of the first brake rod opening envelope. In another feature, the first upper rib terminates flush with, and conforms to, the first brake rod opening. In still another feature, the first and second ribs are lower first and second ribs. The truck has upper first and second ribs. The upper first rib extends underneath the center plate bowl between first web and the second web. The first and second upper ribs terminate clear of the first and second brake rod opening envelopes respectively. In a further feature, the first and second upper ribs terminate flush with, and conform to, the first brake and second brake rod openings respectively.

In another aspect there is a railroad car truck bolster. It has a hollow beam having a lengthwise extending tension and compression members, and lengthwise running upstanding webbing extending between the compression and tension members. The compression member has a center plate bowl. The bolster has first and second brake rod opening envelopes defined transversely therethrough. The webbing includes a first internal web and a first internal rib extending side-ways relative to the web. The web has first and second brake rod openings providing clearance for the brake rod clearance envelopes. The first and second brake rod openings each have a periphery. Each periphery merges flush into the tension member.

In a feature of that aspect of the invention, the bolster has a second internal web spaced from the first internal web. The second internal web has corresponding first and second brake rod openings, each of them having a periphery that merges flush into the tension member. The bolster also has first and second center plate bowl reinforcement ribs running between the first and second webs below the center plate bowl and upwardly of the first and second brake rod openings of the first and second internal webs.

In another aspect of the invention there is a railroad car truck bolster having first and second brake rod tunnels formed cross-wise therethrough. Each brake rod tunnel has at least one of: (a) a tunnel roof portion extending along an uppermost portion of the tunnel, the tunnel roof portion extending underneath at least a portion of a center plate bowl of the bolster, the tunnel roof intersecting with at least a lengthwise running first internal web of the bolster; and (b) a tunnel floor portion extending along a lowermost portion of the tunnel, the tunnel floor portion intersecting with at least a lengthwise running first internal web of the bolster.

In a feature of that aspect of the invention, the first brake rod tunnel has both (a) and (b). In another feature, the first brake rod tunnel includes first and second vertical side wall portions connecting upper and lower portions of the first brake rod tunnel. In a further feature, at least one of the first and second vertical side wall portions has at least one lightening hole formed therein. In still another feature, at least one of: wherein the truck bolster includes (a), and the tunnel roof is semi-circular in cross-section; wherein the truck bolster includes (b), and the tunnel floor is semi-circular in cross-section. In a further feature, the brake rod tunnel has a lower portion having an open periphery between any pair of lengthwise running webs of the bolster. In still another feature, the bolster includes (a), and the bolster has a lengthwise running second internal web spaced apart from the first lengthwise running internal web, and the roof portion runs between and intersects the first and second internal webs. In yet another feature, the roof portion terminates at the first and second internal webs. In an alternate feature, the bolster has lengthwise running first and second external webs, and the roof portion intersects, and terminates at, the first and second external webs.

In still another feature, the bolster has a lengthwise-running second internal web and lengthwise running first and second external webs include first and second roof portions (a). The first roof portion (a) runs between, intersects and terminates at the first external web and the first internal web. The second roof portion (a) runs between, intersects, and terminates at the second external web and the second internal web. In another feature, the bolster includes at least a first upper cross-wise running rib. The cross-wise running rib is a center plate bowl reinforcement rib. It extends downwardly of the center plate bowl above the first brake rod tunnel. In still another feature, the bolster includes at least a first lower cross-wise running rib. The lower cross-wise running rib is a bottom flange reinforcement rib. The bottom flange reinforcement rib stands upwardly of a bottom flange of the bolster beneath the first brake rod tunnel. In still yet another feature, the truck bolster has both the first upper cross-wise reinforcement rib and the first lower cross-wise reinforcement rib. In still another feature, the bolster is a steel casting.

In another aspect of the invention there is a railroad car truck bolster having first and second brake rod passages defined therethrough. An upper portion of each passage is bounded by an at least partially tubular section that extends cross-wise relative to the truck bolster.

In a feature of that aspect of the invention, the tubular section defines a closed oval periphery. In another feature, the bolster includes a transversely extending center plate bolster reinforcement that extends downward to merge with the tubular section. In still another feature, the bolster includes a transversely extending bottom flange reinforcement rib that extends upwardly to merge with a lowermost portion of said tubular section. In still yet another feature, the tubular section has upstanding side walls. The upstanding side walls include lightening holes.

In another aspect of the invention there is a railroad car truck bolster. It has upper and lower flanges; a center plate bowl; first and second external side webs; and longitudinally extending first and second internal webs. The upper flange, lower flange, and first and second external side webs co-operating to define a hollow beam. The center plate bowl is formed in the upper flange. The first and second internal webs run lengthwise within the beam and are spaced apart from each other. The first and second external side webs are spaced from the first and second inside webs respectively. The first and second inside webs extend downwardly of the center plate bowl. The bolster has first and second brake rod clearance openings formed therethrough. The openings have a clearance envelope. Each of the first and second outside webs and each of the first and second internal webs conform to the brake rod opening clearance envelopes. A transversely extending rib is formed between the first and second internal webs under the center plate bowl and above the brake rod opening clearance envelope.

These and other aspects and features of the invention may be understood with reference to the description which follows, and with the aid of the illustrations of a number of examples.

BRIEF DESCRIPTION OF THE FIGURES

The description is accompanied by a set of illustrative Figures in which.

DETAILED DESCRIPTION

Figure 1A:
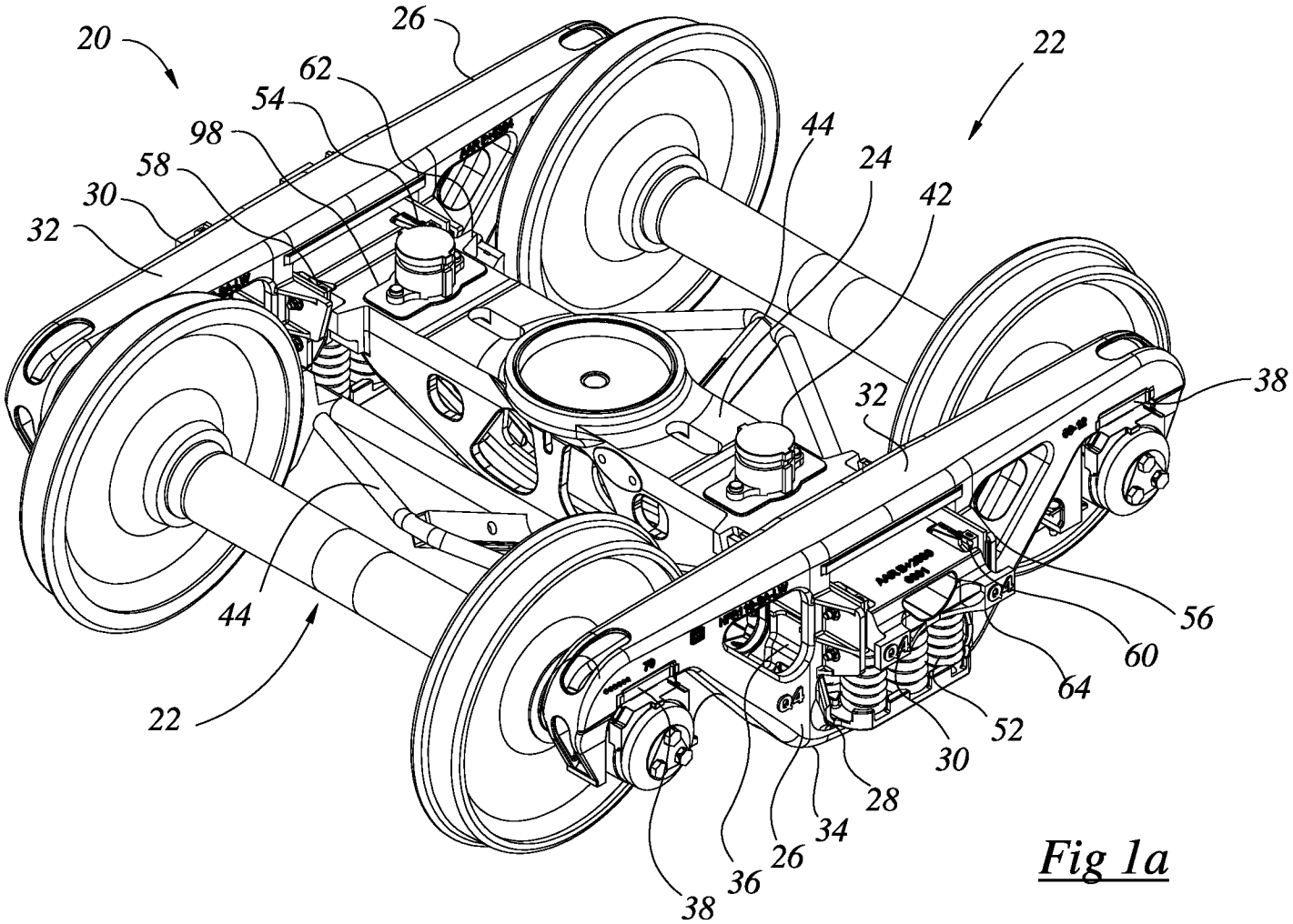
FIG. 1*a* is an isometric, general arrangement view of a railroad car truck such as may incorporate a truck bolster.

The description that follows, and the embodiments described therein, are provided by way of illustration of an example, or examples, of particular embodiments of the principles and aspects of the present invention. These examples are provided for the purposes of explanation, and not of limitation, of those principles and of the invention. In the description, like parts are marked throughout the specification and the drawings with the same respective reference numerals. The drawings are to scale unless noted otherwise. Some views are enlarged more clearly to depict certain features.

In terms of general orientation and directional nomenclature, for the rail road car truck described herein, the longitudinal direction is defined as being coincident with the rolling direction of the rail road car, or rail road car unit, when located on tangent (that is, straight) track. In the case of a rail road car having a center sill, the longitudinal direction is parallel to the center sill, and parallel to the side sills, if any. Unless otherwise noted, vertical, or upward and downward, are terms that use top of rail, TOR, as a datum. In the context of the truck as a whole, the term lateral, or laterally outboard, refers to a distance or orientation relative to the longitudinal centerline of the railroad car, or car unit, or of the centerline of the center plate bowl of the truck. The term "longitudinally inboard", or "longitudinally outboard" is a distance taken relative to a mid-span lateral section of the truck. Pitching motion is angular motion of a railcar unit about a horizontal axis perpendicular to the longitudinal direction. Yawing is angular motion about a vertical axis. Roll is angular motion about the longitudinal axis.

In the context of the truck bolster, such as truck bolster 24 described below, when the car is stationary on straight, level track, the long, or lengthwise, or longitudinal axis 25 of the truck bolster tends to be oriented cross-wise to the longitudinal axis of the truck or of the railroad car and railroad tracks more generally. In this description, the longitudinal axis 25 of the bolster may be considered the x-axis of the bolster. The transverse direction of the bolster may be considered the direction of the fore-and-aft thickness of the bolster, relative to the rolling direction of the truck, and may be designated the y-axis of the bolster. The up and down direction, which may be parallel to the axis of the center plate pin, when installed, may be considered the vertical or z-direction. Given that the rail road car truck and truck bolster described herein may tend to have both longitudinal and transverse axes of symmetry, a description of one half of an assembly may also be understood as being intended to describe the other half as well, allowing for differences between right and left hand parts. The commonly used engineering terms "proud", "flush" and "shy" may be used herein to denote items that, respectively, protrude beyond an adjacent element, are level with an adjacent element, or do not extend as far as an adjacent element, the terms corresponding conceptually to the conditions of "greater than", "equal to" and "less than".

Reference may be made herein to various plate sizes or standards of the Association of American Railroads, the AAR. Unless otherwise specified, those standards are to be interpreted as they were at the date of filing of this application, or if priority is claimed, then as of the earliest date of priority of any application in which the standard is identified.

This description relates to rail car trucks and truck components. Several AAR standard truck sizes are listed at page 711 in the 1997 *Car & Locomotive Cyclopedia*. As indicated, for a single unit rail car having two trucks, a "40 Ton" truck rating corresponds to a maximum gross car weight on rail (GRL) of 142,000 lbs. Similarly, "50 Ton" corresponds to 177,000 lbs., "70 Ton" corresponds to 220,000 lbs., "100 Ton" corresponds to 263,000 lbs., and "125 Ton" corresponds to 315,000 lbs. In each case the load limit per truck is then half the maximum gross car weight on rail. Two other types of truck are the "110 Ton" truck for railcars having a 286,000 lbs. GRL and the "70 Ton Special" low profile truck sometimes used for auto-rack cars.

Truck bolster 24 has seats for friction dampers. There are several types of damper arrangements, some being shown at pp. 715-716 of the 1997 *Car and Locomotive Cyclopedia*. Each of the arrangements of dampers shown at pp. 715 to 716 of the 1997 *Car and Locomotive Cyclopedia* can be modified to employ a four cornered, double damper arrangement of inner and outer dampers as shown in truck 20. In terms of general nomenclature, damper wedges tend to be mounted within an angled "bolster pocket" formed in an end of truck bolster 24. In cross-section, each wedge may then have a generally triangular shape, one side of the triangle being, or having, a bearing face; a second side which might be termed the bottom, or base, forming a spring seat; and the third side being a sloped side or hypotenuse between the other two sides. The first side may tend to have a substantially planar bearing face for vertical sliding engagement against an opposed bearing face of one of the sideframe columns. The second face may not be a face, as such, but rather may have the form of a socket for receiving the upper end of one of the springs of a spring group. Although the third face, or hypotenuse, may appear to be generally planar, in some embodiments it may tend to have a slight crown, having a radius of curvature of perhaps 60". The crown may extend along the slope and may also extend across the slope. The end faces of the wedges may be generally flat, and may have a coating, surface treatment, shim, or low friction pad to give a sliding engagement with the sides of the bolster pocket, or with the adjacent side of another independently slidable damper wedge, as may be.

Truck 20 is shown with double-damper arrangements, also called four cornered damper arrangements, at the bolster ends. Trucks with single damper arrangements, typically with dampers arranged over the fore-and-after outside springs of the central spring row are known, and features and aspects of the invention herein may be applied to single damper arrangements without need for redundant duplication of description. In the terminology herein, and as used in a double-damper, or four cornered damper arrangement, but as also may be used in a split-wedge single damper arrangement, the wedges and corresponding damper wedge packets formed in truck bolster 24 may have a primary angle $\alpha$, being the included angle between (a) the sloped damper pocket face mounted to the truck bolster, and (b) the side frame column face, as seen looking from the end of the bolster toward the truck center. In some embodiments, a secondary angle $\beta$ may be defined in the plane of angle $\alpha$, namely a plane perpendicular to the vertical longitudinal plane of the (undeflected) side frame, tilted from the vertical at the primary angle. That is, this plane is parallel to the (undeflected) long axis of the truck bolster, and taken as if sighting along the back side (hypotenuse) of the damper. The secondary angle $\beta$ is defined as the lateral rake angle seen when looking at the damper parallel to the plane of angle $\alpha$. As the suspension works in response to track perturbations, the wedge forces acting on the secondary angle $\beta$ may tend to urge the damper either inboard or outboard according to the angle chosen.

FIG. 1*a* shows an example of a rail road car truck 20 that is intended to be generically representative of a wide range of trucks in which the present invention may be employed. Truck 20 and truck bolster 24 thereof may be provided in different sizes, such as may be suitable for 70 ton, 100 ton, 110 ton, 125 ton as 70 ton special trucks. While truck 20 may be suitable for general purpose use, it may be optimized for carrying relatively low density, high value lading, such as automobiles or consumer products, for example, or for carrying denser semi-finished industrial goods, such as might be carried in rail road freight cars for transporting rolls of paper, or for carrying dense commodity materials such as coal, metallic ores, grain, potash, steel coils or other lading. Truck 20 is generally symmetrical about both its longitudinal and transverse, or lateral, centreline axes. Where reference is made to a sideframe, it will be understood that the truck has first and second sideframes, first and second spring groups, and so on.

Truck 20 has a truck bolster 24 mounted on main spring groups 52 in first and second side frames 26, which are themselves carried on wheelsets 22 for rolling motion along railroad tracks. Side frames 26 may be metal castings, and may typically be steel castings. Each side frame 26 has a generally rectangular side frame window 28 that accommodates one of the ends 30 of the truck bolster 24. The upper boundary of window 28 is defined by the side frame arch, or compression member identified as top chord member 32, and the bottom of window 28 is defined by a tension member or bottom flange identified as bottom chord 34. The fore and aft vertical sides of window 28 are defined by a pair of first and second side frame columns 36. At each of the swept-up ends of side frame 26 there are side frame pedestal fittings, or pedestal seats 38. Bearings and bearing adapters mounted on the ends of the axle of wheelset 22 are installed in the various pedestal seats 38. Truck bolster 24 has a center plate bowl 40 in which, in operation, the mating center plate of a railroad freight car seats. Truck bolster 24 has side bearings 42 that meet with the underside of the main bolster of the freight car. Truck 20 has brake beams 44 mounted to either face of bolster 24. To accommodate the brake cylinders and their brake rods, truck bolster 24 has brake rod opening 46, 48.

Brake rod apertures or openings 46, 48 are the end openings of brake rod passageways 68 that pass fully through truck bolster 24. Those passageways are at all locations at least as large as brake rod opening envelope 50. That is, there is a brake rod opening envelope 50 that accommodates brake equipment used on freight car trucks that is available from commercial suppliers and that complies with the relevant AAR brake standards. Brake rod openings 46 and 48, and brake rod passageways 68 more generally, can be the same size as, or larger than, brake rod opening envelope 50, but whether larger or not, they conform to brake rod opening envelope 50. That is to say, brake rod passageways 68 are formed through the various webs of bolster 24, such as may be discussed herein, so as not to intrude into or otherwise obstruct brake rod envelope 50.

As noted above, bolster 24 may include brake rod openings 46 and 48. Openings 46 and 48 may be of non-standard size and shape. That is to say, the Association of American Railroads (AAR) standard S-392 provides standard dimensioning for brake rod apertures to accommodate a standard brake rod layout, and to accommodate a WABCOPAC™ or NYCOPAC™ brake arrangement. Standard S-392 is incorporated herein by reference. In general, the apertures provided for WABCOPAC™ or NYCOPAC™ brake arrangements have corner radii that are indicated as having a maximum radius of 2 inches. Standard brake rod openings are indicated as having corner radii of 2 inches. WABCOPAC™ brake rod openings are shown as having an area of the order of somewhat less than about 25 sq. in., maximum, and standard brake rod openings are shown as having an area of somewhat less than about 34 sq. in. For example, one "conventional brake rod opening" identified in AAR standard S-392 shows a WABCOPAC™ brake rod opening that is generally rectangular, having a width of about 3⅛", a height of about 8⅝" and rounded corners having a radius that is, at most, 2". By contrast, openings 46 and 48 may be rather larger. The brake rod openings in the various embodiments described herein may tend to employ radii of curvature in one, another, or all corners that are larger than 2". Brake rod opening envelope 50 may be understood to include the union set of the standard brake rod profile, and the WABCOPAC™ and NYCOPAC™ profiles. For example, openings 46 and 48 may tend to be more rounded than the standard and WABCOPAC™ or NYCOPAC™ brake rod apertures identified in AAR standard S-392. For example, brake rod openings 46 and 48 are larger than brake rod openings 346 and 348 discussed below. In the embodiments shown, brake rod openings 346, 348 of the liners are each about 10½" high, and 7" wide, with a corner radius of about 3½" and an area of about 63.9 $in^2$.

The profile of the aperture, i.e., of brake rod opening 46, (or, indeed, of internal web openings 162, 164 respectively, as discussed below) may have an overall height $h_{46}$, and an overall width $w_{46}$. Height $h_{46}$ may exceed ⅗ of the depth of bolster 24 measured over the top and bottom portions or top and bottom flanges 82 and 84 (but excluding the height of the center plate bowl rim). In one embodiment, height $h_{46}$ may be in excess of ⅔ of this height. Expressed differently, $h_{46}$ may be greater than 10 inches, and may, in one embodiment, be about 10½ inches. Width $w_{46}$ may be of a magnitude greater than ⅖ of the magnitude of the overall height over the top and bottom flanges 82 and 84, and, in one embodiment, may be about half that height. In one embodiment $w_{46}$ may be in excess of 6½ inches. In another embodiment $w_{46}$ may be in excess of 7 inches. The aspect ratio of brake rod opening 46 may be such that the ratio of width $w_{46}$ to height $h_{46}$ is in the range of about 3:5 to about 4:5. The profile of the periphery of brake rod opening 46 or 48 may have a perimeter arc length, P, and an enclosed area $A_{46}$. A characteristic dimension $D_h$, may be defined as $D_h=4A_{46}/P$. In one embodiment, $D_h$ may be greater than 6½ inches, in another embodiment it may be greater than 7 inches, and in another embodiment may be greater than 8 inches. In one embodiment $D_h$ may be about 9 inches. An equivalent circular diameter may be defined as $D_c$=square root of $[4A_{46}/\pi]$. A measure of roundness of an aperture can be defined by the ratio of $D_h$ to $D_c$. For a circular opening, this ratio of $D_h/D_c$ is 100%. In one example, brake rod opening 46 may have a ratio of $D_h/D_c$ that is greater than 95%. A further measure of comparative roundness may be obtained by defining a characteristic diameter $D_p=(P/\pi)$ where it is approximately 3.14159. In some embodiments, the ratio of $D_h/D_p$ may be greater than 90%. In absolute terms, $A_{46}$ in some embodiments may be greater than 45 sq. in. Alternatively, by comparison to the corresponding conventional brake rod opening defined in AAR S-392, $A_{46}$, may be half again as large, or more, than the corresponding WABCOPAC™ opening on one hand, or the corresponding conventional brake rod opening on the other, defined in S-392.

While bolster 24 may be used in trucks of various sizes and capacities, it may be that it may be employed in a truck of an AAR rated capacity of at least 70 Tons. Alternatively, it may be employed in trucks of at least 100 Tons rating. In the further alternative, it may be used in trucks having an AAR rating of either 110 Tons or 125 Tons. Expressed somewhat differently, bolster 24 may be rated to carry a central vertical load of at least 115,000 lbs. In another embodiment, bolster 24 may be rated to carry a vertical load of at least 130,000 lbs. In still another embodiment, bolster 24 may be rated to carry a load of at least 145,000 lbs.

In operation, bolster 24 can pivot about the vertical or z-axis relative to the railroad car, or car unit, body, generally, while vertical load of the railroad car is carried into the bolster through the center plate bowl 40 and the side bearings 42. Bolster 24 can move up and down in the side frame windows 28 on the main spring groups 52 in response to vertical perturbations. The vertical motion may tend to carry along left-hand and right-hand (or outboard and inboard) groups of friction dampers 54, 56 seated in the damper pockets or bolster pockets 58, 60 of bolster 24, causing friction dampers 54, 56 to ride against the respective wear surfaces or wear plates of side frame columns 36, thereby to damp out the motion. Friction dampers 54, 56 (and corresponding damper pockets 58, 60) may be arranged in first and second damper groups, mounted respectively at the first and second ends of bolster 24. In the embodiment shown in FIG. 1*a*, each damper group may include four dampers. Each of those dampers may be sprung independently of any other, and the set or group of dampers or damper wedges may be arranged in a four cornered arrangement, namely with two dampers facing each sideframe column, one member of each pair being outboard of the other. Bolster 24 may be displaced laterally relative to side frames 26 in response to lateral perturbations, subject to the range of travel permitted by the inboard and outboard bolster gibs 62, 64. The spring groups 52 and the sideways swinging, or rocking motion of the side frames may tend resiliently to resist this lateral motion and may tend to restore bolster 24 to an equilibrium position square to (i.e., perpendicular to) the sideframes after deflection to an out-of-square condition, with the amplitude of the lateral rocking or swinging motion decreasing as the dampers work against the side frame column wear plates. When side-to-side leaning or rocking of the car body occurs, loads may be carried into the truck bolster at the side bearings 42 mounted to the upper surface of the top flange of bolster 24 from the engaging side bearing surfaces of the main body bolster of the car body.

Bolster 24 is typically, if not universally, a steel casting. Bolster 24 is a beam of hollow section that has, predominantly, a central point load applied at center plate bowl 40 (with some additional loads applied at side bearings 42 under some loading conditions) that is opposed by reactions at ends 30. Bolster 24 may be thought of as having three regions: (1) a central region 70 that is the deepest portion of bolster 24, and that lies generally underneath center plate bowl 40; (2) relatively shallow end portions or end regions 72, 74 that locate in the sideframe windows 28 and seat on main spring groups 52; and (3) intermediate or transition regions, or arms 76, 78, that extends between the first and second regions. The intermediate, or transition, portions taper in depth from the deep central portion 70 to the shallow end portions 77, 79. Truck bolster 24 has a tension member 34. Tension member 34 has a central section 71 and adjacent sloped sections 77, 79 to either side lengthwise thereof. The bottom chord, or tension member 34 can also be referred to as, or may include, the bottom flange 84 of bolster 24.

Bolster 24 may have a plane of symmetry that runs lengthwise (i.e., along axis 25) and vertically. Aside from such features as brake fittings, bolster 24 may also have a mid-span transverse vertical plane of symmetry that is perpendicular to long axis 25. The mid-span centerline lies in this vertical plane to which lengthwise axis 25 is normal. Bolster 24 may include an upper flange or top flange or upper portion, 82, a lower or bottom flange or a lower portion 84, a first side wall or side wall portion 86 and a second side wall or side wall portion 88. These portions may be joined in a generally hollow box-like configuration, when viewed in section, to form a beam in which upper portion 82 may tend to function as a first flange, or upper flange or top flange; lower portion 84 may tend to function as a second flange or lower flange or bottom flange; and first and second side wall portions 86 and 88 may tend to be, or may tend to function as, shear transfer members, or shear transfer webs, linking the upper and lower flanges or portions 82 and 84. First and second side wall portions 86 and 88 may also be referred to as the outside or external webs of bolster 24, providing a shear connection between the upper and lower flanges of bolster 24 defined by upper and lower portions or flanges 82 and 84 respectively. That is to say, portions 82, 84, 86, and 88 co-operate to define a beam having webs and flanges. The beam may have a hollow, or largely hollow, interior, indicated generally as 80, which may include one or more cavities or sub-cavities formed between the various webs and flanges. This beam may tend to have a greater through thickness depth between the upper and lower flanges in its mid-span region 70 than at its shallower end regions 72, 74. These portions may be integrally formed portions of a single monolithic casting, 90, which may be fabricated of a material such as a steel, that steel being of such steel alloy as may be appropriate for use in rail road freight car truck bolsters.

Upper portion 82 may include, or may be, a wall member identified as an upper flange. At the mid span location, the upper flange may have an upstanding generally circular lip or rim 92, having a diameter $\Phi_{92}$, that defines the outer peripheral wall of center plate bowl 40, such as may accommodate a mating center plate of a railroad car body. The circular base wall 94 of center plate bowl 40 is bounded by rim 92. Base wall 94 is a portion of upper portion or flange 82. At the center of center plate bowl 40, there may be a concentrically located accommodation 96 for a center plate pin. Base wall 94, rim 92, and center plate bowl 40 more generally, have a greater diameter than, and are therefore wider than, the general width of upper portion 82 generally. Consequently the upper margins of side walls portions 86 and 88 deviate locally laterally outwardly to merge on smooth curvatures therewith.

At some distance radially away from accommodation 96, longitudinally or lengthwise outboard beyond the rim 92 of bowl 40, there may be a side bearing mount, or side bearing mounting interface, or seat, 98, which usually has the form of a rectangular machined surface of a size corresponding to a side bearing base, with two holes to accommodate side bearing attachment fasteners. Seat 98 may be a raised portion of upper portion or upper flange 82. That is, it may stand proud of the surrounding region, and, where bolster 24 is a casting, after casting, seat 98 may be milled to give a machined flat. In one embodiment, the side bearing seat may be a generally rectangular flat patch, centered roughly 25 inches outboard of the mid span truck centerline. Upper flange 82 may have a downwardly sloped transition lying outboard of seat 98, and a more distant lower distal region such as may pass through the sideframe window.

Lower flange or lower portion 84 may include, or may be, a lower flange member, and may be taken as including, or as being the same as, tension member 34. That is, in operation, most often the upper flange may tend to be a compression member, and the lower flange may tend to be a tension member. Central section 71 of tension member 34 has a through-thickness that is greater than the respective through thicknesses of sloped sections 77, 79. Brake rod openings 46, 48 have respective peripheries having rounded lowermost portions; and central section 70 of said tension member 34 may be of a thickness that, apart from any upstanding ribs or webs, it has an upper surface that is shy of the lowermost portions of those peripheries of openings 46, 48. That is, the upper surface may be located below the level of the openings by some distance. That distance may be roughly an inch in some embodiments. The through thickness of lower flange member may tend to be greatest in mid-span of central portion 71, and may be tapered in a general reduction in thickness in inclined regions 77, 79, to a once again thicker portion in distal regions 104. The underside of distal region 104 may include fittings in the nature of spring coil end retainers 106 defining the upper spring seat for receiving the upper ends of the spring coils of a main spring group 52, and for receiving the upper ends of the friction dampers.

Each of first and second side wall portions 86, 88 may include a deep central region 110, which may extend between, and form a shear web connection between, (a) the mid span region of upper flange 82 under center plate bowl 40 and (b) mid-span portion 100 of lower flange member 84. Side wall portions 86, 88 may further include a transition or intermediate portion 108, and an end portion 128. Transition portion 108 may narrow in depth (i.e., become more shallow vertically) from the inboard portion to the outboard portion, and may form the shear web connection between the upper and lower flanges in the transition of inclined region 102.

Continuing with externally visible features such as seen in FIGS. 3*a*-3*d*, side wall portions 86, 88 may include inboard bolster gibs 62 and outboard bolster gibs 64. Either or both of those gibs may be tapered as described in U.S. Pat. No. 7,631,603 issued Dec. 15, 2009. Each end of bolster 24 may further include inboard and outboard bolster pockets, or damper pockets, 58, 60 noted above. Inboard bolster pocket 58 may have a substantially planar inclined face 112 that may be inclined with respect to the vertical by a primary angle $\alpha$. Inclined face 112 may also include a lateral bias, represented by secondary angle $\beta$. The apparent lateral rake angle, $\theta$, of the bolster pocket due to secondary angle $\beta$ may be seen in the side-facing view of FIG. 3*c*, but a true view of secondary angle β may be seen by sighting along the inclined plane of angle α. Inboard bolster pocket 58 may include an inboard lateral wall 114 to which the long axis of bolster 24 is normal (i.e., perpendicular). Inboard lateral wall 114 co-operates with the sloped wall defined by inclined face 112 to form a two-sided notch, or acute angle with a face width corresponding to the width of a damper wedge, with tolerance, such that a damper wedge installed in bolster pocket 58 may tend to be constrained, or urged, to work along inclined face 112 and along the walled guideway or trackway defined by inboard lateral wall 114, with a tendency to bear against inboard lateral wall 114 by virtue of the secondary rake angle, β. Inboard pocket 58 also has an outboard side wall or face 116 that forms a slightly obtuse angle with inclined face 112 when seen in true view sighting along the line of intersection or the two surfaces. Similarly, outboard bolster pocket 60 may include an inclined face 118 that may be inclined at primary angle α and secondary angle β, but of opposite hand, and an outboard wall 120, which may be spaced in mirror arrangement to inboard lateral wall 114 and inclined face 112. Outboard bolster pocket 60 may also have an inboard wall or face 122 corresponding to wall 116. Bolster 24 may include a spring land 124 between walls 116 and 122. An end spring of the middle row of coil spring of spring group 52 may bear against the underside of land 124. Land 124 may be part of the upper spring seat. In contrast to conventional bolster pockets that may have three walls (namely a sloped face bracketed between a pair spaced apart parallel side walls), in some embodiments the bolster pocket or pockets, may have only two walls namely, the sloped face and one side face. For example, bolster pocket 58 may have only face inclined 112 and inboard lateral wall 114. In this embodiment the sloped or inclined face 112 may merge on a radiused edge into the vertical web defined by side wall portion 86 (or 88, as may be) rather than into another bolster pocket side face. This may tend to reduce the sharpness or suddenness of the transition in width of, for example, the bottom flange in the transition region from the arm region to the end region of the bolster. Looking at the end of the bolster from below, the flat central portion of the bottom flange is approximately the same width as the broader portion of the bottom flange at the inboard commencement of inclined face 112, and then necks down to a narrower portion. When viewed from below, the end portion of the bottom flange may have a cruciform shape in which the cross arm is defined by the lands under the middle spring seats, and the stem is tapered to be broad at the distal ends, and narrow at the waist. It may be that only the inboard stem of this cruciate form is tapered. In this embodiment, the bias of angle β may tend to urge the inboard and outboard dampers laterally toward each other.

Rounding out the other externally visible features of bolster 24, there are brake fulcrum mounting interface fittings, 66 that are generally flat machined surfaces at which the brake fittings are mounted to the side face webs of bolster 24; and side bearing mounting interfaces 98 which are typically generally rectangular machined surfaces with bore fastening hardware. There may also be openings or slots 65 formed along the centerline in the top flange, and openings 75 formed along the centerline in the bottom flange, such that a vertical slot is formed through the transition portion, or arm, of the bolster. The slots have an aspect ratio of length to width of about of 3:1.

Bolster 24 has internal features, as seen in FIGS. 3*a*-3*d*. Bolster 24 has a pair of first and second internal predominantly upstanding webs of predominantly upright, or internal vertical webs 130 and 132 that run in the longitudinal direction, generally parallel to the external webs of side wall portions 86 and 88. Bolster 24 may also have first and second upper transverse ribs, or transverse reinforcements, 134, 136 located underneath center plate bowl 40, running cross-wise to the length of bolster 24 more generally. Side wall portions 86, 88, internal vertical webs 130, 132, and transverse reinforcements 134, 136 provide cross-wise reinforcement or support of center plate 40. Further, there may be first and second lower transverse ribs, or lower transverse reinforcements 138, 140 located on lower portion or lower flange 84, and extending or running cross-wise to the length of bolster 24 more generally.

Discussion now turns to the external webs and the internal webs. In respect of the external webs, in the central region of side wall portions 86 and 88, there are brake rod openings, or apertures, 46, 48. Opening 46 in side wall portion 86 may be aligned with opening 48 in side wall portion 88, and with corresponding first and second, or left hand and right hand, brake rod openings 162, 164 in such internal vertical webs 130, 132 as may be, thereby co-operating to define a fore-and-aft extending brake rod passageways 68 through bolster 24. That is, the various openings are lined-up such that brake rod passageway 68 threads the needle relative to the aligned openings, clear of the defined brake rod clearance envelope 50. The profiles of these openings 46, 48 may be formed with large corner radii, and may tend to provide a larger passage for brake equipment, and, to the extent that less material may be used, may provide a measure of lightening. In the particular embodiment, openings 46 and 48 include a proximal side portion, or margin, 142, closest to the transverse centerline, that margin ascending on a longitudinally outboard taper such that the mid web portion has the shape of an upwardly widening tree trunk. Openings 46 and 48 each also include a bottom portion or margin 144 running generally outboard, being offset inward from, and conforming to, the outwardly and upwardly curving shape of lower portion or flange 84. There is a third, lengthwise outboard, distal, ascending, slanted or hypotenuse margin 146, and a fourth uppermost portion or margin 148 extending between portions or margins 142 and 146. The transitions, or corners, between each of these margin portions are generously radiused. Uppermost portion or margin 148 may form a substantially continuous radius between margins 142 and 146. The bottom outboard corner of the opening may form a relatively acute angle between portions 142 and 144, and may extend well outward of the profile of brake rod opening clearance envelope 50. The upper portion, upper radiused corners, inboard margin, and lower inboard corner may all lie on, or follow, the profile of clearance envelope 50. As seen in FIG. 2*d*, the entire periphery of openings 46 and 48 is thickened to form a peripheral rib or flange all around opening 46 (and 48) and extending inwardly of side wall portions 86, 88 more generally.

Further outboard there is an access opening 150. It is generally rectangular and is located outboard of, and lower than, the brake fulcrum mounting interface 66. As seen in FIG. 2*d*, the entire periphery of opening 150 is thickened to form a peripheral rib or flange all around extending inwardly of side wall portions 86, 88 more generally. The portion of the side web that lies between brake rod opening 46 (or 48, as may be) and access opening 150 may be identified as a strut 149 which extends diagonally from the merger of the center plate bowl into the top flange 82 to the corner or bend at which the central portion 71 of the bottom flange 84 bends and transitions into the inclined portion 77 (or 79) of the bottom flange 84 running along the tapering arm portions of the bolster.

Figure 2A:
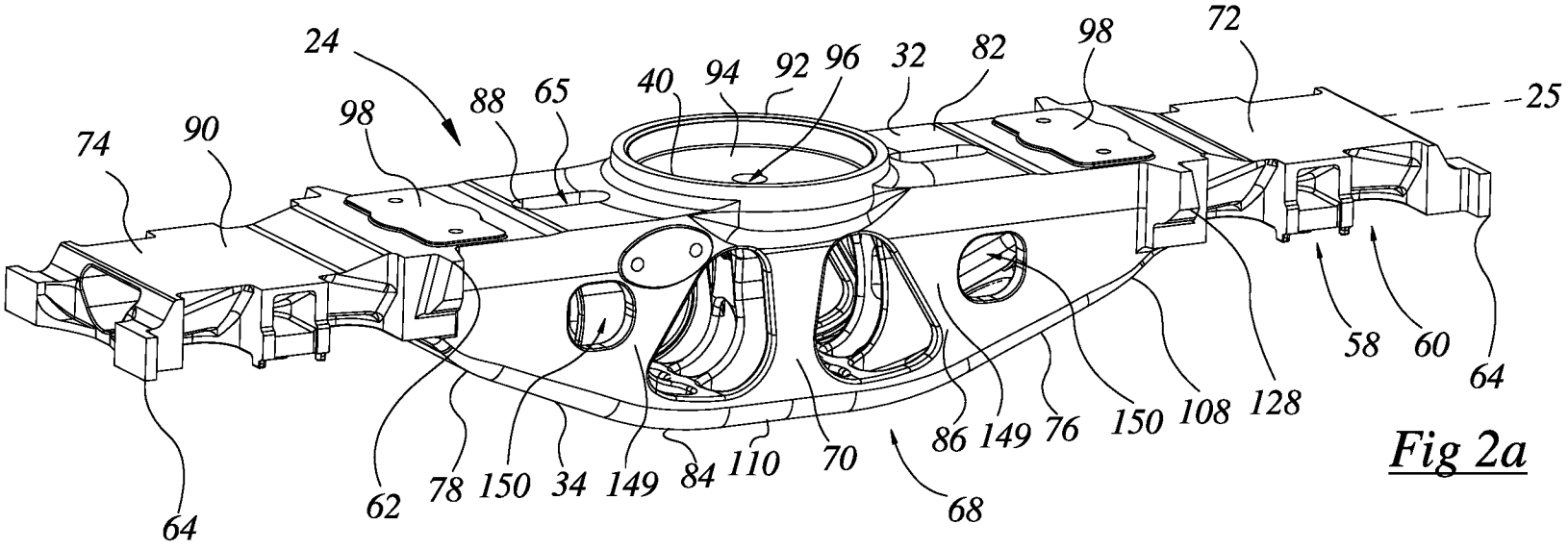
FIG. 2*a* is an isometric view of a truck bolster for the railroad car truck of FIG. 1*a;*
Figure 2B:
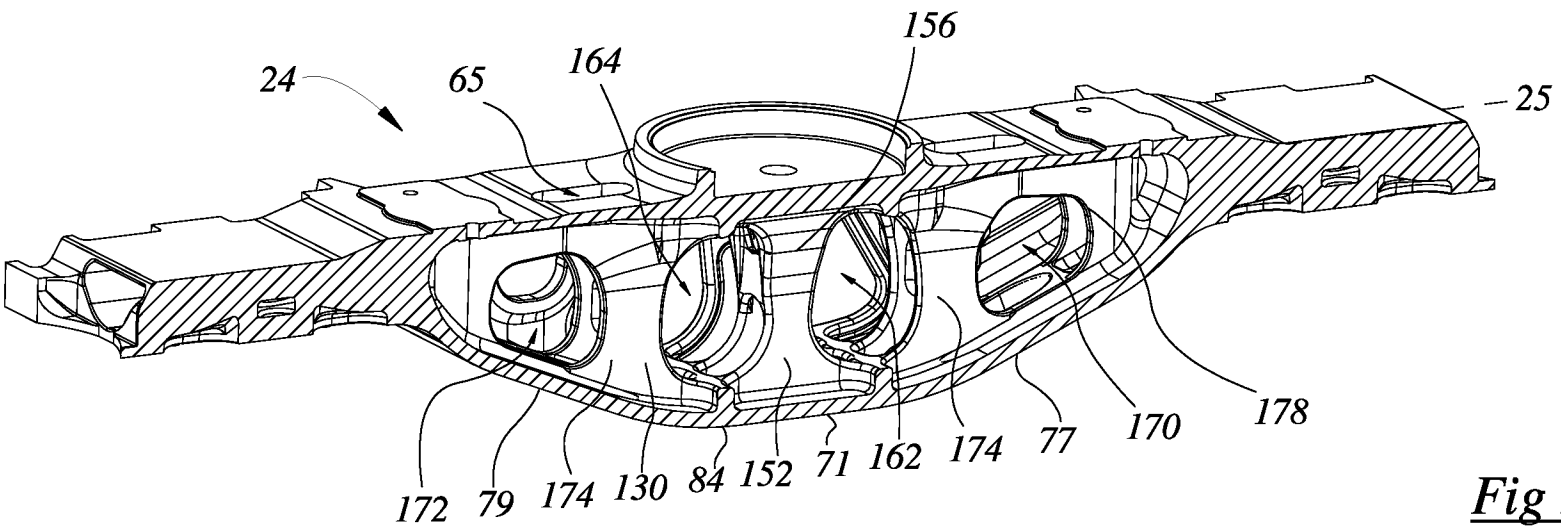
FIG. 2*b* is an isometric section of the truck bolster of FIG. 2*a* taken inward of the foreground outside bolster web looking toward a near-side internal bolster web.
Figure 2C:
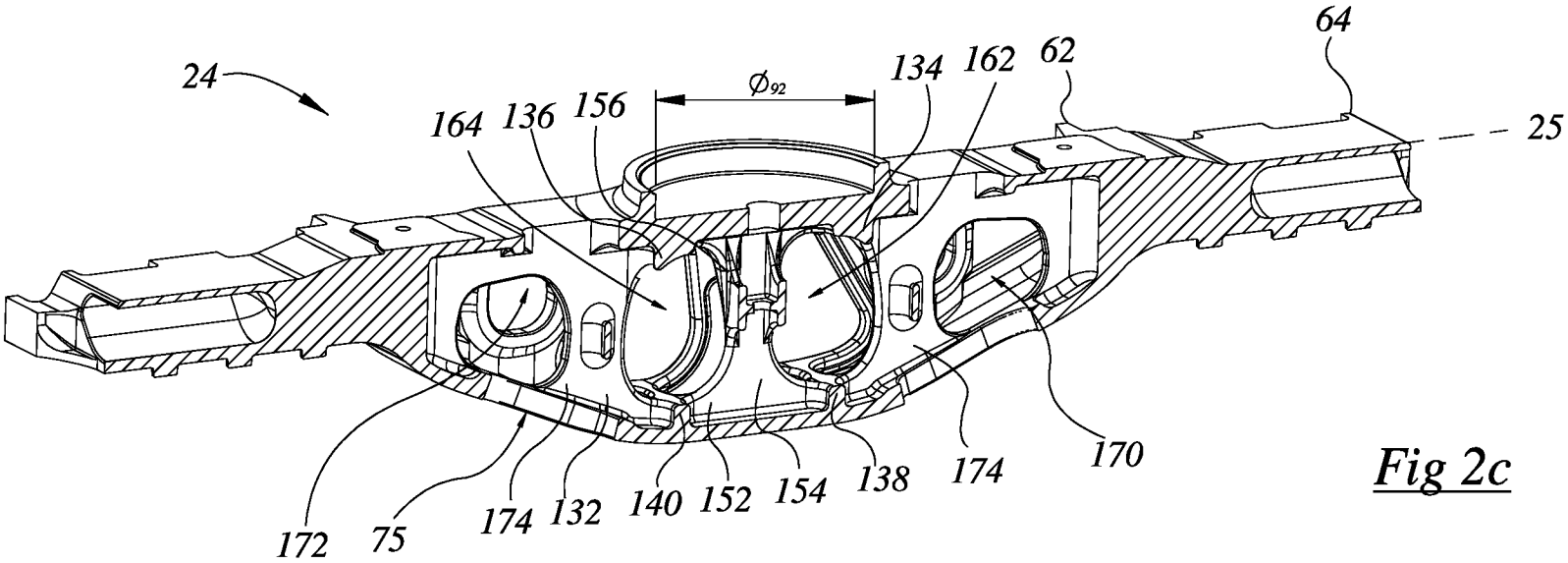
FIG. 2*c* is an isometric sectional view on a vertical plane of the railroad car truck bolster of FIG. 2*a* taken along the longitudinal centerline thereof.
Figure 2D:
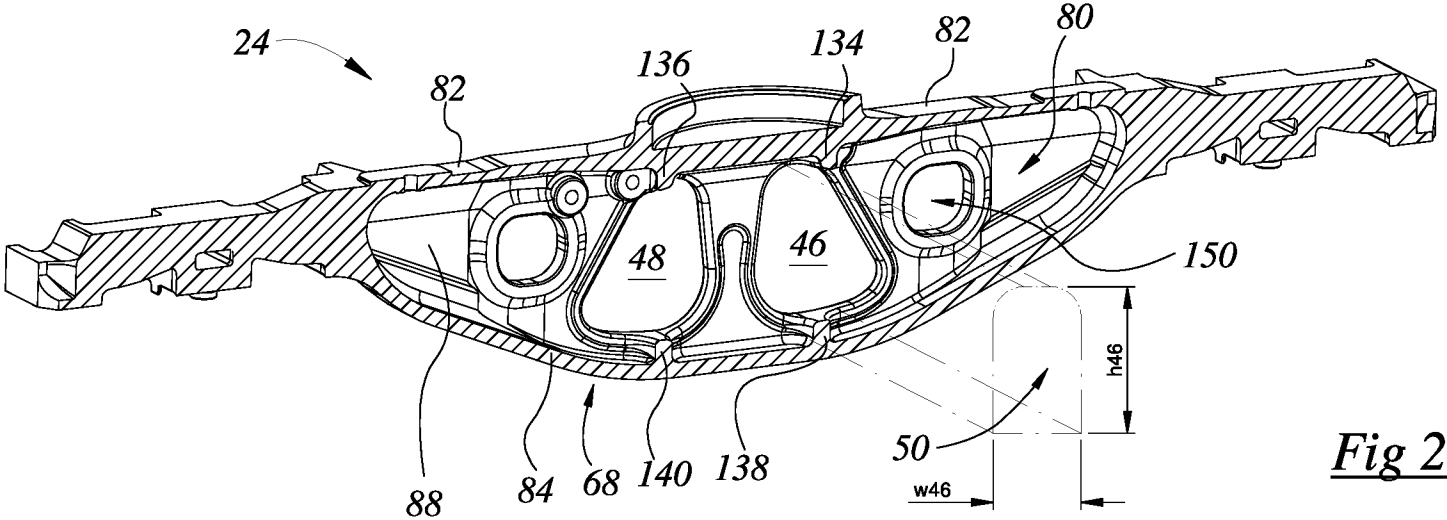
FIG. 2*d* is an isometric section of the bolster of FIG. 2*a*; on a vertical longitudinal plane outboard of the far internal web, looking toward the far external web thereof.
Figure 3A:
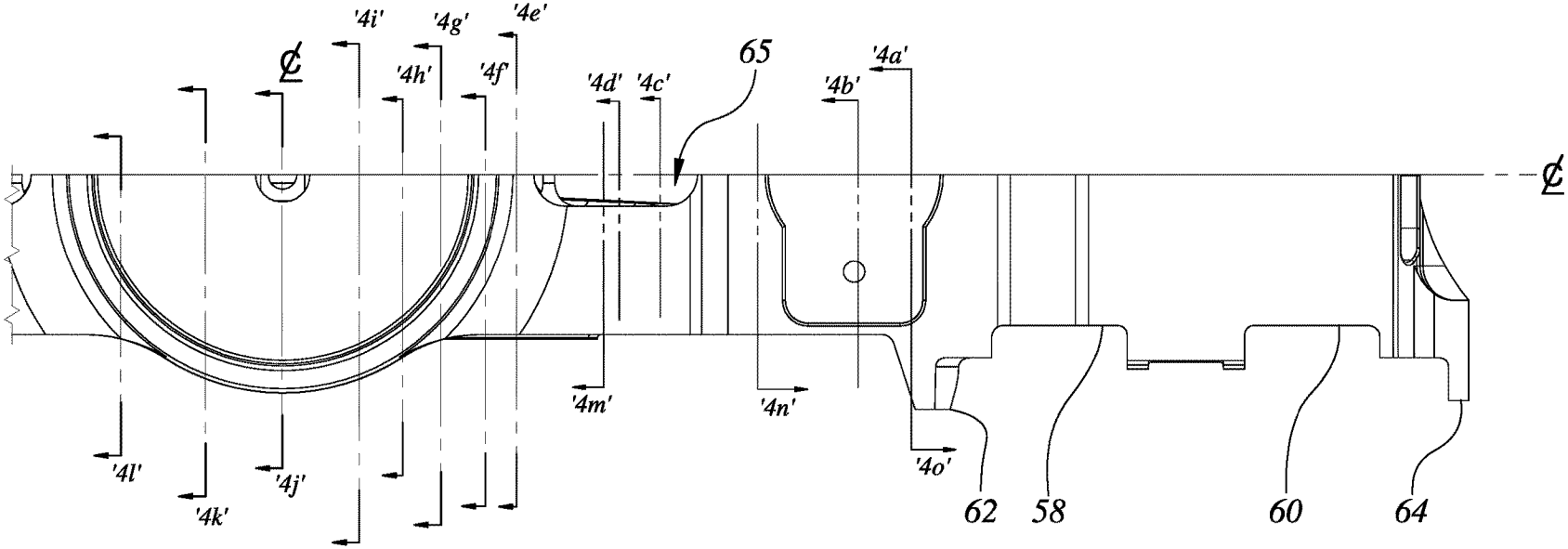
FIG. 3*a* is top view of approximately one quarter of the bolster of FIG. 2*a*, the bolster having longitudinal and transverse axes of symmetry.
Figure 3B:
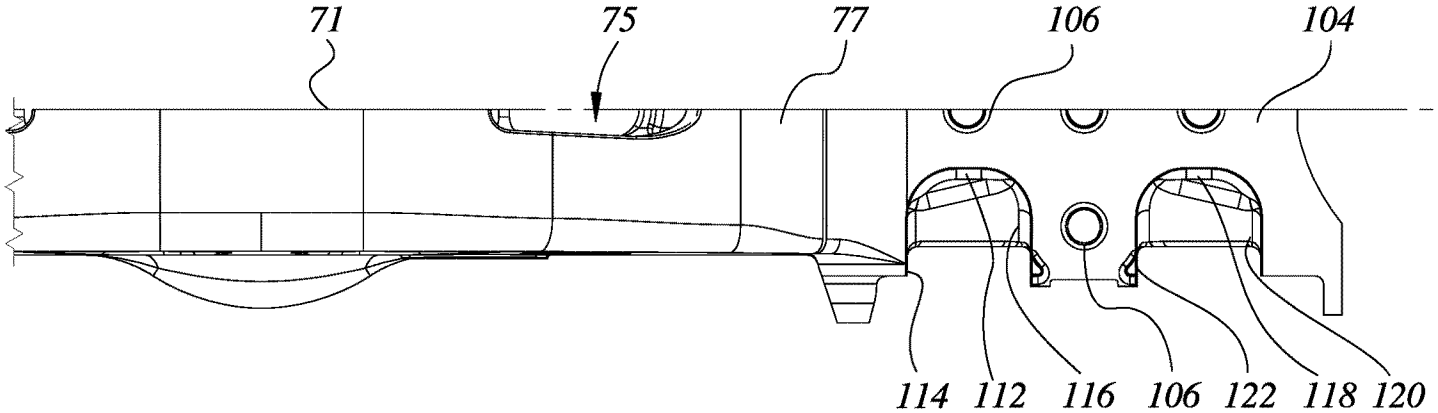
FIG. 3*b* is a bottom view of approximately one quarter of the bolster of FIG. 2*a;*
Figure 3C:
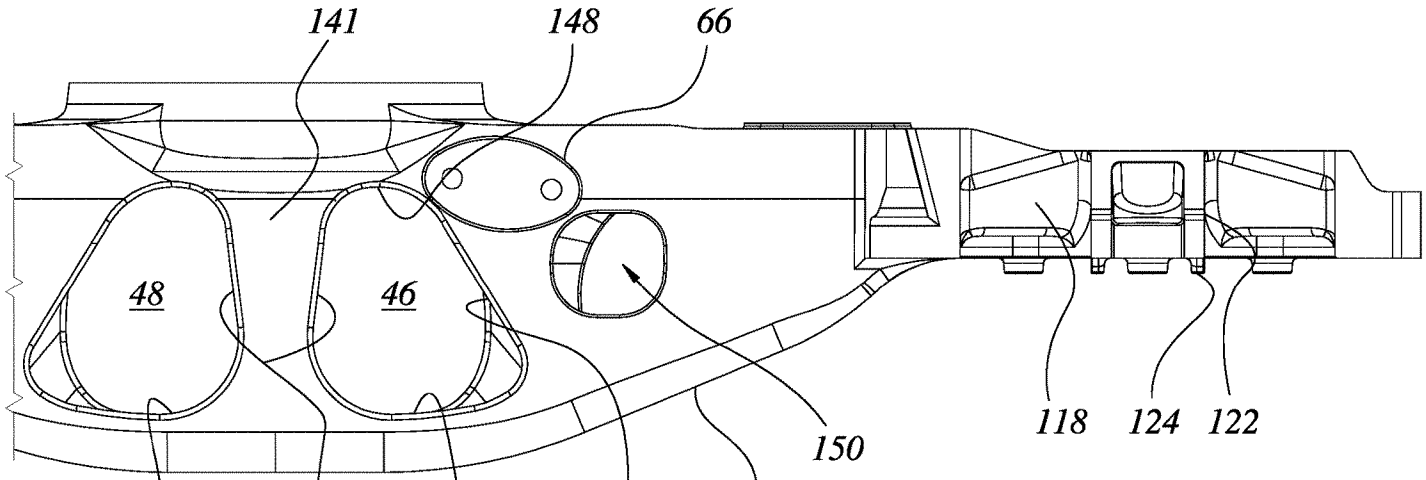
FIG. 3*c* is a side view of the approximately one quarter bolster of FIG. 3*a;*
Figure 3D:
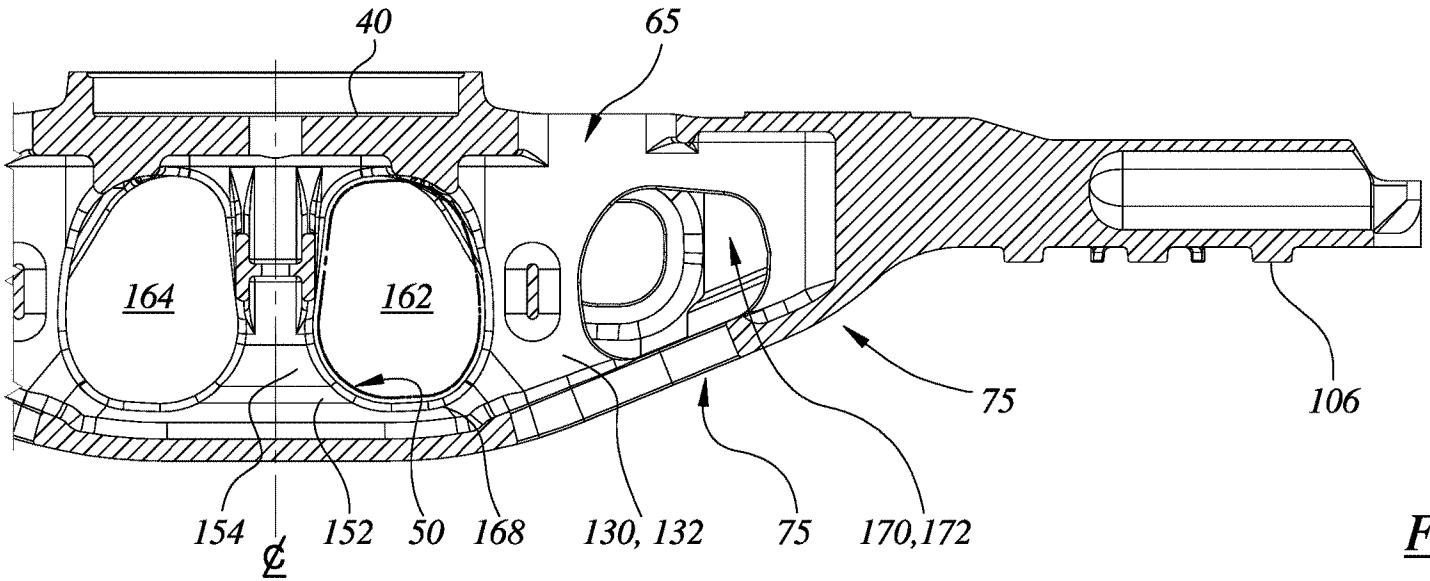
FIG. 3*d* is a cross-sectional side view of the approximately one quarter bolster of FIG. 3*a* on the vertical plane of symmetry of the longitudinal centerline.
Figure 4A:
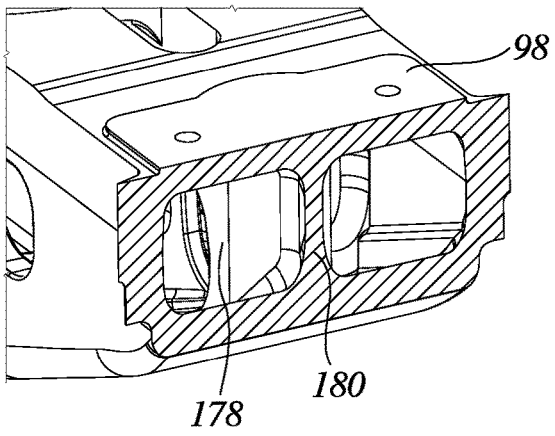
FIG. 4*a* is a vertical-transverse section of the bolster of FIG. 2*a* at the transition longitudinally inboard of the damper wedges and under the outside of the side bearing mounting interface, or footing.
Figure 4B:
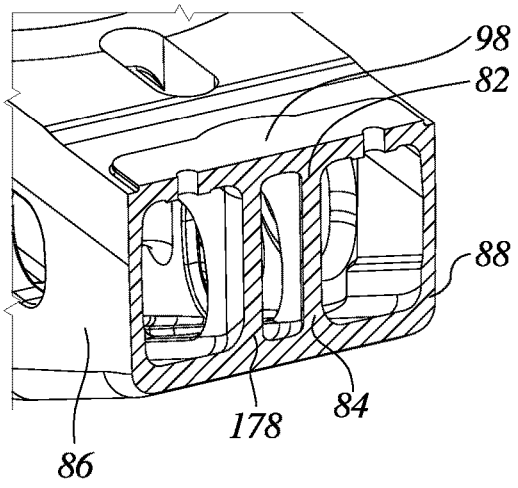
FIG. 4*b* is a vertical transverse cross-section of the bolster of FIG. 2*a* taken through the centerline of the side bearing mounting interface.
Figure 4C:
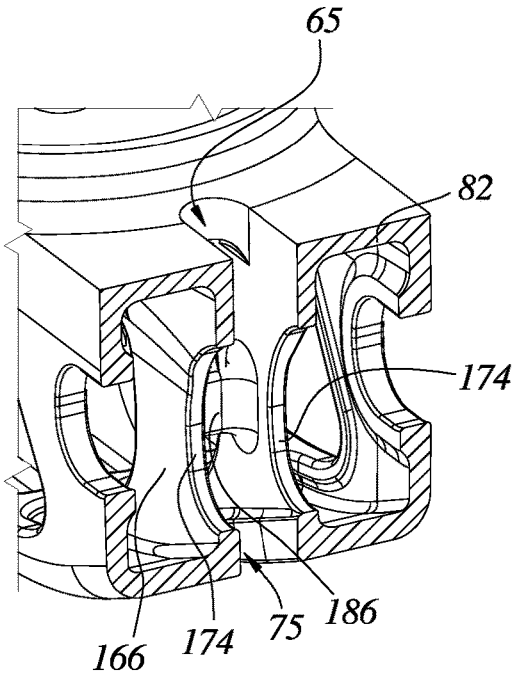
FIG. 4*c* is a vertical-transverse section of the bolster of FIG. 2*a* taken through the outboard lightening holes and showing the internal longitudinal slot and lateral web.

The outside face of the near inner web member, i.e., internal vertical web 130, is seen in FIG. 2*b* and the inside face of the other inner web member, i.e., internal vertical web 132, is seen in FIG. 2*c*. Starting at the transverse centerline, and working outboard, at the opposed internal, side-by-side spaced-apart center web members, internal vertical webs 130 and 132, each have a central web portion 152 having a narrow lower stem portion 154 and an upper broader trunk portion 156, having a tree shape. Web portion 152 defines a shear transfer arm or strut. Left hand and right hand openings 162, 164 are formed lengthwise to either side of central web portion 152, beneath center plate bowl 40. Each of those openings has a periphery that is clear of, or tangent to, brake rod clearance envelope 50. In each case, openings 162 and 164 have a generally oblong shape in which the opening is taller in the vertical direction than wide in the lengthwise direction of bolster 24. The shape of openings 162, 164 is shown in the enlarged detail of FIG. 5*c*. The inboard margin follows, and is defined by, the margin of the "tree" of central web portion 152. The top margin terminates proximate to center plate bowl 40, such that a margin of the web extends downwardly from center plate bowl 40 as a leg or stem, as at 166 (FIG. 4*e*). The top of openings 162, 164 is somewhat narrowed, or convergent. The vertical tangent of the outboard margin of openings 162, 164 is near, or coincident with, the outside diameter of the outside of rim 92 of center plate bowl 40. There is a vertical web or stem 168 extending upwardly from lower portion 84 to the margin of each of openings 162, 164. The profile of openings 162, 164 may be different from that of openings 46, 48.

Figure 4D:
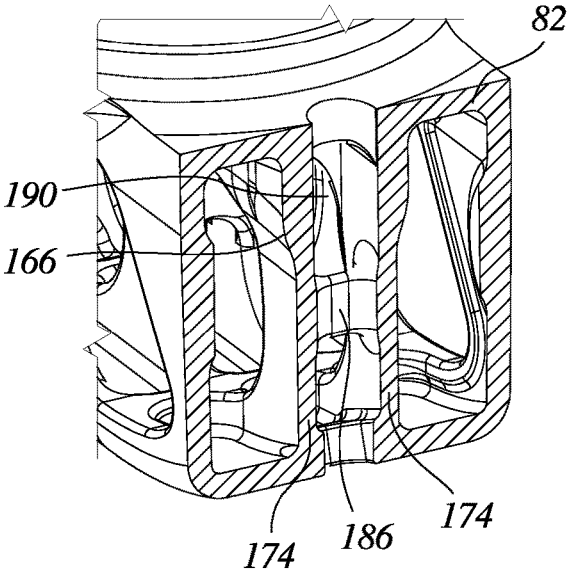
FIG. 4*d* is a vertical-transverse section of the bolster of FIG. 2*a* inboard of the lightening holes showing the transverse web and the narrowing vertical web profile.
Figure 4E:
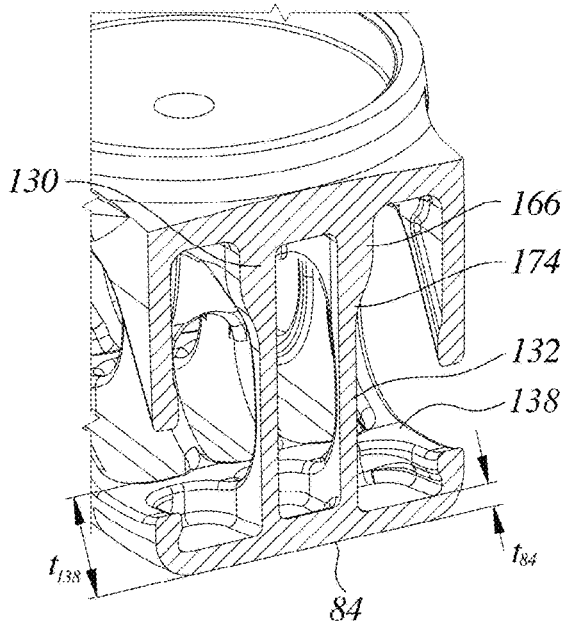
FIG. 4*e* is a vertical-transverse section of the bolster of FIG. 2*a* inboard of the lateral web showing a first transverse lower rib and radiused mergers with the internal and external webs thereof.
Figure 4F:
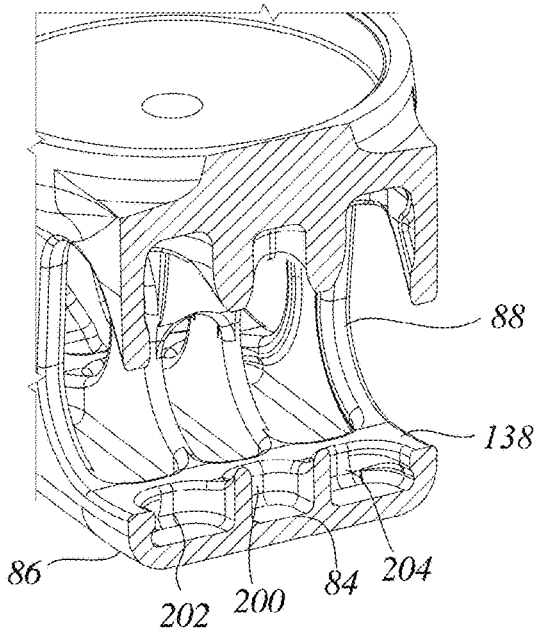
FIG. 4*f* is a vertical-transverse section showing the broadened, radiused arch transition of the internal webs into an upper rib of the bolster of FIG. 2*a;*
Figure 4G:
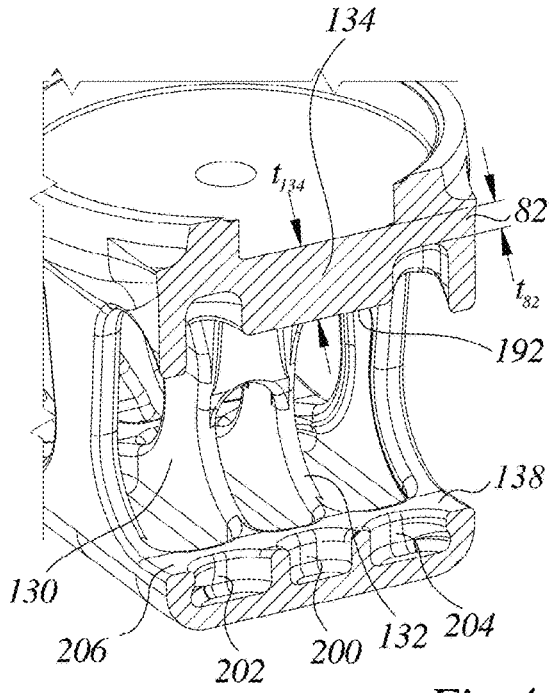
FIG. 4*g* is a vertical-transverse detail of the section depth of the upper rib transition.
Figure 4H:
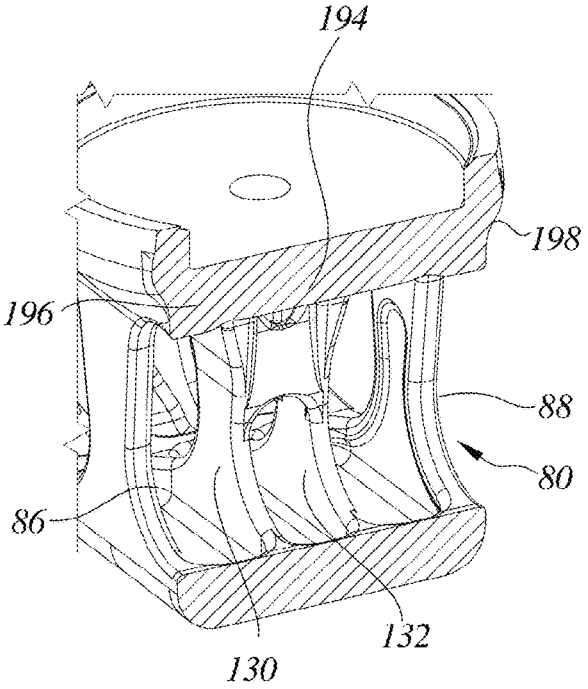
FIG. 4*h* is a vertical-transverse section of the center of the bottom and top ribs, showing them flush with the brake rod opening periphery at top and bottom.
Figure 4I:
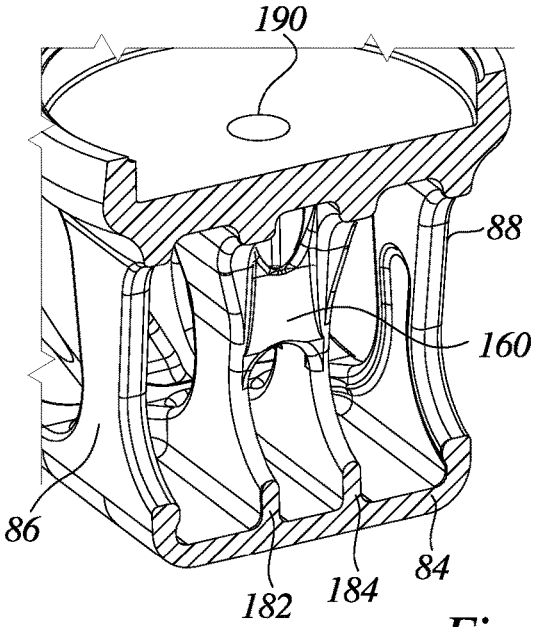
FIG. 4*i* is a vertical-transverse section inboard of the top and bottom ribs showing the center plate and tension member bottom flange thicknesses.

A further, opening 170 (or 172) is formed in internal vertical web 130, (or 132) in the outboard transition region of bolster 24 to leave a web or brace or strut 174 between opening 162 and 170 (or between 164 and 172, as may be). Strut 174 is smoothly and generously radiused into lower portion 84 at the bottom, and into a web stem portion 166 that extends downwardly from upper portion 82 above opening 170 (or 172). An end web portion 178 continues outboard toward bolster end 30. The end, or outboard extremity, of end web portion 178 curves underneath the side bearing mounting interface to merge with the corresponding opposite web portion 178 of web 132 (or, from the opposite perspective, web 130) to form a single web end 180 seen in FIGS. 4*a* and 4*o*. That is, bolster 24 is a railroad car truck bolster having a pair of external side walls and a pair of internal longitudinally extending webs. The internal webs have ends or end portions in which the pair of webs merge into a single web.

Figure 4J:
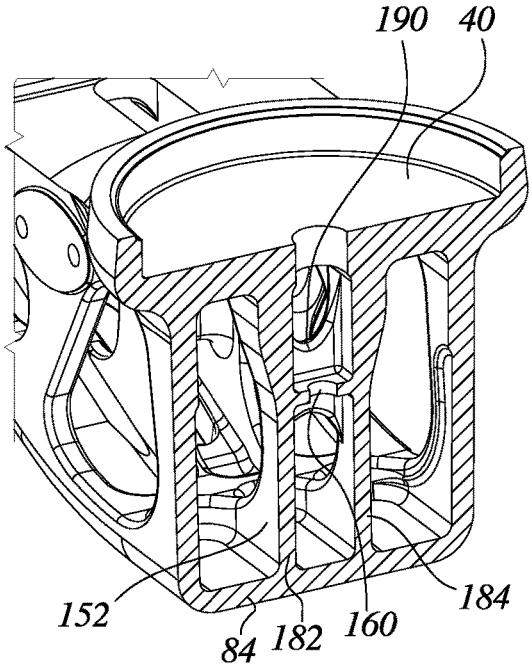
FIG. 4*j* is a vertical-transverse section at the bolster central plane of symmetry.
Figure 4K:
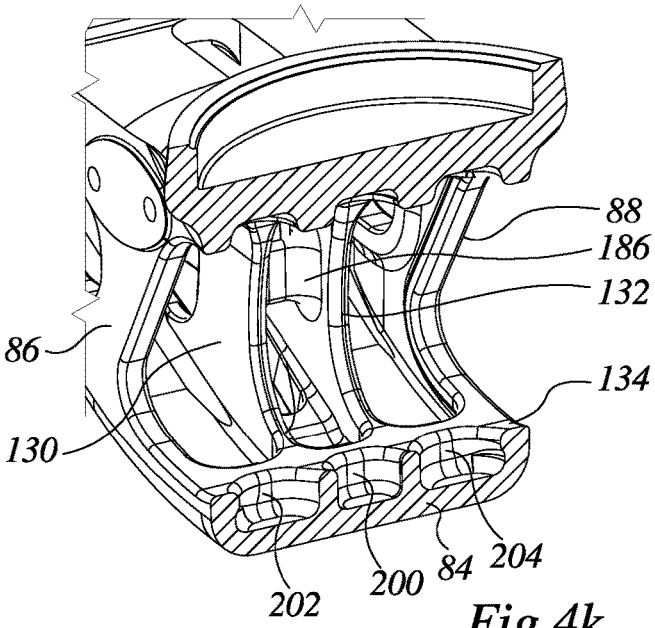
FIG. 4*k* corresponds to FIG. 4*i*, but looking outboard rather than inboard.
Figure 4L:
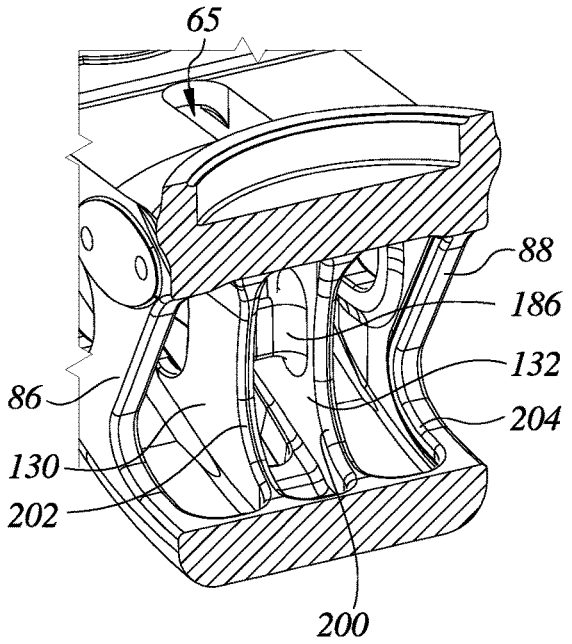
FIG. 4*l* corresponds to FIG. 4*h*, looking outboard rather than inboard.

As seen in FIG. 4*j*, the center pin seat 190 is mounted in a socket 160 formed between two transverse webs or ties 182, 184 that join central web portions 152 together at roughly mid height between lower portion 84 and center plate bowl 40. Socket 160 may have the form of a rectangular blank or flat bar or block having a central hole in which to admit the end of the pin. Ties 182, 184 and central web portions 152 of internal vertical webs 130 and 132 form a square or rectangular box about the blank or bar, or block of socket 160. In the embodiment shown, lower stem portions 154 are of substantially constant through thickness in the transverse direction. Upper stem or trunk portions 156 broaden in thickness from top to bottom such that their upper portion near center plate bowl 40 is substantially thicker than lower stem portion 154

Figure 4M:
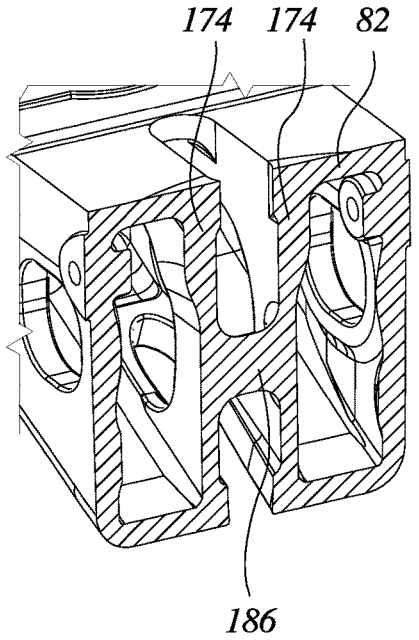
FIG. 4*m* is a vertical-transverse section through the lateral web, looking outboard.
Figure 4N:
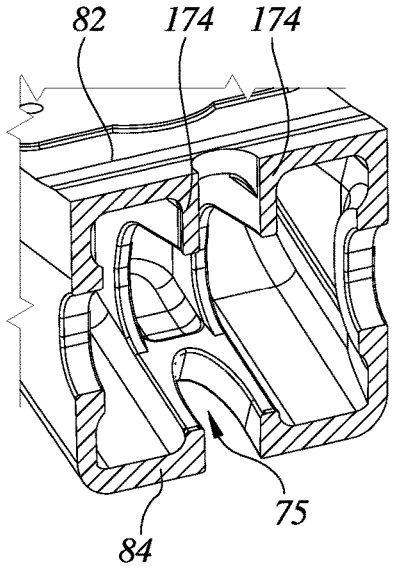
FIG. 4*n* is a vertical-transverse section at the lightening holes showing the ends of the slots in the compression and tension members of the bolster of FIG. 2*a;*
Figure 4O:
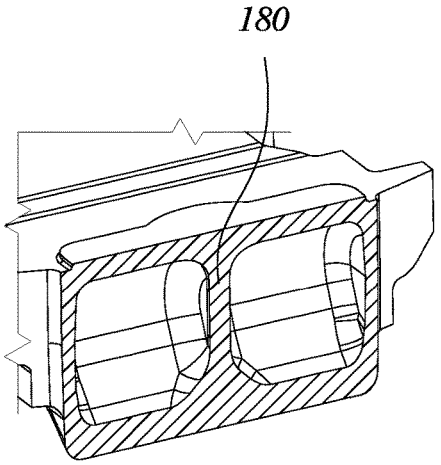
FIG. 4*o* corresponds to FIG. 4*a*, but looking outboard rather than inboard, showing the transition into the bolster pockets.

Similarly, as seen in FIGS. 4*d* and 4*m*, there is a transverse web or tie 186 that extends across, and links, the mid-height portions of webs or struts 174. The lower portion of strut 174 below tie 186 is of constant thickness, and is narrow relative to upper portion that broadens out, and merges into upper flange or upper portion 82.

It can be seen that bolster 24 is a railroad freight car truck bolster having reinforcement extending transversely underneath the bottom of the center plate bowl 40. In one embodiment, that reinforcement has the form of transversely extending ribs 134, 136. In one embodiment, ribs 134, 136 extend transversely between internal vertical webs 130, 132, and have ends that intersect, and merge with, those internal webs. FIG. 4*g* is taken on a section through rib 134 showing that it has a depth of section $t_{134}$ that is deeper than, or additional to, the through thickness depth of section of the upper plate or flange or portion 82 more generally, shown as $t_{82}$. Ribs 134, 136 are located over the respective brake rod openings 46, 48, and extend downwardly toward them. The vertical centerline of rib 134 at any transverse station may not necessarily intersect perpendicularly with either the periphery of the respective brake rod opening 46, 48 (or to any extent that the profiles of brake rod openings 46, 48 are different, of brake rod envelope 50). That is, the vertical centerline of rib 134 (or 136 as may be) may intersect the periphery of brake rod opening 46, or web opening 162 (or brake rod opening 48 or web opening 164, as may be), at an oblique angle. Although the lowermost margin, or termination, of rib 134 (or 136, as may be) may be tangent to one or other, or both of the applicable openings in the various webs so that it merges smoothly therewith, it may be that rib 134 (or 136) may be less deep, and may terminate shy of the profile of opening 46 (or 48) or 162 (or 164), but stands downwardly proud of the adjacent region or wall thickness of the top cover plate or top flange of bolster 24 as in upper portion 82 more generally. For example, taking the full potential depth as the depth that would yield a reinforcement terminating flush with opening 46, 48, 162 or 164, as the case may be, in some embodiments, ribs 134 or 136 may be between half the potential depth and the full depth. In some embodiments openings 46, 48 may be formed to have a peripheral flange or bead or thickened rim, and ribs 134, 136 may be of corresponding depth, less the extra thickening of the bead or flange. The bottom margin 192 of rib 134 may follow (i.e., be flush with and conform to) the profile of the respective brake rod opening 46 or 48. The depth of the stem, or section, or web of rib 134 is such that the lowermost margin of rib 134 lies flush with, or clear of, brake rod envelope 50. Further, the outboard ends of rib 134 may merge into the generally diagonally downwardly and outwardly extending strut 174. As seen in FIG. 4*h*, upper rib 134 may have a central portion 194 between webs 130 and 132, and first and second end portions 196 and 198 that extend transversely outboard of webs 130 and 132 respectively. End portion 196 may extend fully between web 130 and first side wall portion 86; end portion 198 may extend fully between web 132 and second side wall portion 88, the ends being smoothly and fully radiused into the webs and side walls as shown in FIG. 4*h*.

Lower transverse rib 138 (or 140) stands upwardly from lower portion or lower flange 84, and extends transversely between webs 130 and 132. The through thickness depth $t_{138}$ of rib 138 (or rib 140) is of greater depth than the general through thickness $t_{84}$ of lower portion 84. That is, rib 138 (or 140) stands upwardly of the surrounding structure of lower portion 84. Lower rib 138, (or 140) merges at smoothly radiused corners into webs 130 and 132. Lower rib 138, 140 may have a central portion 200 located between webs 130 and 132; and end portions 202 and 204 that extend between web 130 and first side wall portion 86; and between web 132 and second side wall portion 88 respectively. In each case, as shown in FIGS. 4*e*, 4*f* and 4*g*, portions 200, 202 and 204 intersect and are smoothly radiused into webs 130, 132 and side walls 86, 88, as may be. Lower rib 138, 140 may have an upper margin 206 that is flush with the lower edge of brake rod openings 46, 48 and flush with brake rod openings 162, 164, as may be. Lower rib 138 (or 140) may be located at the bottom center of brake rod openings 46, 48, 162, 164, where the distance between those openings and lower portion 84 is smallest, and where the slope, or tangent to the slope, is parallel to lower portion 84. Lower rib 138 (or 140) may stand substantially vertically upright from lower portion 84. The height of rib 138 (or 140) in the vertical, or z-direction may be the same as, or greater than its width in the lengthwise or x-direction of bolster 24. In some embodiments the aspect ratio of height to width may be in the range of ¾ to 2.

Figure 5C:
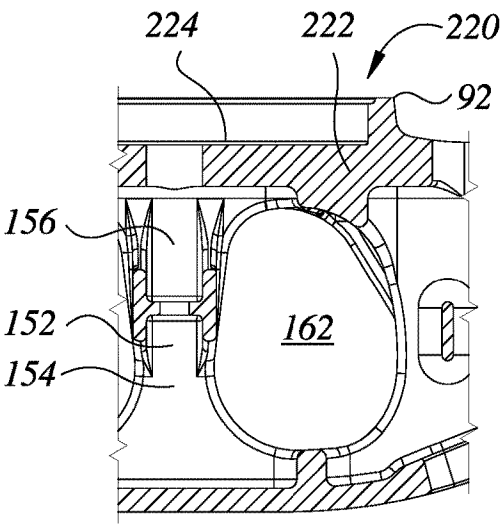
FIG. 5*c* is an enlarged detail of a centerline longitudinal cross-section showing the brake rod opening and an embodiment of the upper rib in cross-section.
Figure 5D:
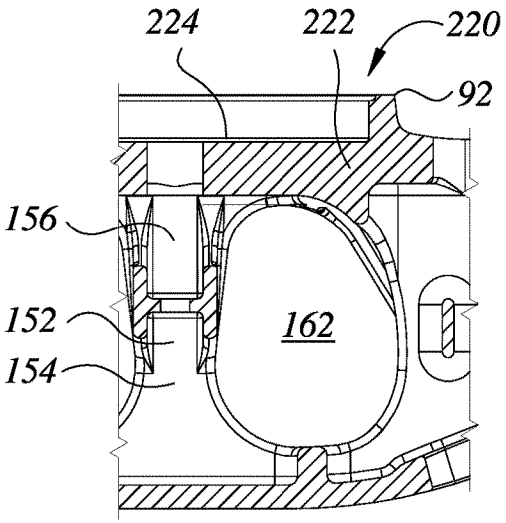
FIG. 5*d* shows an alternate embodiment of the enlarged detail of FIG. 5*c;*
Figure 5A:
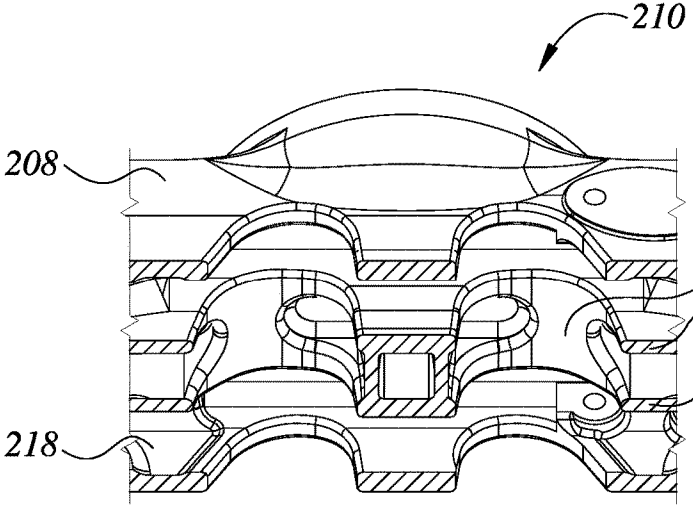
FIG. 5*a* is an underside perspective view of an embodiment of the bolster of FIG. 2*a* on a section immediately below the bottom margin of the upper rib transition.

In an alternate embodiment, shown in FIG. 5*a*, truck bolster 210 has upper ribs 212 that extend between internal webs 214, 216. Upper ribs 212 do not extend to the web defined by outside side walls 208, 218. Bolster 210 may be taken as otherwise the same as bolster 24. At the lengthwise outboard margins, ribs 222 increase in depth, following the profile of openings 162, 164. The outside termination of this region is at or near the downward vertical projection of rim 92 taken along the bolster central vertical plane, as seen in FIG. 5*c*, in which the outer margin lies directly, or very nearly directly, underneath the inside face of rim 92.

Figure 5B:
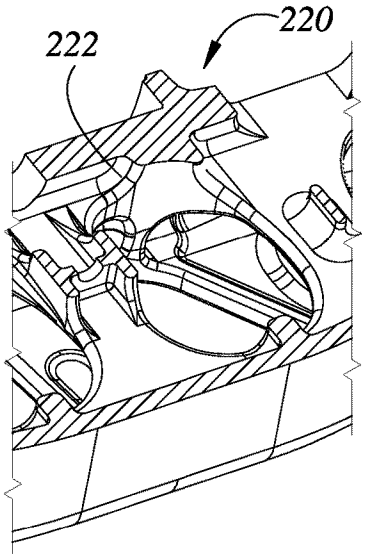
FIG. 5*b* is an enlarged detail of the upper rib transition on a centerline section.

In the embodiment of FIGS. 5*b* and 5*c*, truck bolster 220 has upper ribs 222 that extend fully across the underside of center plate bowl 224 in the transverse direction, not merely between the inner two vertical webs. A region may be defined between the respective locations of horizontal tangency of the uppermost portion of brake rod openings 46, 48, and 162, 164, identified by tangent points 223. In that region, rib 222 is deeper than the surrounding though-thickness of top flange 82, generally, at locations distant from center plate bowl 224. In the embodiment of FIG. 5*d*, ribs 222 effectively merge to form a single monolith, an extra-thick (i.e., thicker than the top or upper flange 82, outside the center plate bowl more generally) plate running fully across bolster 220. The thickened portion is flat, or roughly flat, on the underside between the horizontal tangent points 223 of brake rod openings 162 and 164. Expressed differently, rib 222 can be thought of as occupying the space from the center plate center pin aperture to the location of horizontal tangency, point 223. In that region rib 222 predominantly fills such space. In some embodiments, such as that of FIG. 5*d*, the depth of that region may be the entire depth from the inner surface of center plate bowl 224 to the plane of the horizontal tangent at point 223. In such cases, rib 222 may entirely fill such space. Rib 222 may also extend outboard past tangent point 223, as shown in FIG. 5*d*. In some embodiments rib 222 may overlie tangent point 223. In other embodiments, such as those of FIGS. 5*a*, 5*b* and 5*c*, some, a majority, or all, of rib 222 may lie outboard of tangent point 223.

Figure 6A:
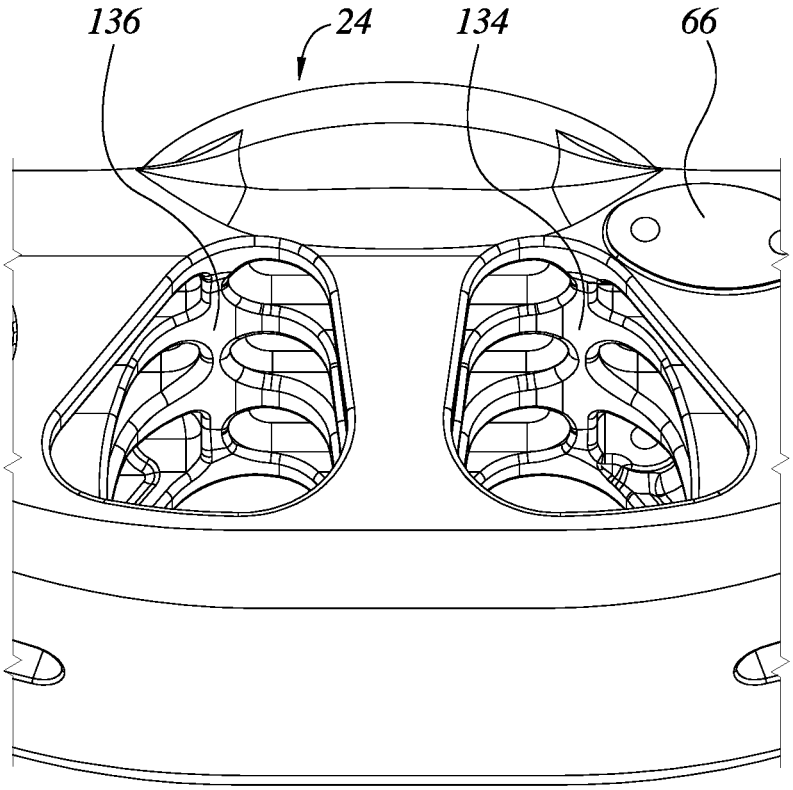
FIG. 6*a* is an underside perspective view of a detail of the bolster of FIG. 2*a;*
Figure 6B:
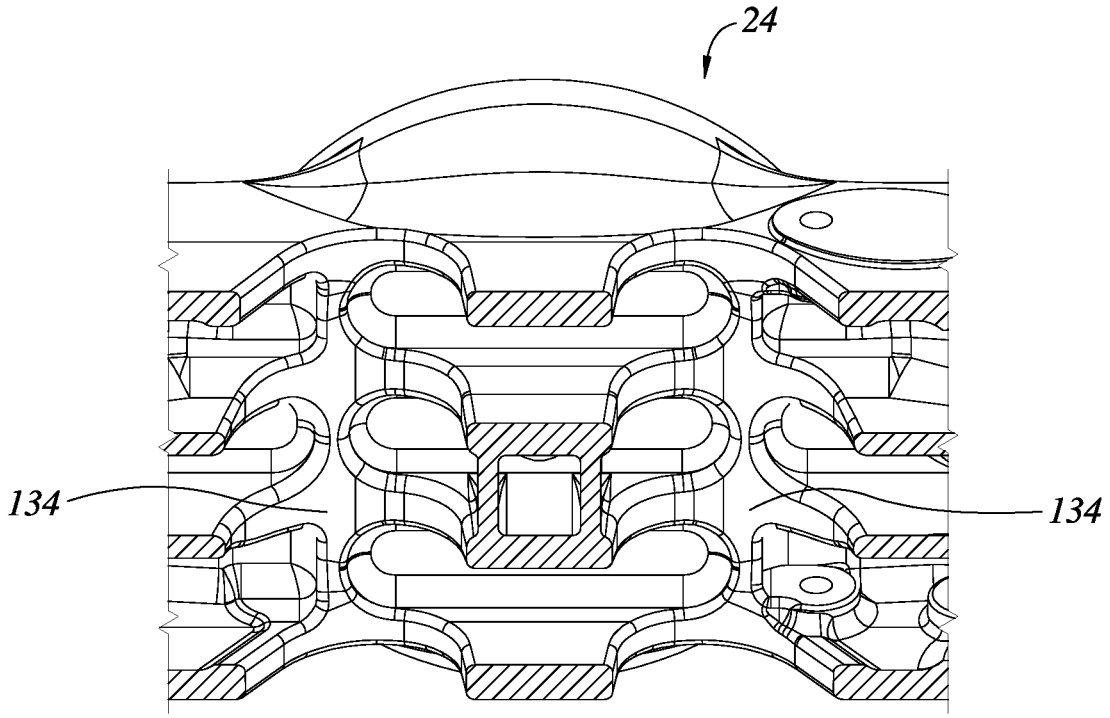
FIG. 6*b* is an enlarged sectional view of the detail of FIG. 6*a* showing the upper internal ribs and their mergers with the longitudinal bolster webs.

In FIGS. 6*a* and 6*b*, truck bolster 24 can be seen to have upper ribs 134, 136 that extend across the bolster 24 in the transverse direction in a straight line, and in which rib 134, 136 is of constant width, other than being radiused at the mergers into the side walls and the internal webs.

Figure 7A:
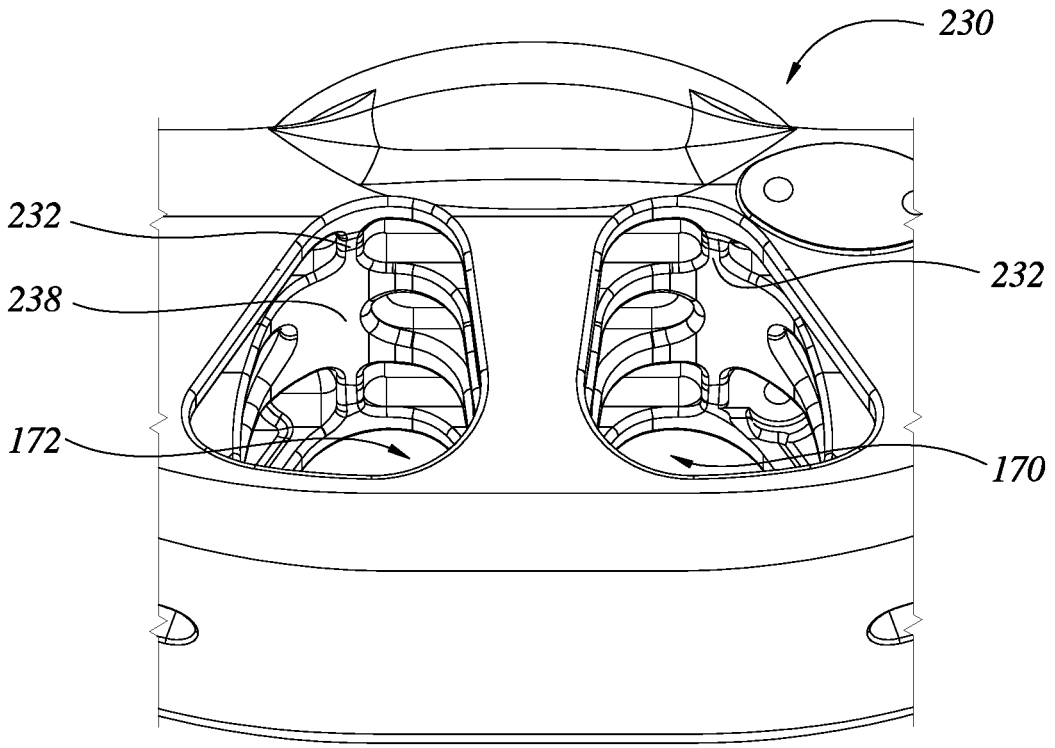
FIG. 7*a* shows an alternate embodiment of the detail of FIG. 6*a;*
Figure 7B:
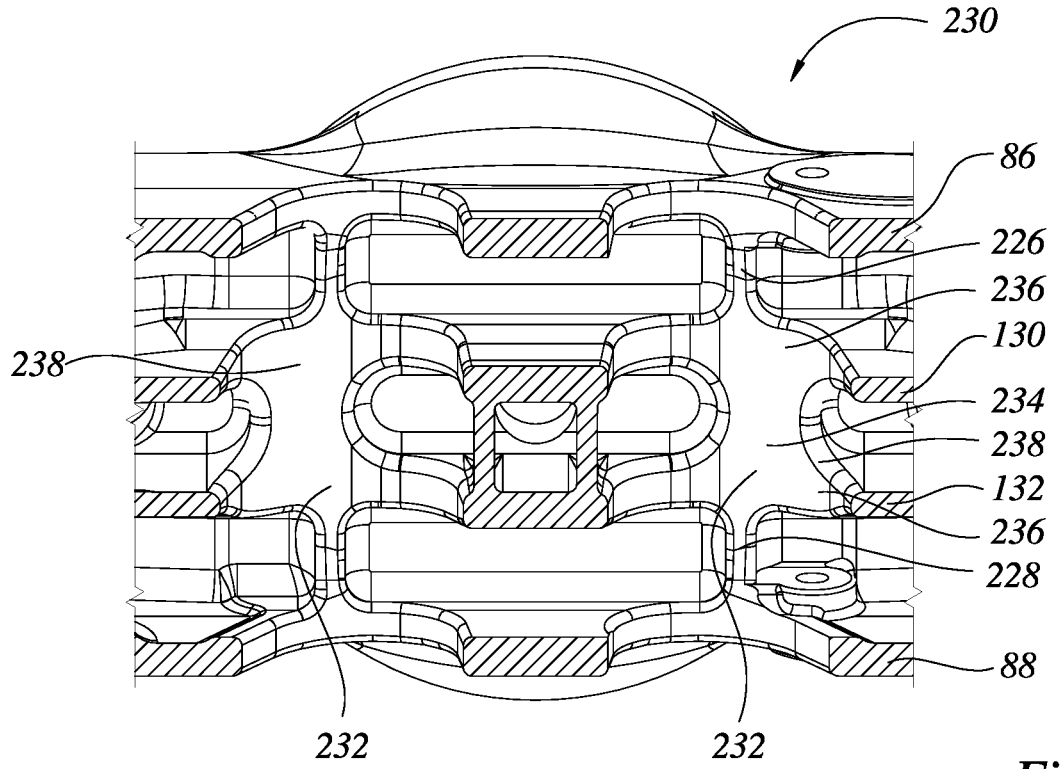
FIG. 7*b* shows an enlarged detail of the embodiment of FIG. 7*a;*

In the embodiment of FIGS. 7*a* and 7*b*, bolster 230 has upper ribs 232 having a central portion 234 between internal webs 130, 132; and first and second end portions 226, 228 that are between webs 130 and first side wall 86; and between web 132 and second side wall 88, respectively. Central portion 234 has an outboard transition or merger 236 between internal webs 130 and 132 that extends outboard of the horizontal point of tangency of brake rod openings 162, 164, and extends along the sloping profile of those openings, as in the embodiment of FIGS. 5*b* and 5*c*, to yield the inclined transverse archway 238 seen in FIGS. 7*a* and 7*b*. The resultant central portion 234 is at all points wider than the corresponding width of outboard end portions 236. Central portion 234 may have a greater cross-sectional area than outboard end portions 226, 228.

Figure 8A:
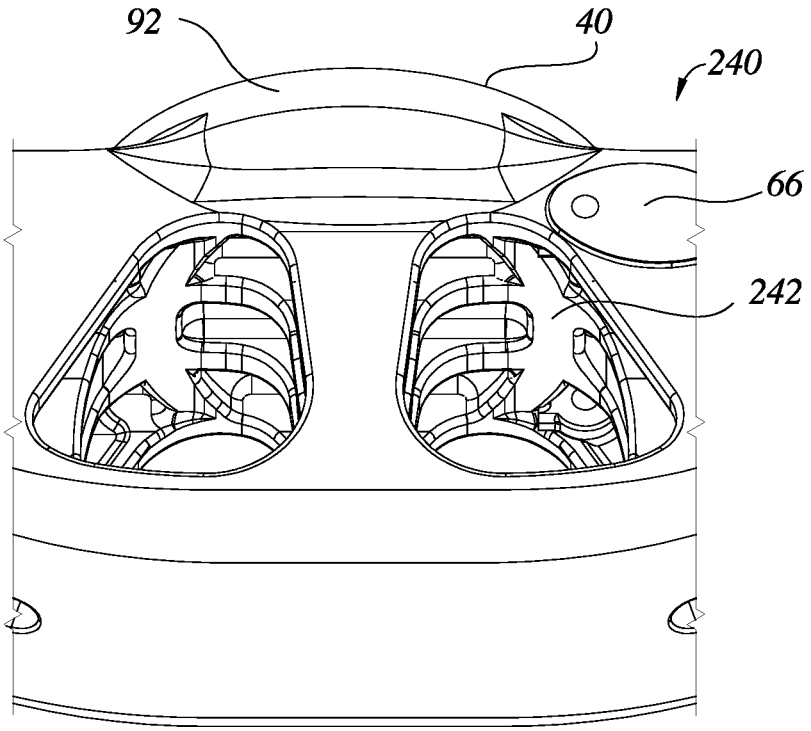
FIG. 8*a* shows a further alternate embodiment of the enlarged detail of FIG. 6*a;*
Figure 8B:
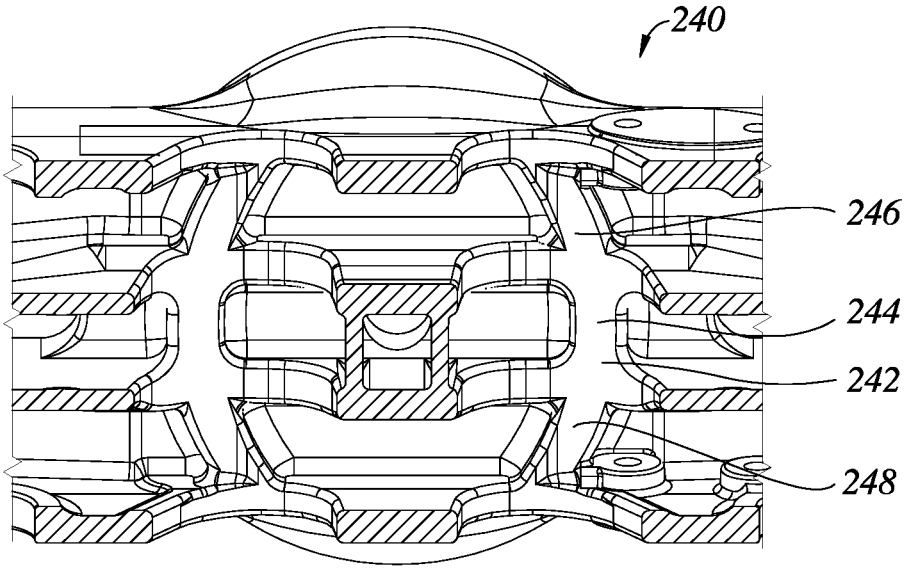
FIG. 8*b* shows an enlarged sectional view revealing the detail of FIG. 8*a;*

In the embodiment of FIGS. 8*a* and 8*b*, truck bolster 240 is substantially the same as truck bolster 24, but differs therefrom in having upper ribs 242 that are curved on an arc when viewed in vertical projection from underneath. Upper rib 242 has a central portion 244 and first and second end portions 246, 248. Central portion 244 is similar to rib 212 of FIG. 5*a* or central portion 234 of FIG. 7*b*, being of deeper thickness on the outboard margin as it follows the brake rod opening outward and downward. Upper ribs 242 may taper in thickness from a widest dimension in central portion 244 to a narrower dimension in end portions 246, 248. Rib 242 is concave toward center plate center pin opening. Rib 242 need not follow a circular arc, and need not follow the same arc as the circumference of rim 92. In the embodiment of FIGS. 8*a* and 8*b*, central portion 244 lies in the same, or substantially the same, position as shown in FIG. 5*c*, and the end portions 246, 248 curve toward the uppermost part of brake rod opening, the top center position, that being the location at which the web depth from the underside of center plate bowl 40 to the top of brake rod openings 46, 48 is smallest; and being the point at which the tangent to the profile of the brake rod opening is horizontal. As shown in FIG. 8*b*, the curve of rib 242 follows a continuous, smooth arc.

Figure 9A:
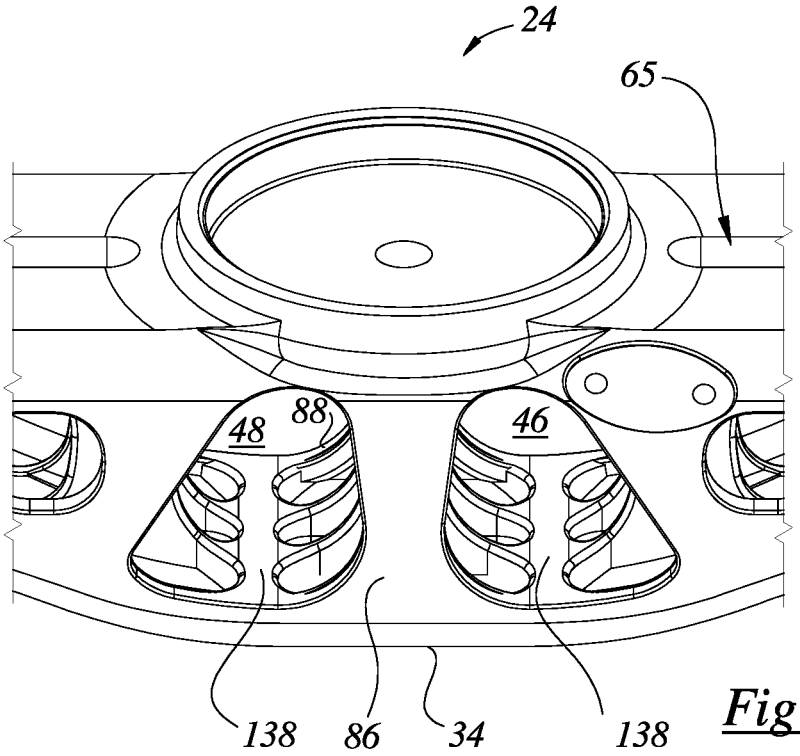
FIG. 9*a* shows a detail of lower ribs of an embodiment of the bolster of FIG. 2*a;*
Figure 9B:
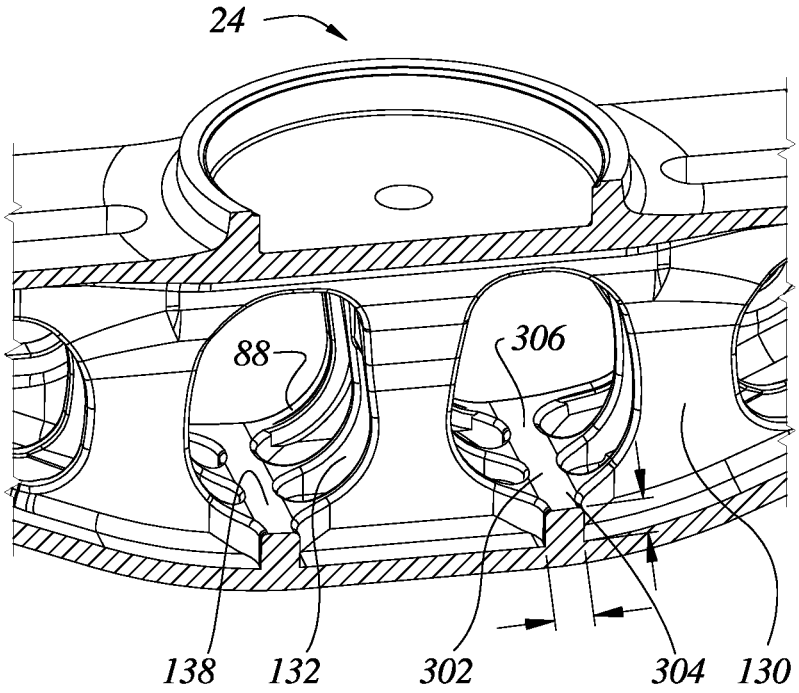
FIG. 9*b* shows an alternate view of the detail of FIG. 9*a* with the near-side external web removed to show internal detail.

The embodiment of FIG. 9*a* shows a perspective view of an embodiment of truck bolster 24 having a bottom flange or tension member 34 and first and second lower transverse reinforcements, which may also be called, or have the form of, lower ribs 138, 140. Lower ribs 138, 140 may run transversely across bottom flange or bottom portion 84 beneath brake rod envelopes 50. Alternatively lower ribs 138, 140 may run transversely flush with the profile of brake rod openings 46, 48 more generally. The perspective view of FIG. 9*b* shows a sectional view of bolster 24 with the foreground side wall removed to show the section of ribs 138, 140 midway between the outside side wall 86 (or 88) and the adjacent internal web 130 (or 132).

In summary, truck bolster 24 may be a hollow beam, i.e., a hollow box-beam, having a lengthwise extending tension member 34, a lengthwise extending compression member 32, and lengthwise running upstanding webbing extending between compression member 32 and tension member 34. Compression member 32 includes a center plate bowl 40. Bolster 24 has first and second brake rod clearance envelopes 50 defined transversely therethrough. As explained above, the upstanding webbing includes a first internal web, namely web 130, and a first lower internal rib 138 that intersects and extends side-ways relative to web 130. First internal web 130 has brake rod openings 46, 48 that provide clearance for respective first and second brake rod clearance envelopes 50. First brake rod opening 46 has a periphery. First internal rib 138 stands upward of tension member 34 and has an uppermost margin flush with the periphery of first brake rod opening 46. Bolster 24 also has a second lower internal rib 140 that stands upwardly of tension member 34. The second lower internal rib 140 has an uppermost margin flush with the periphery of second brake rod opening 48.

As described above, the webbing of bolster 24 includes a second internal web 132 spaced from first internal web 130. First lower internal rib 138 runs across tension member 34 between, and intersects smoothly with, first web 130 and second web 132.

As described, the webbing of bolster 24 includes the external webs defined by first and second side walls 86, 88. First lower internal rib 138 extends across tension member 34 from first side wall 86 to second side wall 88. First lower internal rib 138 is a lower first rib. Truck bolster 24 also has a first upper rib 134. First upper rib 134 extends underneath center plate bowl 40 sideways relative to first external web, or side wall portion, 86. First upper rib 134 terminates clear of said first brake rod opening envelope 50. First upper rib 134 may also terminate flush with, and conform to, said first brake rod opening 46.

As described, truck bolster 24 has upper first and second ribs 134, 136 that extend underneath center plate bowl 40 between, and intersect smoothly with, first and second side walls 86, 88. First and second upper ribs 134, 136 terminate clear of first and second brake rod opening envelopes 50 of openings 46, 48 respectively. First and second upper ribs may terminate flush with, and conform to, first brake and second brake rod openings 46, 48 respectively.

Figure 9C:
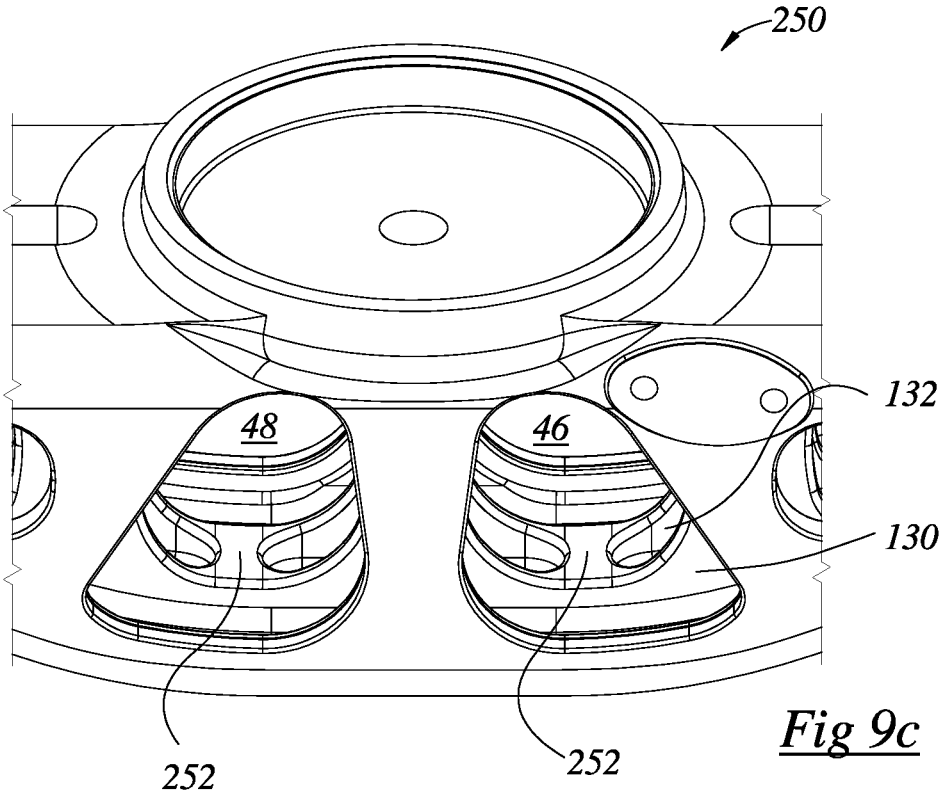
FIG. 9*c* shows an alternate embodiment of the detail of 9*a;*
Figure 9D:
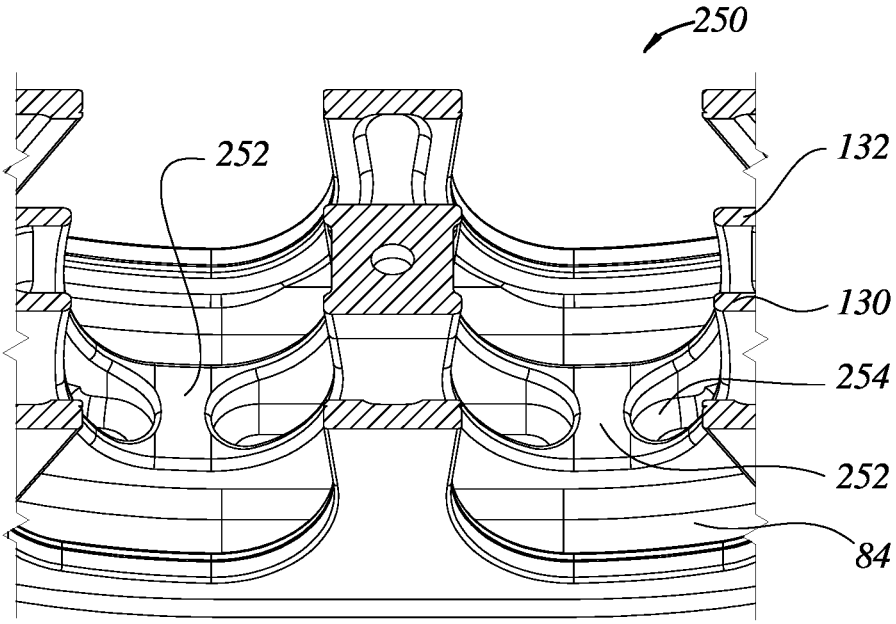
FIG. 9*d* shows a horizontal transverse section of the enlarged detail of FIG. 9*c*, taken at mid-height of external web, looking downward.

As also described above, truck bolster 24 has lower ribs 138, 140 having a central portion 302 between internal webs 130, 132, and end portions 304, 306 that are between internal web 130 and external side wall, or web, 86; and between internal web 132 and external side wall, or web, 88, respectively. The perspective view of FIGS. 9*c* and 9*d* show a truck bolster 250 having lower ribs 252 that extend only between internal webs 130 and 132. In each case, the transverse rib (be it 138, 140, or 252) is smoothly radiused to merge into the respective walls or webs, such that the radius wall forms a semi-circular or semi-oval end wall 254 to the adjoining portion of bottom portion or flange 84. The upper surface of lower ribs 138, 140 or 252 (as may be) as viewed in FIGS. 9*a* to 9*d* extends up to the bottom edge of the brake rod opening 46, 48. Truck bolster 250 is otherwise similar to truck bolster 24, etc.

Figure 10A:
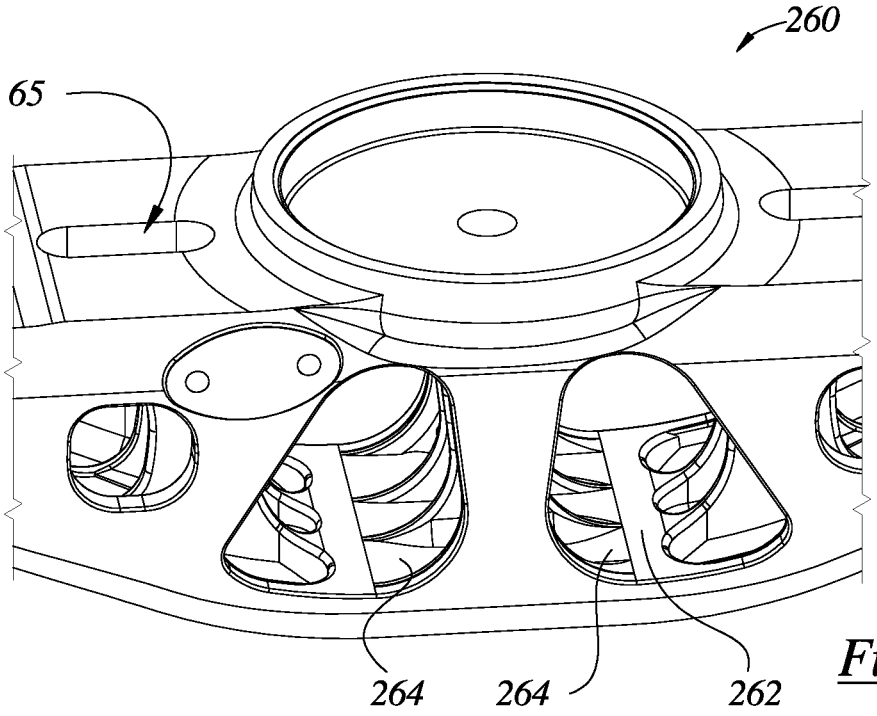
FIG. 10*a* shows an alternate embodiment of the detail of 9*a;*

In the embodiment of FIG. 10*a*, truck bolster 260 has bottom ribs 262 similar to ribs 138, 140. However, the lengthwise space between the ribs is filled with cast steel to form a single continuous thickened flange as indicated at 264. In the embodiment shown, the filled thickness has a depth corresponding to the depth of the lower internal ribs 138, 140 at the horizontal tangent point of brake rod openings 162, 164. Truck bolster 260 is otherwise the same as truck bolster 24, etc.

Figure 10B:
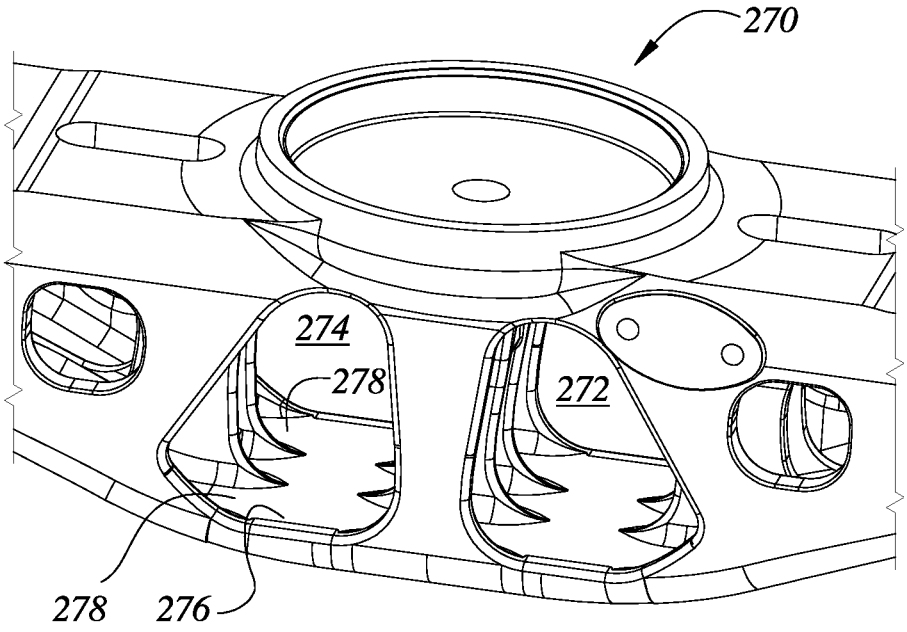
FIG. 10*b* shows an alternate embodiment of the detail of 9*a;*

In the embodiment of FIG. 10*b*, truck bolster 270 has a central portion of the bottom flange that is filled as a solid casting flush to the level of the tangent point of brake rod openings 46, 48. As shown, that depth is greater than what would otherwise be the bottom of openings 272, 274 such that the level of the cast steel drowns (i.e., has a thickness deeper than) what would otherwise be the tangent point. The extra thickness portion 276 extends on the horizontal plane with tapering thickness at the ends 278 outboard of the point of tangency as the central portion merges into the upwardly angled transition portion of the bottom flange. Truck bolster 270 is otherwise the same as truck bolster 24, etc.

Figure 10C:
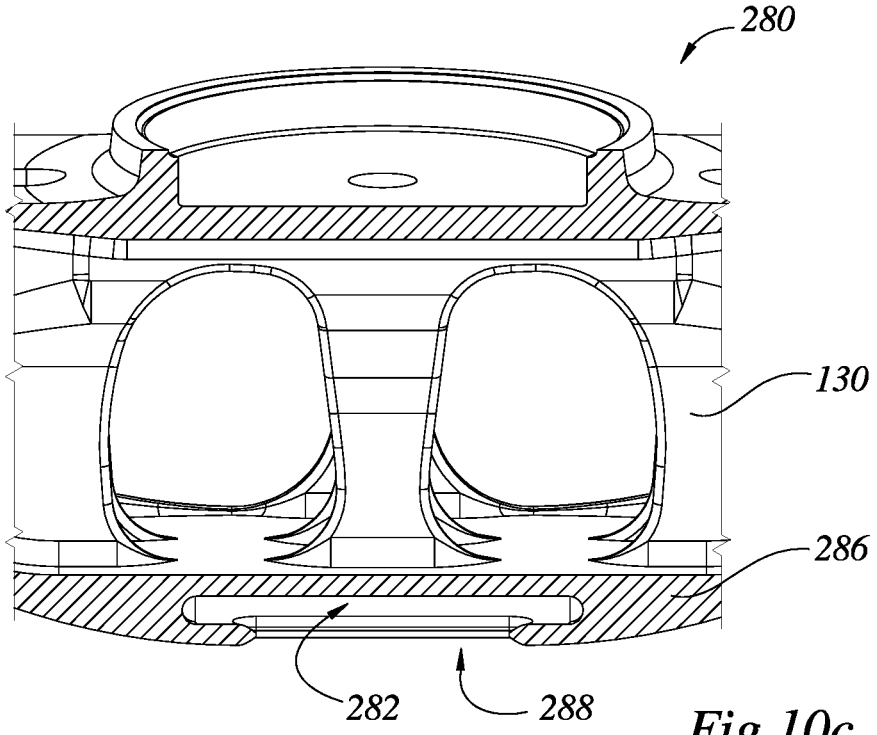
FIG. 10*c* shows an alternate view of the detail of FIG. 10*b* with the near-side external web removed to show internal detail.
Figure 10D:
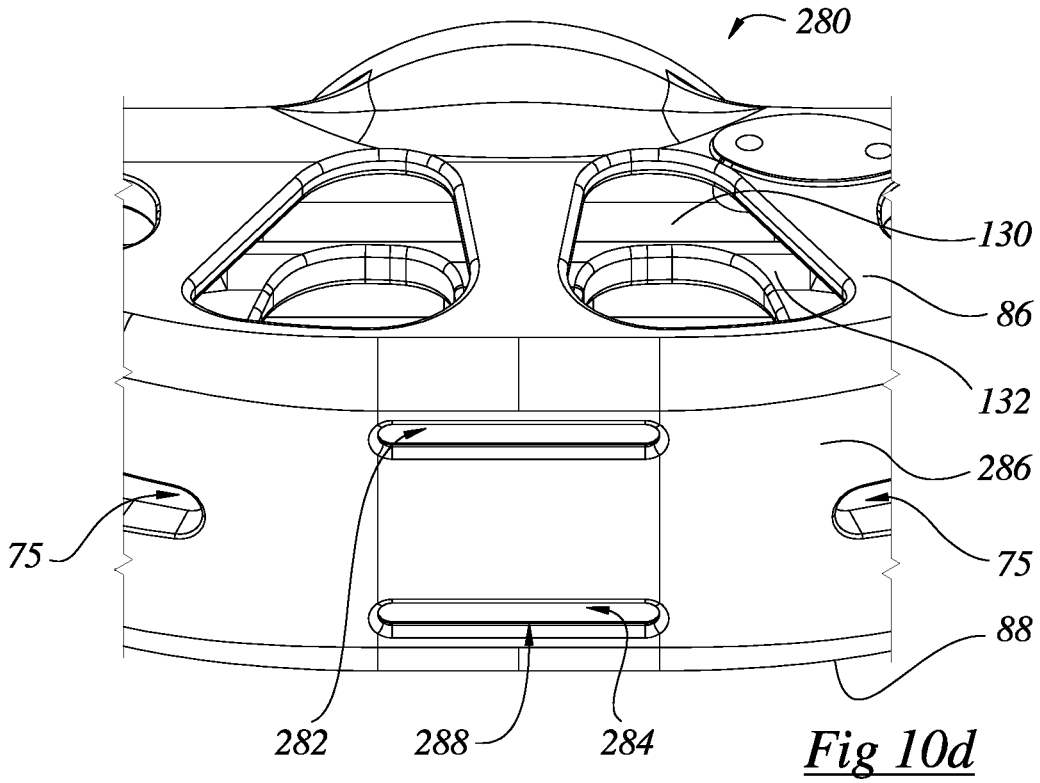
FIG. 10*d* shows a perspective view, partially from below of an embodiment in FIG. 10*b* with hollow spaces in lower flange.

In the embodiment of FIGS. 10*c* and 10*d*, bolster 280 may be taken as being the same as bolster 270. However, bolster 280 has hollow spaces or cavities 282, 284 formed in lower flange 286 between each outboard side wall, or web, 86, (or 88) and the adjacent internal web 130, (or 132). The internal space is both longer and wider than the drainage opening 288. The effect is to make the bottom portion into a flanged beam or open section. The central portion between webs 130, 132 is solid, not having a cavity formed therein.

Figure 10E:
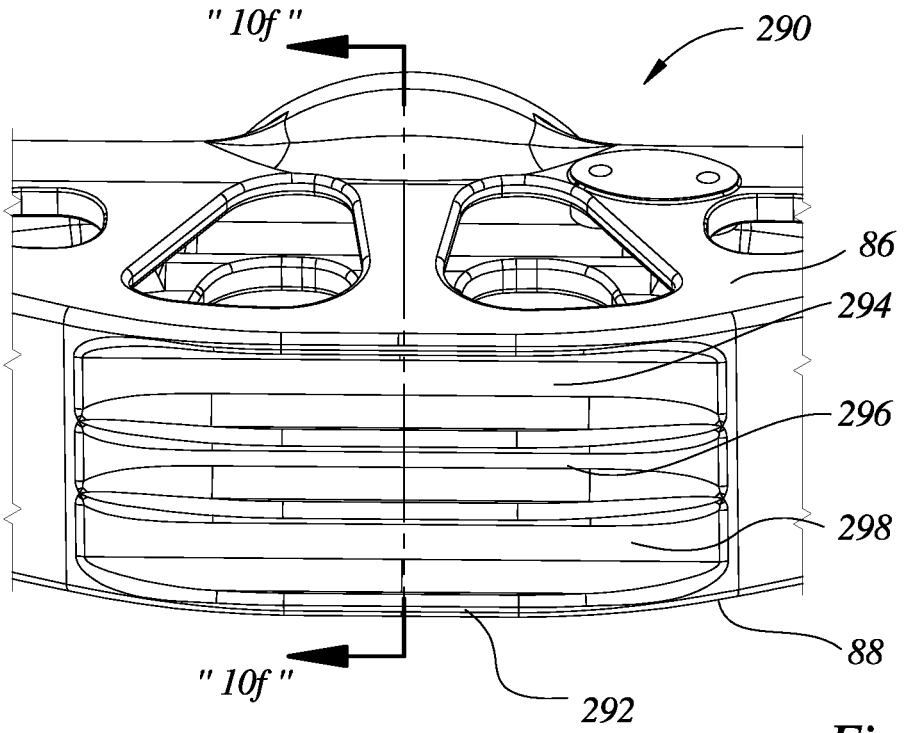
FIG. 10*e* shows a perspective view, partially from below of the embodiment in FIG. 10*b* with tension member being hollowed out.
Figure 10F:
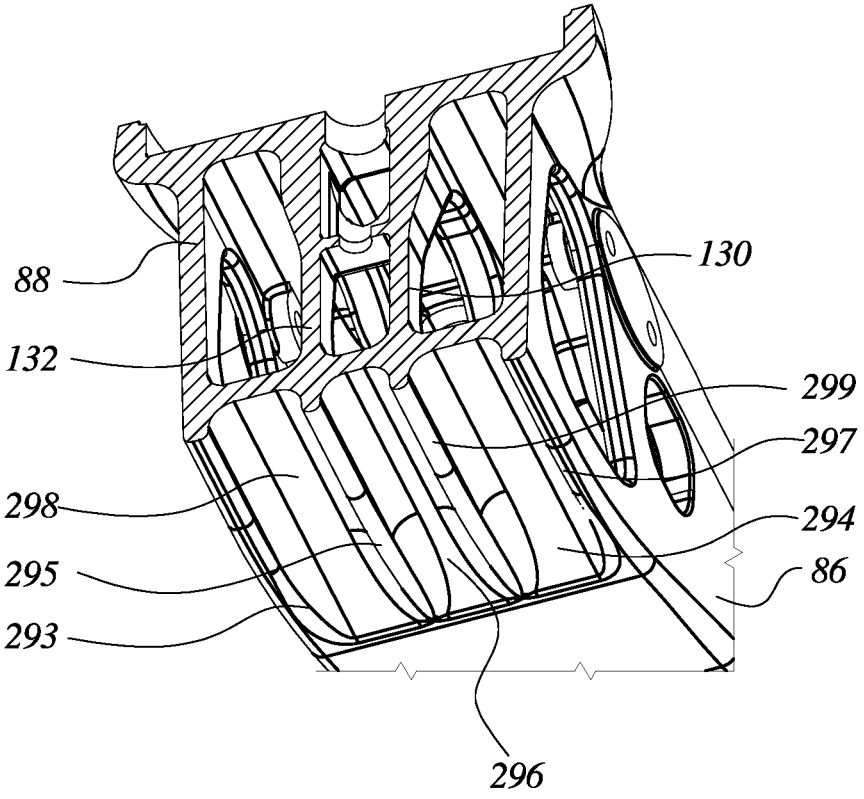
FIG. 10*f* shows a perspective view of the bolster taken on the central transverse plane of section '10*f*-10*f*' of FIG. 10*e;*

In the embodiment of FIG. 10*e*, bolster 290 is substantially similar to bolster 270, except that the exterior of central portion 292 of the tension member has relatively thin webs 294, 296, 298 that extend in a horizontal, or substantially horizontal plane or surface, web 294 extending in the lateral space between outside wall 86 and internal web 130; web 296 extending in the lateral space between upstanding internal webs 130 and 132; and web 298 extending laterally between internal web 132 and outside wall 88 respectively, with the bottom margins or web extensions 293, 295, 297 and 299, respectively, of the webs defined by items 86, 88, 130, and 132 extending downwardly proud of webs 294, 296, and 298. In this structure, the tension member, or bottom flange, of bolster 290, globally, includes webs 294, 296 and 298. In the central span of the bottom flange between struts 149, (or struts 174), beneath openings 46, 48 (or 162, 164), it may be desired to increase the local flexural stiffness of bottom flange 84. To that end, web extensions 293, 295, 297 and 299 may tend to co-operate with webs 294, 296 and 298, thereby to function in combination as a flange of enhanced local flexural stiffness.

Figure 11A:
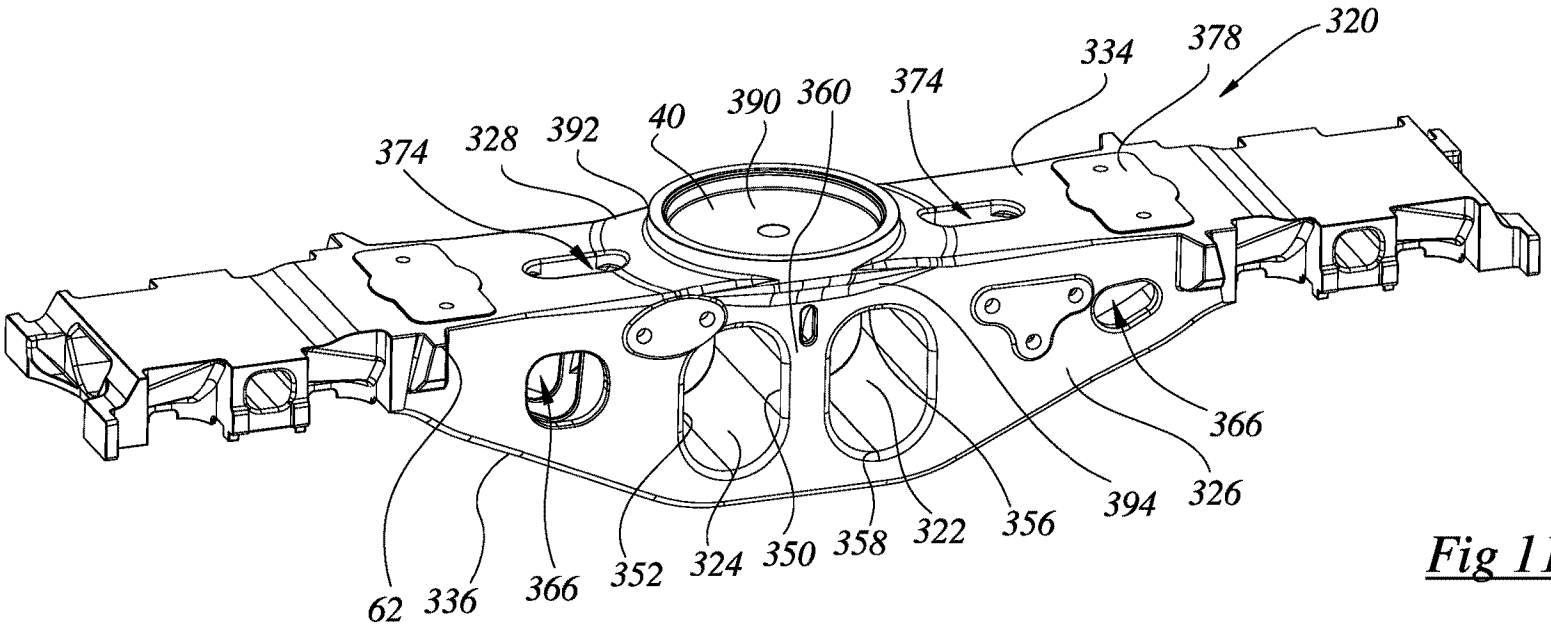
FIG. 11*a* shows a perspective view of an alternate embodiment of bolster to that of FIG. 2*a* having brake rod opening lining tubes.
Figure 11B:
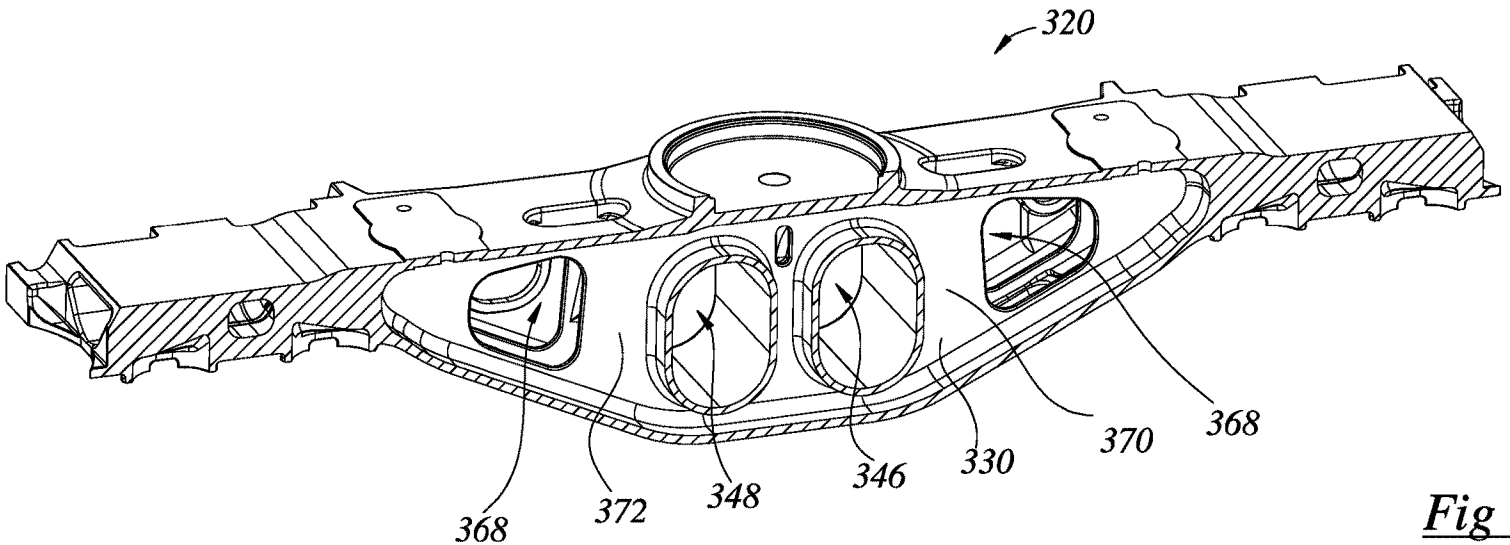
FIG. 11*b* is an isometric section of the bolster of FIG. 11*a* taken inward of the foreground outside bolster web looking toward a near-side internal web.
Figure 11C:
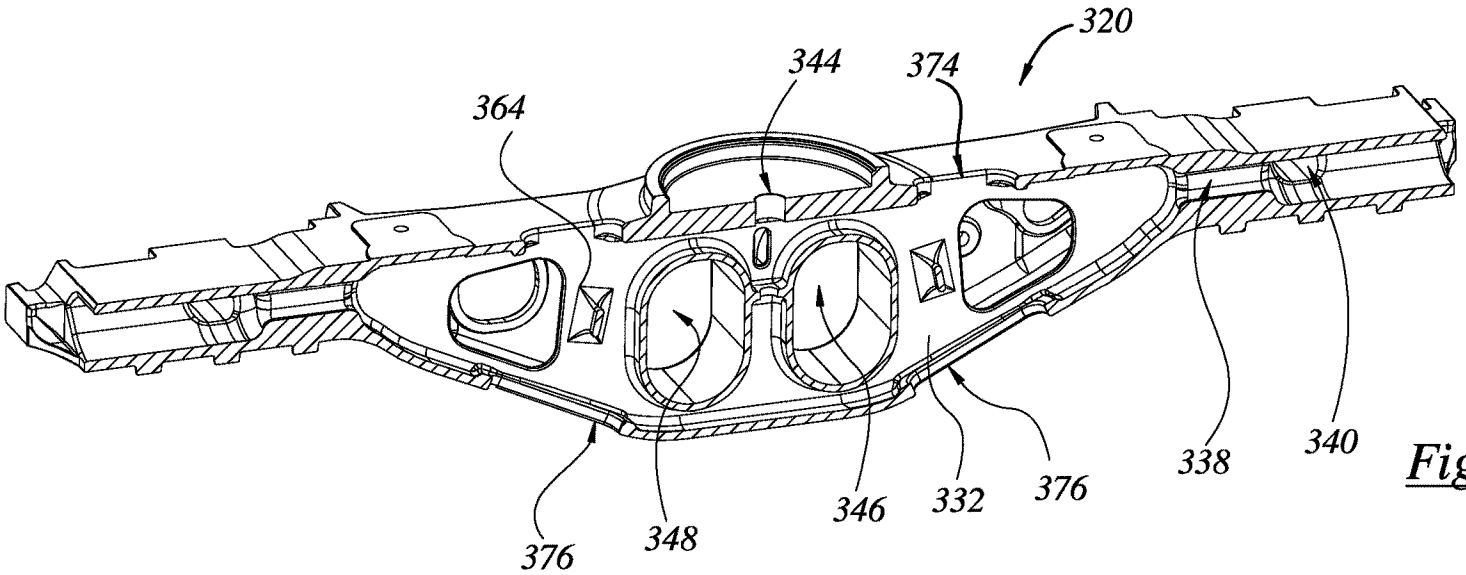
FIG. 11*c* is an isometric sectional view on a vertical plane of the railroad car truck bolster of FIG. 11*a* taken along the longitudinal centerline thereof.
Figure 11D:
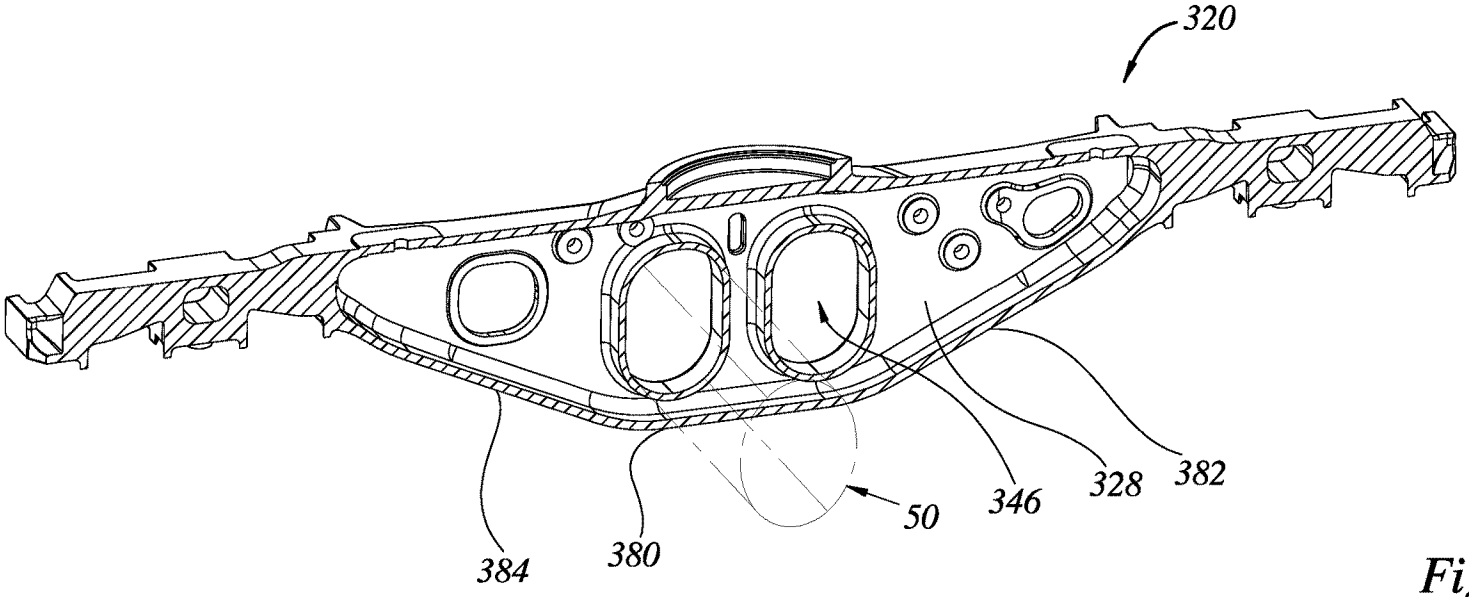
FIG. 11*d* is an isometric sectional view of the railroad car truck bolster of FIG. 11*a*; on a vertical longitudinal plane outboard of the far side internal web, and looking toward the far side external web thereof.
Figure 11E:
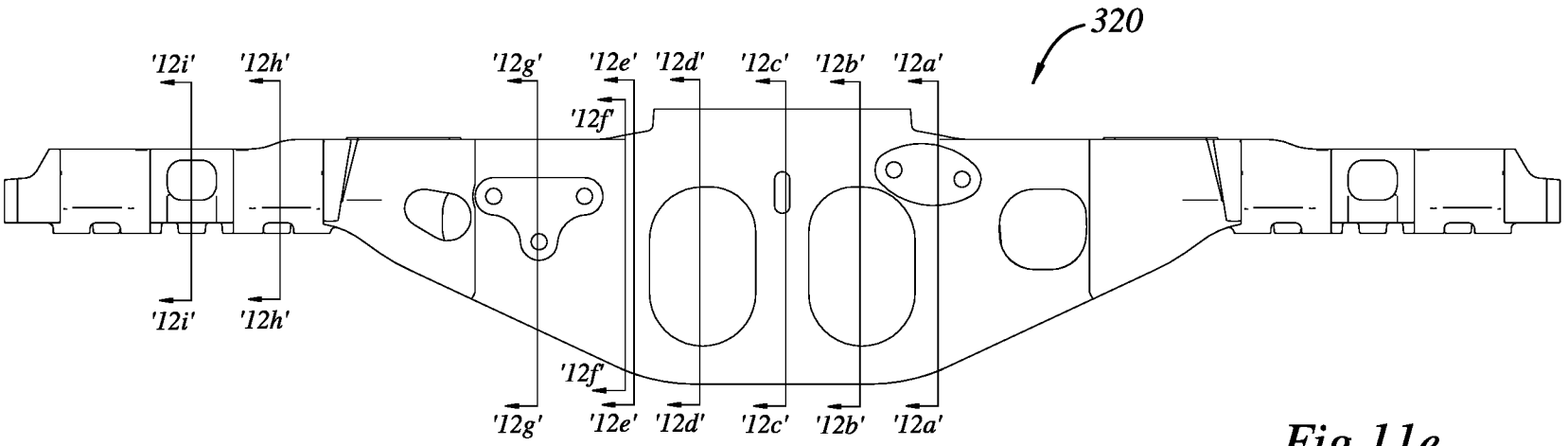
FIG. 11*e* is a side view of the bolster of FIG. 11*a;*

To this point, all of the embodiments have employed upper transverse reinforcements or ribs, lower transverse ribs or reinforcement, or both. In the embodiment of FIGS. 11*a*-11*d* and 12*a*-12*i*, bolster 320 has internal tubes, or tubular members, or tubular liners 322, 324, however they may be termed. FIGS. 11*a*-11*d* correspond generally to the sectional views of FIGS. 2*a*-2*d*. FIG. 11*e* shows the sectional locations of the views of FIGS. 12*a*-12*i*. Liners 322 and 324 extend transversely across bolster 320 and are connected to the various webs to form vaults or archways, or arches, over the brake rod openings, and, in the embodiment shown, to form a fully peripherally extending wall around the openings. As before, bolster 320 may typically be a monolithic steel casting.

In greater detail, bolster 320 has a first external side wall or outside wall web 326, a second external side wall or outside web 328, and first and second internal webs 330, 332, all of the various webs extending lengthwise along bolster 320 and standing substantially upright, spaced apart, and generally parallel to each other. Bolster 320 has an upper or top flange 334, and a lower or bottom flange 336. The center plate bowl 40 is as before. The structure outboard of inboard bolster gib 62 is substantially the same as that of truck bolster 24, other than the existence of an internal lengthwise running cavity or core or bore 338 and a crosswise bore or cavity 340 formed transversely across bolster 320 through its middle above the center of the upper spring seat, i.e., through the central spring row lands, that intersects with bore 338. Bore 338 forms a continuous passageway that connects the internal hollow chambers of bolster 320 to the tapered hollow 342 formed inwardly from the outermost end of bolster 320. In the middle of bolster 320 there is a center pin access opening 344. There are slots formed in the top and bottom flanges of the bolster in the transition regions to either side of the center plate, as indicated at 85 and 95, respectively. Slots 85 and 95 have length to width aspect ratio of about 2½:1 to 4:1.

Figure 12A:
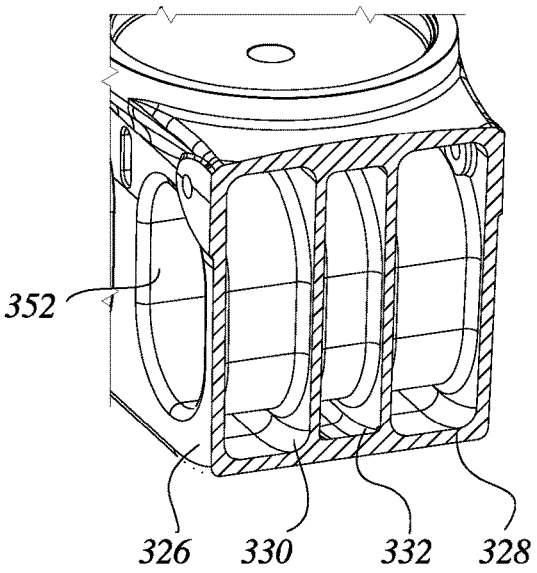
FIG. 12*a* is a perspective, vertical transverse section of the bolster of FIG. 11*a* inboard of the brake beam mounting facing a near brake rod tube at the location of section '12*a*-12*a*' of FIG. 11*e;*
Figure 12B:
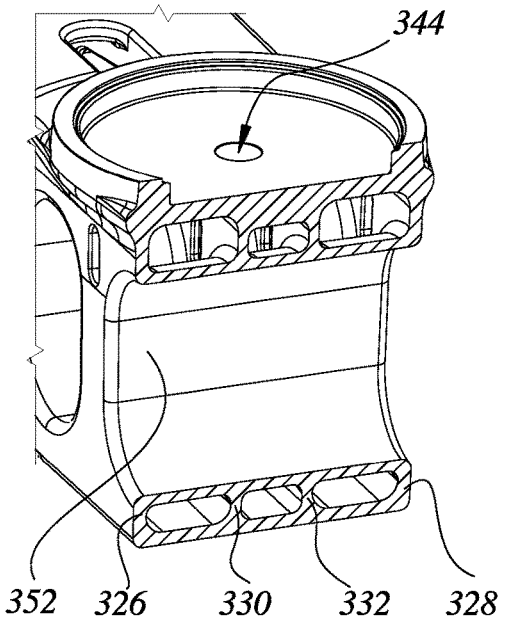
FIG. 12*b* is a view on a vertical transverse section of the bolster of FIG. 11*e* at the mid-section of the near side brake rod tube of FIG. 12*a* at section '12*b*-12*b*'.
Figure 12C:
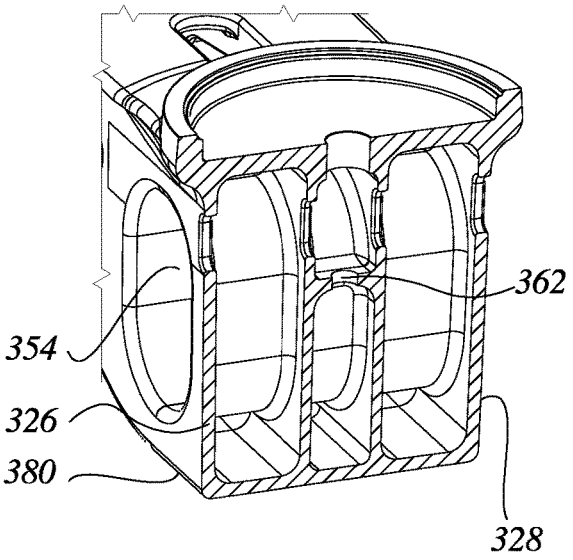
FIG. 12*c* is a view on a vertical plane of symmetry of the bolster of FIG. 11*a* looking toward a far side brake rod tube at section '12*c*-12*c*' of FIG. 11*e;*
Figure 12D:
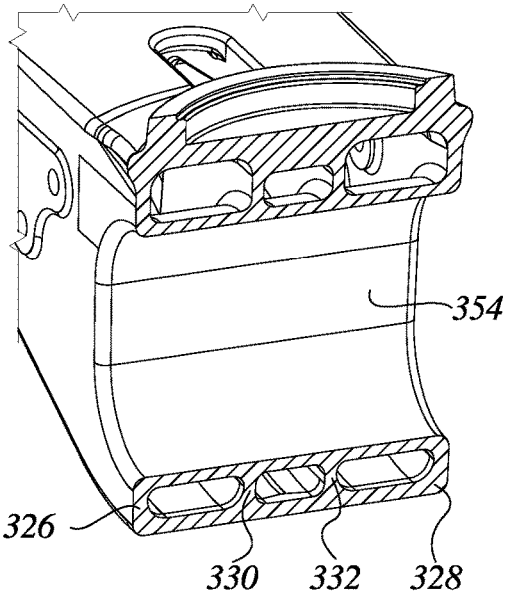
FIG. 12*d* is a vertical transverse section of the bolster of FIG. 11*e* at the mid-section of the far side brake rod tube of FIG. 12*c* at the location of section '12*d*-12*d*'.
Figure 12G:
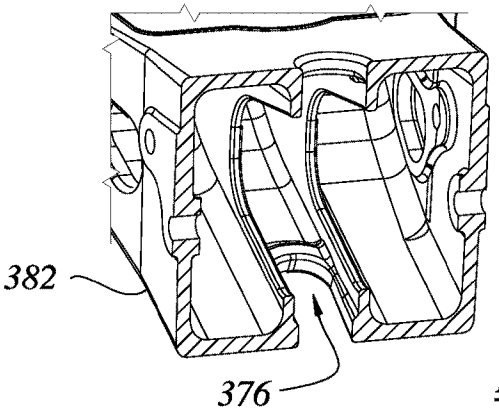
FIG. 12*g* is a perspective, vertical transverse section at '12*g*-12*g*' of FIG. 11*e* through the brake beam mount showing lightening openings in the internal webs and the outboard transition to twin webs under the side bearing mounting.
Figure 12H:
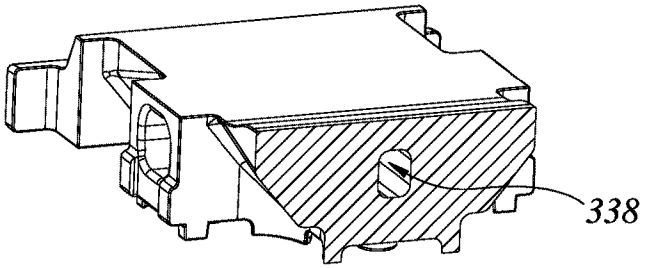
FIG. 12*h* is a perspective, vertical transverse section at '12*h*-12*h*' of FIG. 11*e* through the middle of an inboard damper pocket, showing internal hollowing.
Figure 12I:
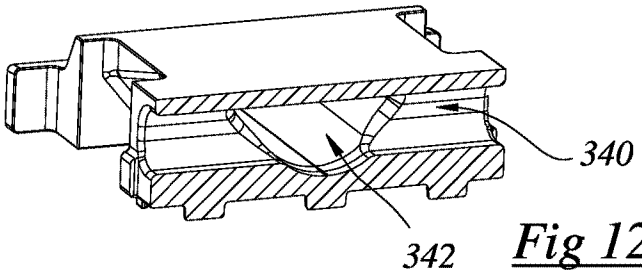
FIG. 12*i* is a perspective view on a vertical transverse section of the bolster of FIG. 11*a* through the hollow middle of the mid-row spring seat, looking outboard at the location of section '12*i*-12*i*' of FIG. 11*e;*
Figure 12E:
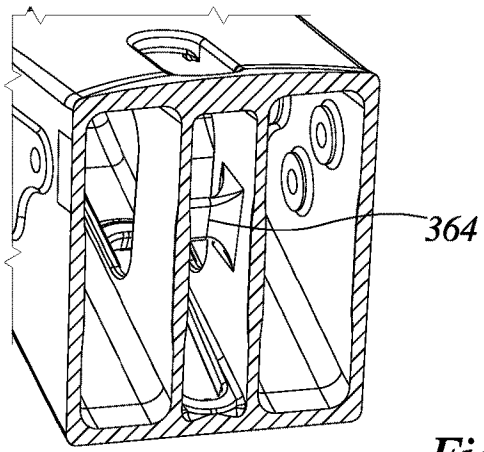
FIG. 12*e* is a perspective sectional view corresponding to the section of FIG. 12*a*, facing lengthwise outboard at the location of section '12*e*-12*e*' of FIG. 11*e;*
Figure 12F:
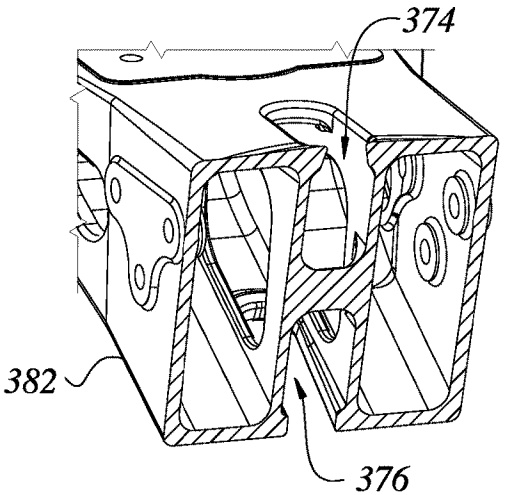
FIG. 12*f* is a perspective, vertical transverse section of the bolster of FIG. 11*a* through the internal web tie at the location of section '12*f*-12*f*' of FIG. 11*e;*
Figure 13A:
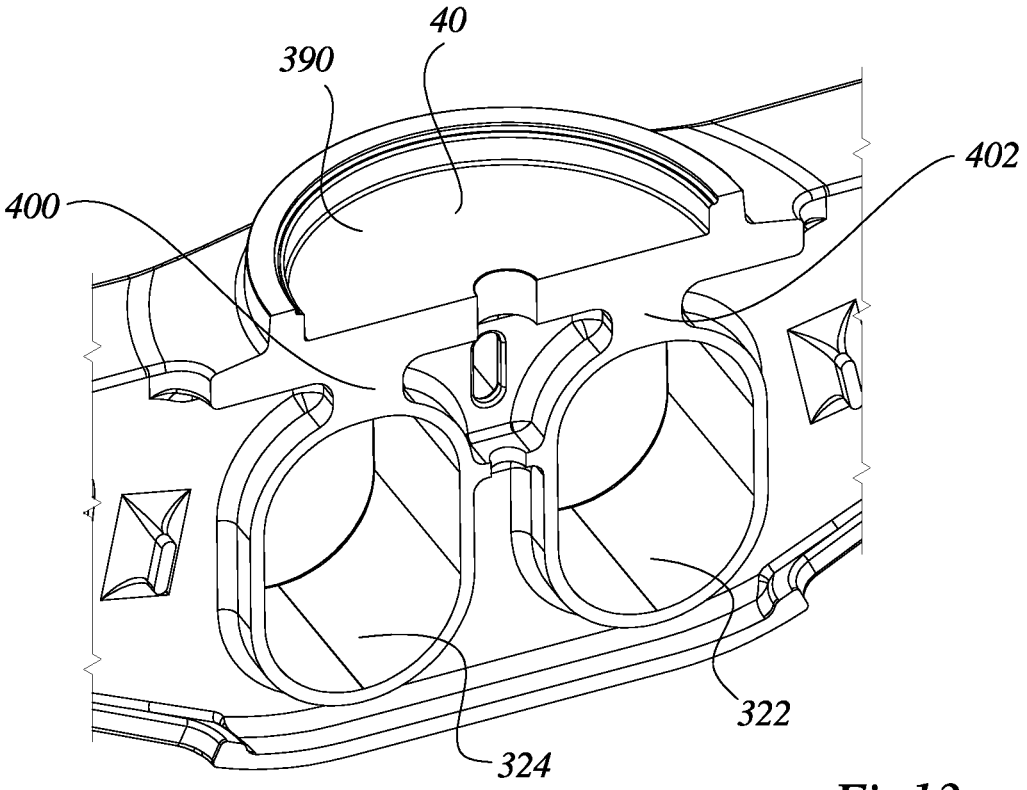
FIG. 13*a* is a perspective enlarged detail of an alternate embodiment to FIG. 11*c* showing ribs connecting the center plate bowl to the brake rod opening tubes.

All of the webs, that is to say all of items 326, 328, 330 and 332, have brake rod openings 346, 348. It is not necessary that brake rod liners 322 and 324 be cylindrical, i.e., of constant cross section. They could taper from the ends to the center, whether widening or narrowing, or the aspect ratio or shape of the section could change between triangular, trapezoidal, rectangular, oval or elliptical, and so on. However, it is convenient that their section be constant, and, accordingly, that the size and aspect ratio of the openings in all four webs be the same. In the example shown, each of brake rod openings 346 and 348 has a periphery 350 that includes a pair of inboard and outboard vertical margins 352, 354; and upper and lower semi-circular ends 356, 358. As before, at all locations periphery 350 is either tangent to, or stands outwardly clear of brake rod clearance envelope 50. Each web has a central strut or portion 360 that lies between openings 346, 348. A center pin block 362 is mounted in the generally square or rectangular space or tube, or column formed between the internal webs 330, 332 that are inside bolster 320, generally, and the tubular liner inboard margins 352. Block 362 has a central bore defining a socket for the center pin. An example of this geometry is shown in FIGS. 12*c* and 13*a*.

Figure 13B:
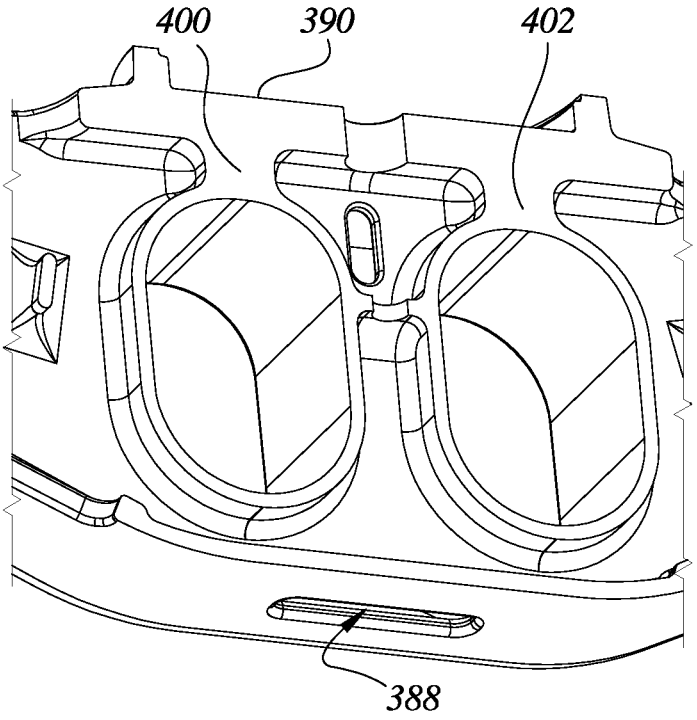
FIG. 13*b* is an alternate perspective view of the section of FIG. 13*a;*

The outside walls, or webs, 326, 328 have relatively small access openings 366 formed in the left hand and right hand transition regions as inboard of bolster gibs 62. The inner webs have larger internal, generally triangular or trapezoidal lightening openings 368. The ends of the web are planar and straight and merge perpendicularly into the end sections of the bolster. Struts or webs, or columns, or braces 370, 372 are formed in the internal webs between openings 346, 368; and between 348 and 368, respectively. A central transverse web or tie 364 joins the pairs of spaced apart internal webs. Lightening holes 374, 376 are formed in upper and lower flanges 334 and 336 respectively. All of the various openings have smoothly radiused corners. Bottom flange 336 is of substantially constant thickness over its central and sloped transitions 380, 382 and 384. Upper flange 334 is likewise of substantially constant thickness other than in the region of center plate bowl 40 and side bearing mounting interface regions 378. Bottom flange 336 may also have lightening apertures or holes or slots or drain holes 388 in the central portion as seen in FIGS. 13*b* (single, central aperture between internal webs) and 14*a* (two parallel apertures between the internal webs and external walls respectively).

In the embodiment of FIGS. 11*a*-11*d* and 12*a*-12*f*, the junctions between tubular liners 322, 324 and the various brake rod openings 346, 348 are smoothly radiused so that the sections merge without abrupt corners or edges.

Center plate bowl 40 has a base, or base wall, 390 and an upstanding peripherally extending rim 392. Base wall 390 has a radially outwardly extending lip, or flange or extension 394 that extends radially outwardly beyond rim 392. Base wall 390, including extension 394, is thicker than upper flange 334 generally.

The upper tubes, or tubular members, or partially tubular members, as may be, form arches underneath the center plate. These arches, or such transverse sections of them as may be, may be termed vaults, i.e., such as might alternatively be termed an arch, or archway, or arched ceiling, or ceiling portion, or tunnel roof portion, that over-spans at least a portion of the respective brake rod opening envelope and that spreads loads in the bolster and its various webs. The tubular liner, or such section or sections thereof as may be, also tends to aid the bolster structure in retaining its shape, namely the verticality and parallelism of the webs under load.

In the embodiment of FIGS. 13*a* and 13*b*, the geometry of center plate bowl 40 is shown in enlarged cross section. The embodiment of FIGS. 13*a* and 13*b* differs from the embodiment of FIGS. 11*a*-11*d* insofar as it also includes transversely extending ribs 400, 402 that are located underneath base wall 390, and above the centers of tube liners 322, 324. Ribs 400 and 402 merge smoothly into base wall 390 and into tube liners 322, 324.

Figure 14A:
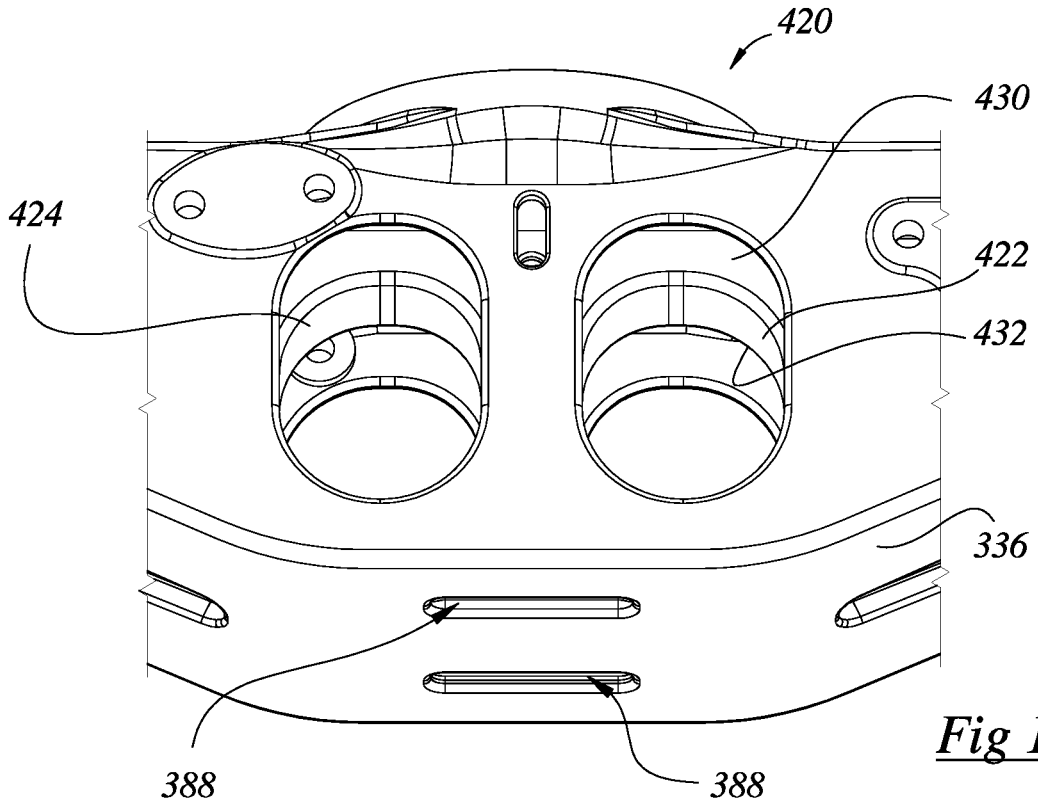
FIG. 14*a* shows a perspective view, partially from below of an enlarged detail of an alternate embodiment of bolster to that of FIG. 11*a* in which the brake rod opening lining tubes extend only between the internal webs of the bolster.
Figure 14B:
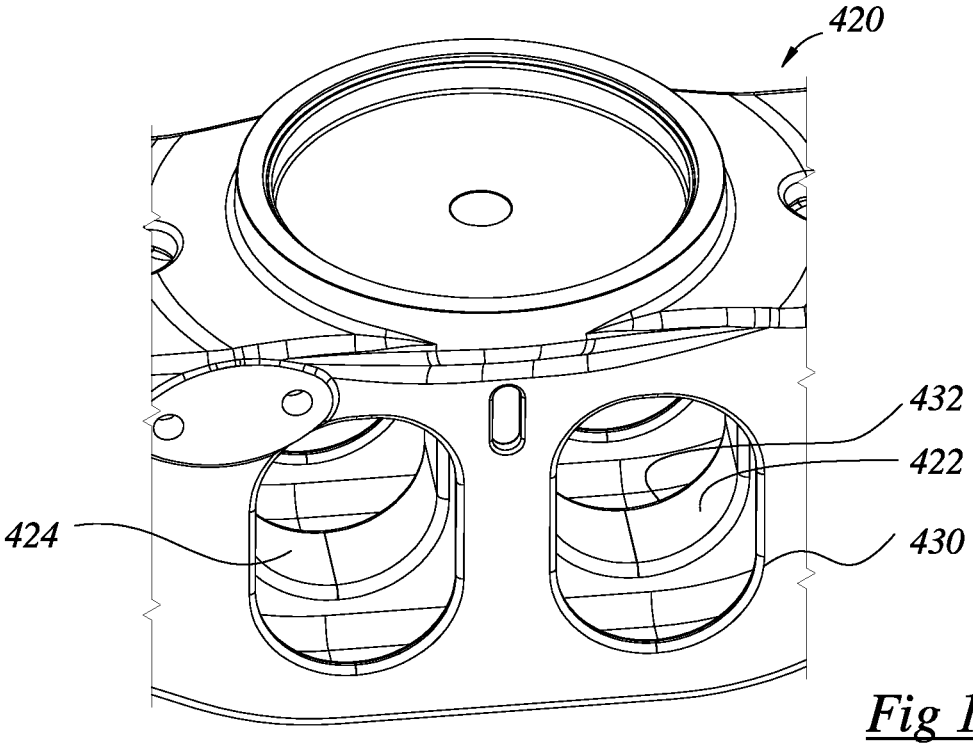
FIG. 14*b* shows a perspective view, partially from above of an enlarged detail of an alternate embodiment of bolster to that of FIG. 11*a* in which the brake rod opening lining tubes extend only between the internal webs of the bolster.

Whereas in the embodiment of FIGS. 11*a*-11*d*, tube liners 322, 324 extend across the full width of bolster 320, in the embodiment of FIGS. 14*a* and 14*b*, bolster 420 has tube liners 422, 424 that extend only between internal webs 430, 432. Lightening holes or slots 388 are formed in the central portion of bottom flange 336 as noted. Bolster 420 is otherwise similar to bolster 320.

Figure 14C:
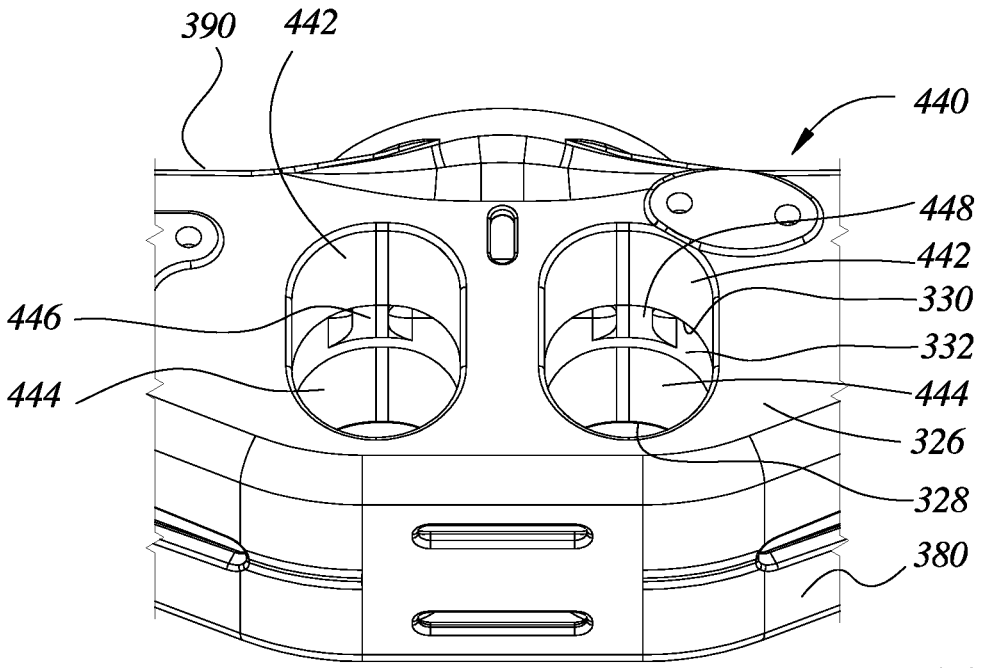
FIG. 14*c* shows a perspective view, partially from below of an enlarged detail of an alternate embodiment of bolster to that of FIG. 11*a* in which the brake rod opening lining tubes extend only between the outside walls and internal webs.

In the embodiment of FIG. 14*c*, bolster 440 has two sets of brake rod opening liners 442, 444 that extend, respectively, between and intersects smoothly with outside wall 326 and near side internal web 330; and between outside wall 328 and far side internal web 332. Transverse ribs 446, 448 correspond to ribs 400, 402 in merging with base wall 390 and with the uppermost regions of the respective tube liners, having a central portion between internal webs 330, 332 that spans the gap between the near side and far side liners, and acts to distribute center plate load between the near side and far side web pairs. Bolster 440 is otherwise similar to bolster 320.

Figure 14D:
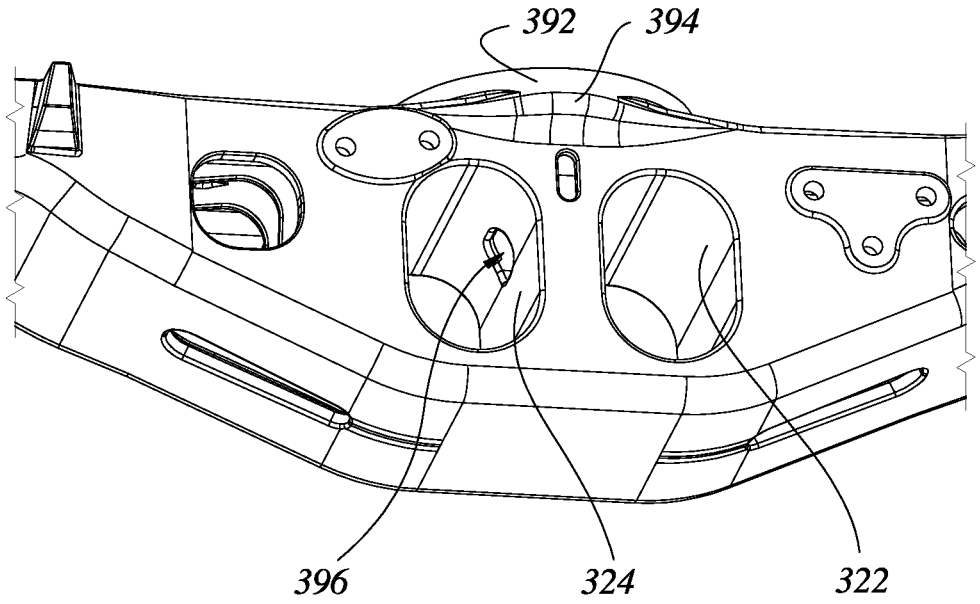
FIG. 14*d* shows a perspective view, partially from below of an enlarged detail of an alternate embodiment of bolster to that of FIG. 11*a* in which a center pin access opening is formed in the brake rod liners.

In the embodiment of FIG. 14*d*, a center pin access opening 396 is formed in the brake rod tube liners 322, 324 between the inner webs from roughly the 12 o'clock to 2 o'clock positions.

Figure 15C:
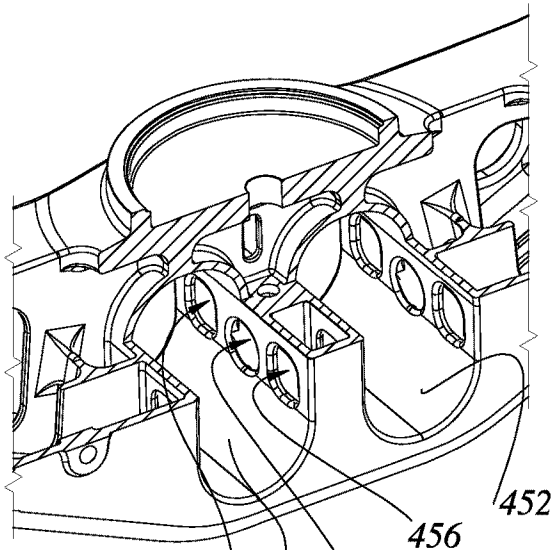
FIG. 15*c* shows a partial cross sectional perspective view of an enlarged detail of the bolster of FIG. 15*a;*
Figure 15A:
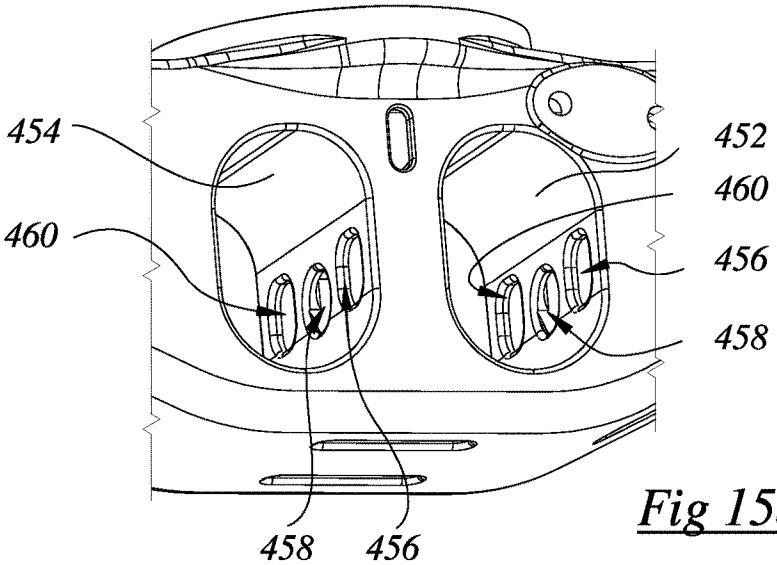
FIG. 15*a* shows a perspective view of an enlarged detail of the bolster of FIG. 11*a* or 13*a* in which the brake rod lining tubes have side openings.
Figure 15B:
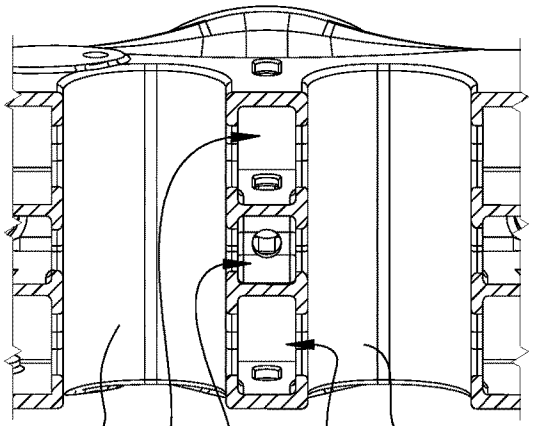
FIG. 15*b* shows a horizontal transverse section of the enlarged detail of FIG. 15*a*, taken at mid-height of the lining tubes, looking upward.

In the embodiment of FIGS. 15*a*, 15*b* and 15*c*, brake rod liners 452, 454 have lightening openings 456, 458 and 460 formed in the mid-height vertical side wall portions, the central opening.

In the embodiment of FIGS. 16*a* to 16*d*, brake rod liners 462, 464 have been opened in their lower portions, such that the remaining open section forms a "tunnel roof" vault or archway between at least one of the various inner and outer webs that is open at the sides and bottoms. The transversely extending arches, or vaults, 470, 472 and 474 are smoothly radiused, the spacing between internal webs 330, 332 being slightly narrower than the transverse spacing between each internal web 330 (or 332) and its transversely outboard adjacent side wall 326 (or 328). As viewed in FIGS. 16*c* and 16*d*, ribs 446, 448 merge into the tunnel roof. The tunnel roof over-spans at least a portion of the respective brake rod opening envelope and terminates downwardly flush with the profile of brake rod openings 346, 348 more generally. The tunnel roof may continuously extend from side wall 326 to side wall 328.

Figure 17A:
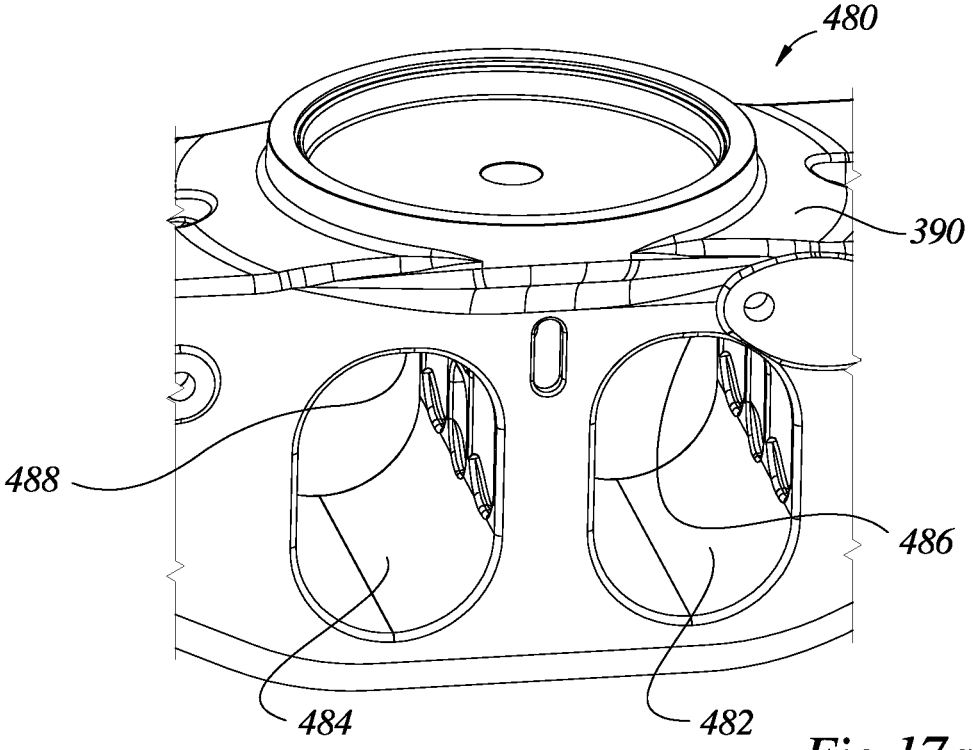
FIG. 17*a* shows an alternate embodiment of the bolster of FIG. 11*a* in which the brake rod opening tube lines a bottom portion of the brake rod opening, is open in upper regions thereof, and has transverse ribs under the center plate bowl.
Figure 17B:
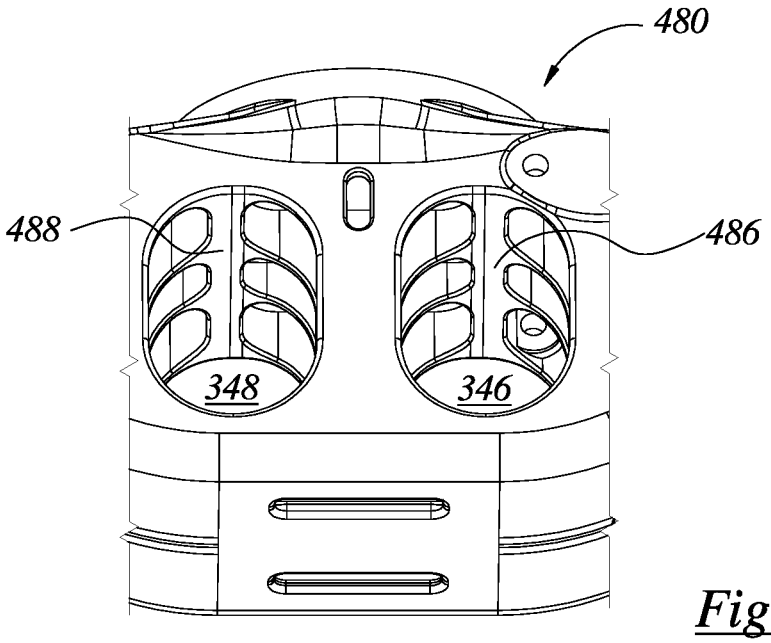
FIG. 17*b* is an alternate view of the bolster of FIG. 17*a*, seen partially from below.

In the embodiment of FIGS. 17*a* and 17*b*, bolster 480 has brake rod opening liners 482, 484 that are open at the sides and top, but closed along the bottom semi-circular curvature. Ribs 486, 488 extend transversely underneath base wall 390 as before, and terminate downwardly flush with the profile of brake rod openings 346, 348 more generally.

When a truck bolster such as truck bolster 24, or the other embodiments of truck bolsters shown and describe herein, is placed under repeated dynamic loading (e.g., with a downward distributed load within the center plate bowl reflecting the loaded rail car load, and with corresponding vertical reactions at the bolster ends), the top chord under the center plate bowl may want to fold downward and inward, also tending to bend the outside webs to bulge laterally outward. At the same time, the bottom chord may be stretched lengthwise, which may cause the center portion of the bottom chord to want to rise and become shorter relative to the outside fibers at the junctions of the outside webs with the bottom flange. The resultant effect is for the bottom flange to want to flex into a curved shape when viewed in transverse cross-section. In that context, in the family of embodiments and permutations of the bolster of FIGS. 2*a* to 10*b*, the addition of upper lateral ribs, or a thickened through-thickness of the base plate of center plate bowl 40 may tend to aid in resistance of lateral bending of the central portion of the compression member, and may tend to aid in resisting lateral bending or deviation of the predominantly upright or vertical webs. For example, when the car body is in a laterally rocking mode, such that a portion of the vertical load may be transferred through the side bearing, the load transferred through the center plate may tend to be concentrated along the edge of the chamfer of the center plate (not shown in drawings). Of course, the center plate may pivot in the center plate bowl generally in the range of +/−13 degrees of rotation. Throughout this range of motion, however, the location of the chamfer may tend typically to lie above rib 134 (on one side) or rib 136 on the other side. In such a loading condition, the rib may tend to distribute the load more evenly into the bolster structure the otherwise more highly concentrated line load, (or approximately line load).

The addition of transversely extending bottom ribs similarly gives the bottom chord, or bottom flange, of the bolster increased resistance to bending in the transverse direction, and tends to prevent the webs from deflecting laterally to a non-square orientation relative to the flange. That is, it may tend to increase the flexural resistance of the bottom flange in the transverse direction while at the same time enhancing the tendency of the internal and external webs (as may be) to maintain squareness, or perpendicularity, of the webs relative to the bottom flange.

Considering reinforcement of the base plate of the center plate bowl, alone, the use of the ribs may double the local flexural modulus of the base of the center plate bowl at the location of the rib as compared to the lateral flexural modulus of the top flange generally, i.e., such as based on the depth of section adjacent to the top flange openings, namely slots 65. Expressed differently, taking the diameter of the center plate bowl inside the rim as the length, and considering the rib and the adjacent portions of the center plate bowl regions influenced by the rib as a beam, the reinforcement ribs give the transverse stiffener a depth of section that is more than 1/10 of the lateral length, such that the section may be considered a low aspect ratio beam. In some instances the ratio of length to depth of section may be in the range of 7:1 to 5:1.

Similarly, reinforcement of the bottom flange by ribs may yield a transverse second moment of area $I_{yy}$, or flexural modulus $EI_{yy}$, that is more than double the flexural modulus of the plate defined by the bottom flange thickness, alone, and may be more than triple that value. This may also be taken as a short beam, or low aspect ratio beam. The length of the beam is the width of bottom flange 84. The depth of section is taken from the outside fiber of the bottom flange to the lowermost tangent of the brake rod openings, which corresponds to the top of the bottom rib most distant from the outside face of bottom flange 84. This aspect ratio of length to depth may be less than 10:1, and may be in the range of 8:1 to 5:1.

In the family of embodiments of FIGS. 11*a* to 17*b*, the tubular or partially tubular sections of the tunnel roof vaults or tunnel floor sections may tend to compel the webs to remain square relative to each other, and relative to the top and bottom flanges. The arches of the vaults tend to provide a relatively deep section with a large second moment of area, and therefore a large flexural modulus for resisting lateral bending in the top flange in general, and in the regions of the concentrated loads of the center plate bowl in particular. When a vertical rib is used in conjunction with the tunnel roof, the vertical rib links the vault to the base of the center plate bowl, such that a beam of comparatively deep section and short aspect-ratio is formed. That is, the base of the center plate bowl (or of the top flange of truck bolster 24 generally) forms the upper flange of a transverse beam; the rib forms the shear web; and the tunnel roof forms the bottom flange of the transverse beam. The depth of section is of the order of 1/3 of the overall height of the deep central portion of truck bolster 24, if only the roof vaults are employed as in FIGS. 16*a* and 16*b*, and greater than 1/2 of the bolster depth if a full continuous-periphery tube is employed. The aspect ratio of length of beam to depth of section is then of the order of less than 4:1, and may be as low as the range of 5:2 to 3:2.

The same, or similar, commentary can be made about the lower portion of the bolster, where the use of a lower semi-circular section, a rib, and the bottom flange may yield a short aspect ratio beam in which the semi-circular section is the top flange, and the lateral rib defines a shear web extending between the semi-circular section and the bottom flange. The aspect ratio of such a beam may be less than 4:1 and may be in the range of 3:1 to 6:5.

Figure 18A:
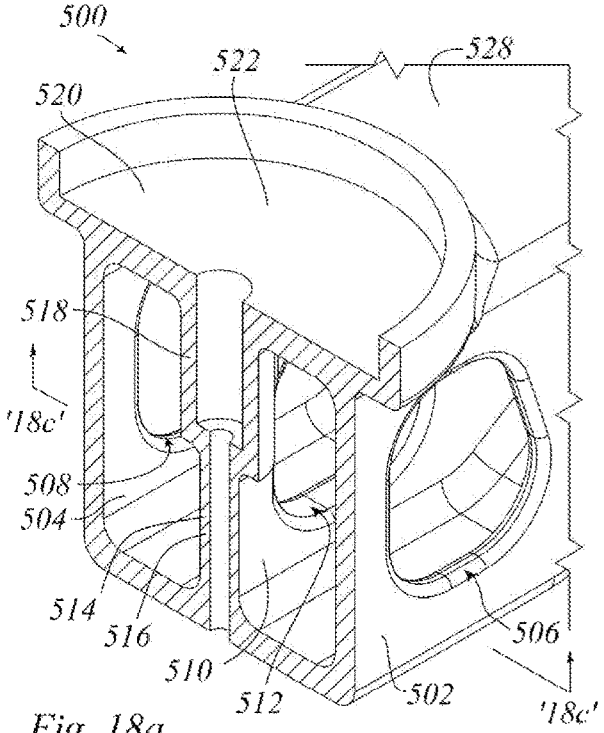
FIG. 18*a* shows a perspective view in section of a central portion of an alternate embodiment of bolster to that of FIG. 2*a;*
Figure 18D:
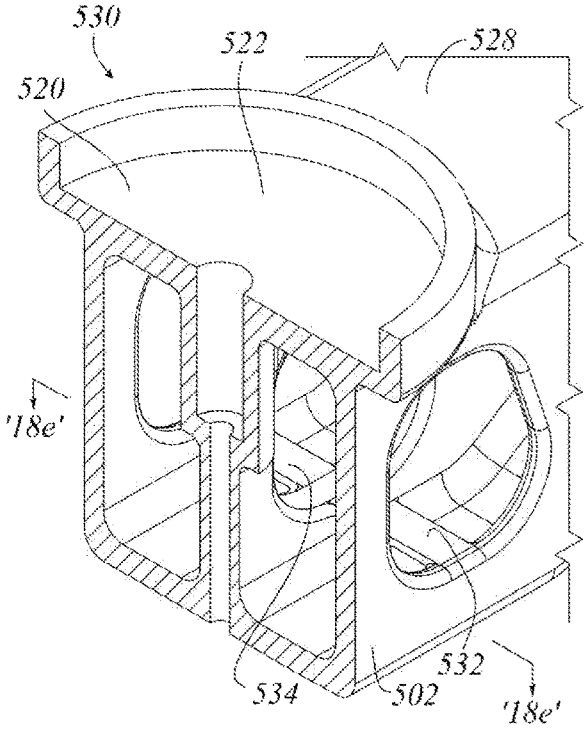
FIG. 18*d* shows a perspective sectional view of an alternate embodiment of central section of a bolster to that of FIG. 18*a*.
Figure 18B:
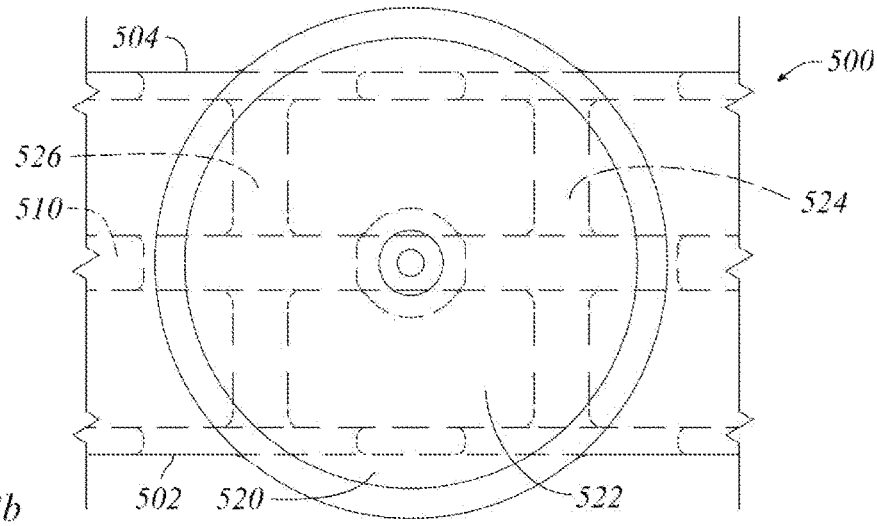
FIG. 18*b* shows a view from above of the bolster section of FIG. 18*a;*
Figure 18C:
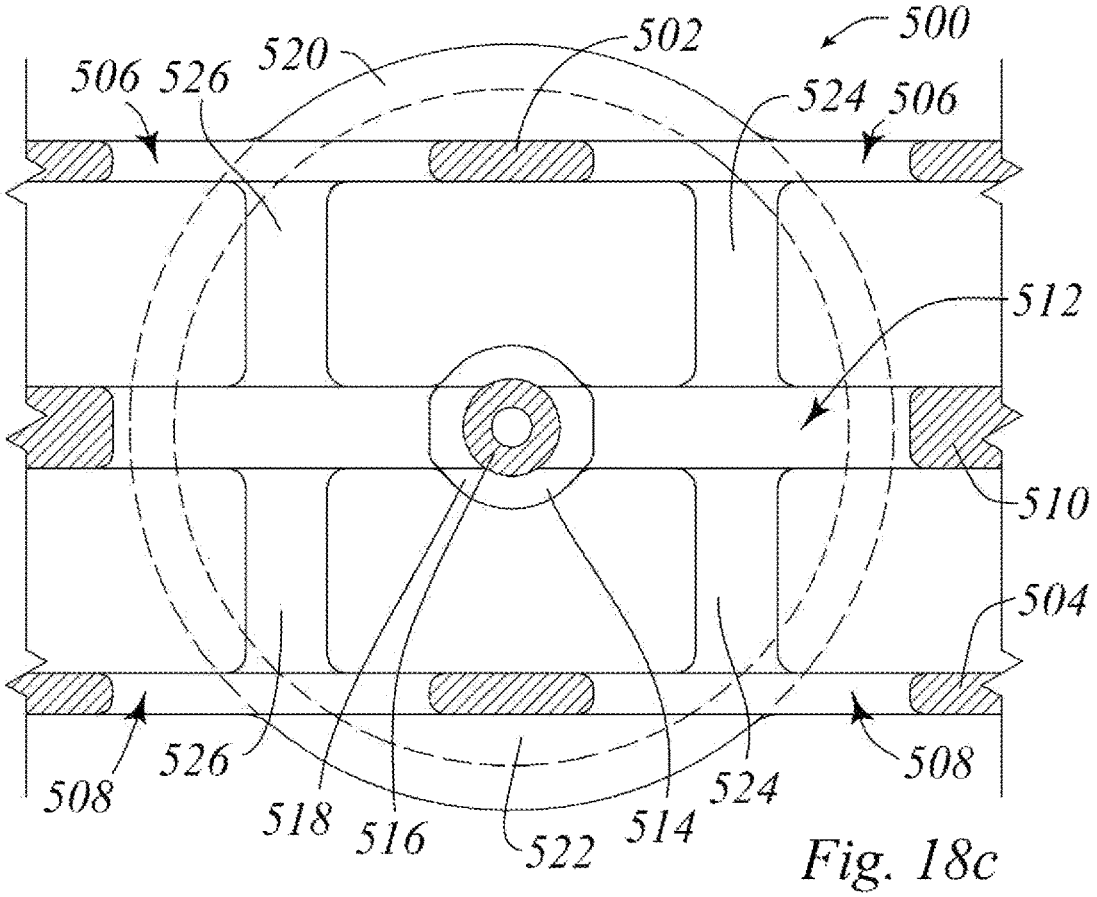
FIG. 18*c* shows a sectional view, looking upward, on '18*c*-18*c*' of FIG. 18*a;*

A further embodiment of bolster 500 is seen in FIGS. 18*a*, 18*b*, and 18*c*. Bolster 500 may be understood to be substantially the same as, or similar to, bolster 24. Outside webs 502, 504 have brake rod openings 506, 508. Rather than a spaced pair of internal webs as in bolster 24, bolster 500 has a single web 510. Web 510 may be located on the central vertical longitudinal plane of bolster 500, and may generally be taken as being the same as, or similar to, webs 130, 132 of bolster 24, but being a singular web rather than being a pair of spaced apart webs, and being thicker than webs 130, 132. That is, central web 510 is thicker than each of the first and second outside webs 502, 504. Web 510 may have roughly the same thickness as the sum of the thicknesses of webs 130, 132, or, alternatively, the sum of the thicknesses of outside webs 502, 504. In effect, conceptually central web 510 is similar to having a pair of webs 130, 132 where there is zero spacing between the webs.

Central web 510 has brake rod openings 512. Brake rod openings 506, 508 may be the same profile as, or substantially the same profile as brake rod opening 512, which, itself, may be of roughly the same profile as brake rod opening 162 or 164. A central fitting, or socket 514 may be formed in central web 510 for the center pin. Socket 514 is wider than web 510, and located centrally under center plate bowl 520. Socket 514 has a narrower diameter lower portion 516, and a wider, or larger diameter, upper portion 518. Upper portion 518 extends from roughly the half-way height of bolster 500 up to the base plate 522 of center plate bowl 520. Plate 522 may be thicker than webs 502 or 504. Plate 522 may be thicker than the general thickness of the top flange, or compression member 528, of bolster 500 distant from (i.e., outside of), center plate bowl 520). As indicated in FIGS. 18*b* and 18*c*, the underside of plate 522 may be have reinforcements, e.g., in the form of transversely extending first and second upper ribs 524, 526 that extend laterally away from central web 510 to intersect outside webs 502, 504. Ribs 524, 526 may be straight and perpendicular to web 510, and may be of constant depth and generally rectangular cross-section. Alternatively, ribs 524, 526 may have the form of any of the rib variations described above, whether generally straight as in FIGS. 5*a*-5*d*; FIGS. 6*a*-6*b*; FIGS. 7*a*-7*b*; or curved or arcuate in plan view as in FIGS. 8*a*-8*b*, without the need for further duplication of description. Similarly, the section need not be generally rectangular, but may follow the profile of the brake rod opening, and may terminate flush with that opening 512, or those openings 506, 508, or all of them, as may be. Similarly, alternate embodiments of bolsters 320, 420, 440, and 480, of FIGS. 11*a*-11*e*; FIGS. 13*a*-13*b*; FIG. 14*a*-14*b*; 15*a*-15*c*; 16*a*-16*b*; or 17*a*-17*b*, or alternative embodiments thereof, may also be made in arrangements having as single central internal web, such as web 510, rather than a pair of spaced apart internal webs.

Figure 16A:
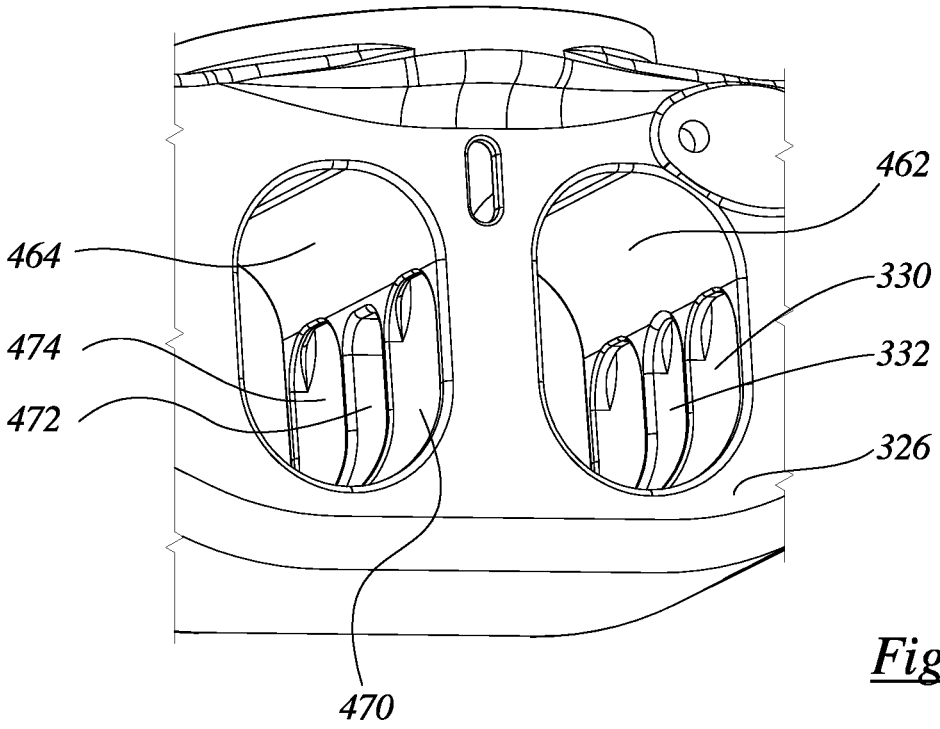
FIG. 16*a* is an enlarged alternate embodiment detail to that of FIG. 11*a*, the brake rod opening lining tubes extending as an arched roof, that is open below.
Figure 16B:
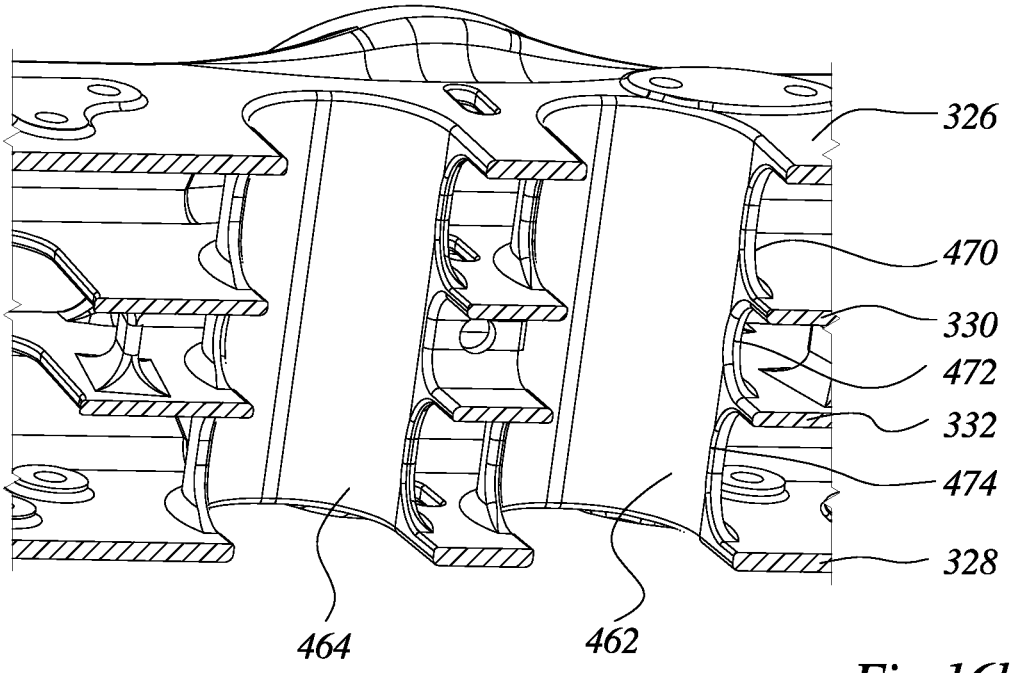
FIG. 16*b* is an enlarged detail of FIG. 16*a* on a transverse section looking upward.
Figure 16C:
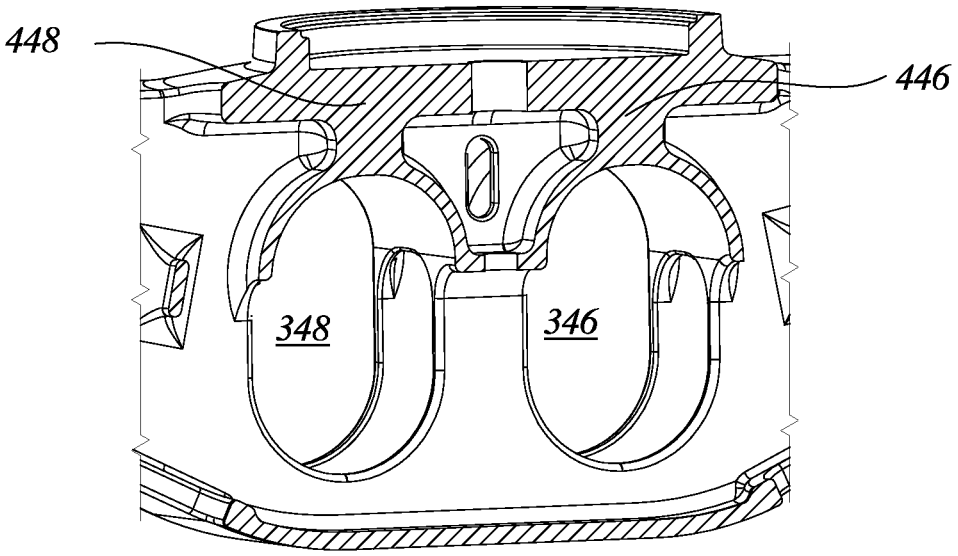
FIG. 16*c* is an alternate embodiment of the bolster of FIG. 16*a* having ribs extending between upper portions of the brake rod opening tube and the center plate bowl.
Figure 16D:
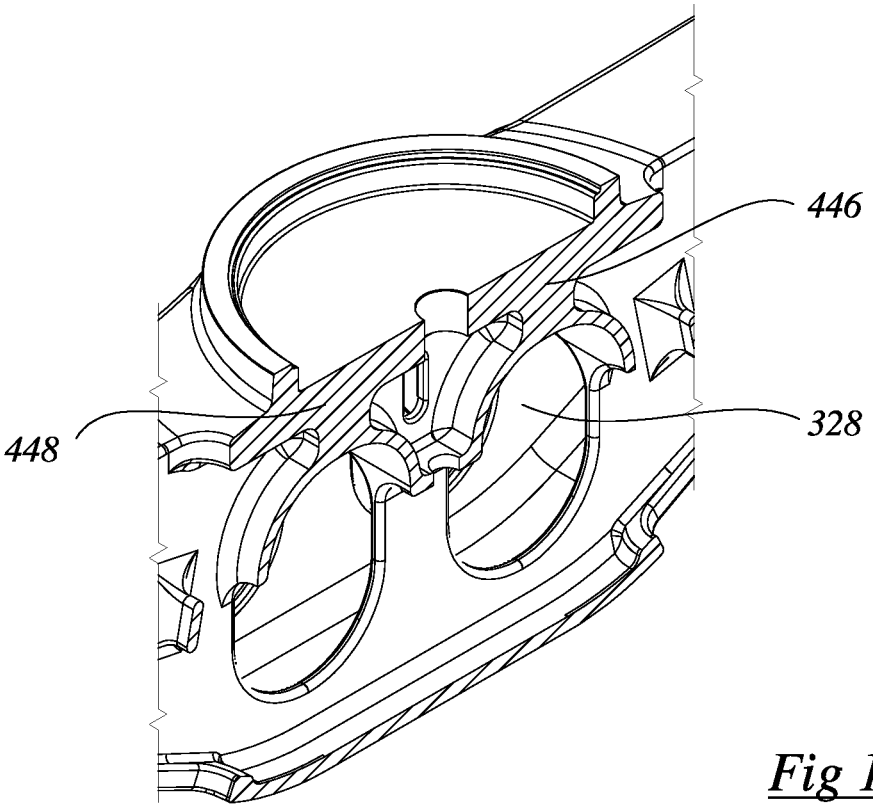
FIG. 16*d* shows an alternate perspective view of the enlarged detail of FIG. 16*c;*
Figure 18E:
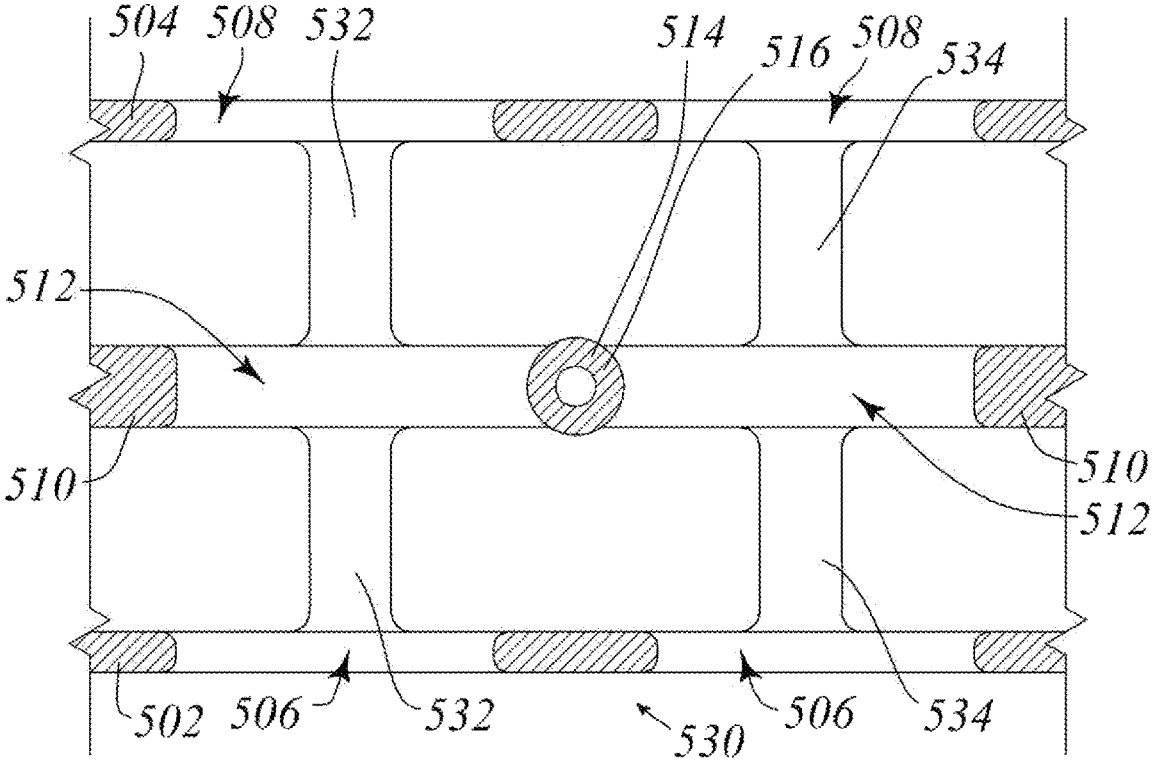
FIG. 18*e* shows a sectional view, looking downward, on '18*e*-18*e*' of FIG. 18*d*.

In FIGS. 18*d* and 18*e*, bolster 530 may be taken as being the same as bolster 500, but it may also have lower lateral reinforcements, such as may have the form of lower ribs 532, 534. Again, ribs 532, 534 may have the form of any of the variations of lower ribs shown or discussed above. Furthermore, bolster 530 (or bolster 500) may have both upper transversely extending reinforcements such as upper ribs 524, 526; and lower transversely extending reinforcements, such as lower ribs 532, 534. As above, a bolster arrangement having a single central web can be combined with a lower transverse rib arrangement of ribs such as ribs 532, 534, and such as web 510 or a central web analogous thereto may have bottom rib or bottom flange reinforcement arrangements such as shown in FIGS. 10*a*-10*f*; FIGS. 11*a*-11*d* and 12*a*-12*d*; FIGS. 13*a*-13*b*; FIG. 14*a*-14*b*; FIGS. 15*a* and 15*c*; FIGS. 16*c*-16*d*; and FIGS. 17*a*-17*b*.

The features of the various embodiments may be mixed-and-matched as appropriate. That is, although a large number of alternate embodiments have been shown and described in respect of the families of FIGS. 2*a*-10*b* and 11*a*-17*b*, other alternate combinations and permutations of the rib and web features of each of those families can be made.

Various embodiments have been described in detail as indicated above. Since changes in and or 9additions to the above-described examples may be made without departing from the nature, spirit or scope of the invention, the invention is not to be limited to those details.

We claim:

1. A railroad car truck bolster comprising:

a hollow beam having a lengthwise extending tension member, a lengthwise extending compression member, and lengthwise running upstanding webbing extending between said compression member and said tension member, said compression member including a center plate bowl;

said bolster having first and second brake rod clearance opening envelopes defined transversely therethrough;

said webbing including first and second external webs extending between said lengthwise extending tension member and said lengthwise extending compression member;

said webbing including a first internal web and a first internal rib within said hollow beam, said first internal rib extending side-ways relative to said first internal web;

said first internal web having first and second brake rod openings providing clearance for said first and second brake rod opening clearance envelopes; and said first brake rod opening having a periphery, said first rib standing upward of said tension member and having an uppermost margin flush with said periphery of said first brake rod opening.

2. The railroad car truck bolster of claim 1 wherein said first internal web has a second brake rod opening having a periphery, and a second rib standing upwardly of said tension member, said second rib having an uppermost margin flush with said periphery of said second brake rod opening.

3. The railroad car truck bolster of claim 2 wherein:

said first and second ribs are a lower first rib and a lower second rib;

said bolster has an upper first rib and an upper second rib, said upper first rib extending underneath said center plate bowl between said first internal web and said second internal web; and said first and second upper ribs terminating clear of said first and second brake rod opening clearance envelopes respectively.

4. The railroad car truck bolster of claim 3 wherein said first and second upper ribs terminate flush with, and conform to, said first brake and second brake rod opening clearance envelopes respectively.

5. The railroad car truck bolster of claim 1 wherein said webbing includes a second internal web spaced from said first internal web, and said first internal rib runs across said tension member between said first web and said second web.

6. The railroad car truck bolster of claim 5 wherein said first rib extends across said tension member from said first external web to said second external web.

7. The railroad car truck bolster of claim 1 wherein said first internal rib is a lower first internal rib; said bolster has an upper first rib, said upper first rib extending underneath said center plate bowl sideways relative to said first web, said first upper rib terminating clear of said first brake rod opening envelope.

8. The railroad car truck bolster of claim 7 wherein said first upper rib terminates flush with, and conforms to, said first brake rod opening.

9. A railroad car truck bolster comprising:

a hollow beam having a lengthwise extending tension member, a lengthwise extending compression member, and lengthwise running upstanding webbing extending between said compression member and said tension member, said compression member including a center plate bowl;

said bolster having first and second brake rod opening envelopes defined transversely therethrough;

said webbing including first and second external webs extending between said lengthwise extending tension member and said lengthwise extending compression member;

said webbing including a first internal web;

said first internal web having first and second brake rod openings providing clearance for said first and second brake rod opening envelopes;

said first and second brake rod openings having respective peripheries, said peripheries of said brake rod openings of said first internal web merging flush into said tension member.

10. The railroad car truck bolster of claim 9 wherein:

said bolster has a second internal web spaced from said first internal web;

said second internal web has corresponding first and second brake rod openings, said brake rod openings having respective peripheries that merge flush into said tension member; and said bolster also has first and second center plate bowl reinforcement ribs running between said first and second webs below said center plate bowl and upwardly of said first and second brake rod openings of said first and second internal webs.

* * * * *